US006262704B1

(12) United States Patent
Kurumisawa et al.

(10) Patent No.: US 6,262,704 B1
(45) Date of Patent: Jul. 17, 2001

(54) METHOD OF DRIVING DISPLAY DEVICE, DISPLAY DEVICE AND ELECTRONIC APPARATUS

(75) Inventors: Takashi Kurumisawa; Akihiko Ito; Shingo Isozaki; Masuhide Ikeda; Makoto Katase, all of Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 08/894,865

(22) PCT Filed: Dec. 13, 1996

(86) PCT No.: PCT/JP96/03648

§ 371 Date: Nov. 14, 1997

§ 102(e) Date: Nov. 14, 1997

(87) PCT Pub. No.: WO97/22036

PCT Pub. Date: Jun. 19, 1997

(30) Foreign Application Priority Data

Dec. 14, 1995 (JP) ..... 7-325648

(51) Int. Cl.[7] ..... G09G 3/36

(52) U.S. Cl. ..... 345/98; 345/100; 345/214; 348/555; 348/556

(58) Field of Search ..... 345/89, 99, 103, 345/211, 212, 213, 38, 127, 132, 100, 90, 95; 348/554, 555, 556, 557, 558

(56) References Cited

U.S. PATENT DOCUMENTS

| | | | | |
|---|---|---|---|---|
| 4,378,557 | | 3/1983 | Murata . | |
| 4,679,043 | * | 7/1987 | Morokawa | 340/784 |
| 4,748,444 | | 5/1988 | Arai . | |
| 5,248,965 | | 9/1993 | Yoshimitsu . | |
| 5,376,944 | * | 12/1994 | Mogi et al. | 345/100 |
| 5,394,166 | * | 2/1995 | Shimada | 345/98 |
| 5,598,565 | * | 1/1997 | Reinhardt | 395/750 |
| 5,748,175 | * | 5/1998 | Shimada et al. | 345/127 |
| 5,881,299 | * | 3/1999 | Normura et al. | 395/750.06 |
| 5,900,856 | * | 5/1999 | Iino et al. | 345/100 |

FOREIGN PATENT DOCUMENTS

| | | |
|---|---|---|
| 3347345 A1 | 7/1984 | (DE) . |
| 0 043 277 A2 | 1/1982 | (EP) . |
| 0 106 386 A2 | 9/1983 | (EP) . |
| 0 378 293 A2 | 7/1990 | (EP) . |
| 0 455 204 A2 | 11/1991 | (EP) . |
| 050 032 | 12/1980 | (GB) . |
| 2 262 377 | 6/1993 | (GB) . |
| WO 87/05429 | 9/1987 | (WO) . |

OTHER PUBLICATIONS

Rycke, Igor D., et al.; "2–MHZ Clocked LCD Drivers on Glass"; IEEE Journal of Solid–State Circuits, vol. 25, No. 2; Apr. 1, 1990; pp. 531–538.

* cited by examiner

*Primary Examiner*—Bipin Shalwala
*Assistant Examiner*—Mansour M. Said
(74) *Attorney, Agent, or Firm*—Harness, Dickey & Pierce, P.L.C.

(57) ABSTRACT

A driving method of a display device in which the number of voltage levels of scanning lines during a non-selection period is only one, and the voltage level of a data line corresponding to a display element that presents no image is set to the voltage level of the scanning lines during the non-selection period. The power consumption of the display device is thus reduced. A minimum area of the entire screen of the device is used for image presentation while the remaining area is set to a display-off state (display-off mode) using the above driving method, and thus the power consumption of the display device, for example, in a standby state is reduced. Each of the display-enabled area and the display-off area is flexibly set. A combination of a multi-line driving method and the above driving method helps further reduce power consumption.

36 Claims, 45 Drawing Sheets

| NUMBER OF MULTI-LINES | NUMBER OF VOLTAGE LEVELS FOR DATA LINES |
|---|---|
| L | L + 1 |

FIG. 23A $$\begin{pmatrix} 1 & 1 & 1 & 1 \\ 1 & 1 & 0 & 0 \\ 1 & 0 & 0 & 1 \\ 1 & 0 & 1 & 0 \end{pmatrix}$$

FIG. 23B $$\begin{pmatrix} 0 & 0 & 1 & 0 \\ 0 & 1 & 0 & 0 \\ 1 & 0 & 0 & 0 \\ 0 & 0 & 0 & 1 \end{pmatrix}$$

FIG. 30A

| BO | INPUT | INPUT TERMINALS | OUTPUT TERMINALS | EN1 | EN2 |
|---|---|---|---|---|---|
| L | D0 | 1A | 1Y | H | |
| | D1 | 2A | 2Y | H | |
| | D2 | 3A | 3Y | H | |
| | D3 | 4A | 4Y | H | |
| | D0 | 5A | 5Y | | L |
| | D1 | 6A | 6Y | | L |
| | D2 | 7A | 7Y | | L |
| | D3 | 8A | 8Y | | L |

FIG. 30B

| BO | INPUT | INPUT TERMINALS | OUTPUT TERMINALS | EN1 | EN2 |
|---|---|---|---|---|---|
| H | D0 | 1B | 1Y | H | |
| | D0 | 2B | 2Y | H | |
| | D1 | 3B | 3Y | H | |
| | D1 | 4B | 4Y | H | |
| | D2 | 5B | 5Y | | H |
| | D2 | 6B | 6Y | | H |
| | D3 | 7B | 7Y | | H |
| | D3 | 8B | 8Y | | H |

METHOD OF DRIVING DISPLAY DEVICE, DISPLAY DEVICE AND ELECTRONIC APPARATUS

TECHNICAL FIELD

The present invention relates to a method of driving a display device, a display device and an electronic apparatus and, in particular, to a technique for reducing the power consumption of the display device.

BACKGROUND ART

Since passive matrix type liquid-crystal display devices need no costly switching elements and are less expensive than active matrix type liquid-crystal display devices, the passive matrix type liquid-crystal display devices find widespread use as monitors of portable computers and portable electronic apparatuses.

The following methods are known as the methods of driving the passive matrix type liquid-crystal display device.

(1) APT method (IEEE TRANSACTIONS OF ELECTRON DEVICE, VOL, ED-21, No. 2, FEBRUARY 1974 P146–155 "SCANNING LIMITATIONS OF LIQUID-CRYSTAL DISPLAYS" P. ALT, P. PLESHKO, ALT&PLESHKO TECHNIC).

(2) Smart Addressing (LCD International '95, Liquid-Crystal Display Seminars held under the sponsorship of Nikkei BP, C-4 Lecture No. (1), by Matsushita of Tottori SANYO Electric, Co., Ltd).

(3) Multi-line driving methods (for example, Japanese Patent Application 4-84007, Japanese Unexamined Patent Publication No. 5-46127, and Japanese Unexamined Patent Publication No. 6-130910).

Besides the demand for miniaturization and light weight, there is a growing demand for longer time of displaying without the need for battery replacement in the field of the portable electronic apparatuses such as cellular telephones and pagers. Therefore, a low power consumption feature is rigorously required of the display device used in such portable electronic apparatuses.

The inventor of this invention has extensively studied the passive matrix type liquid-crystal display device with a view to reducing power consumption.

The study has shown that prior art passive matrix liquid-crystal display devices have to supply an alternating current of 20 V or higher in amplitude to both scanning lines and signal lines even during a display-off time, that the power consumption in the power supply circuit for generating that alternating current is considerably large, and that currents flowing between the scanning lines and the data lines via liquid crystals are also considerably large.

The present invention has been developed with a view to resolving such problems.

SUMMARY OF THE INVENTION

One of the primary objects of the present invention is to reduce power consumption of a display device such as a passive matrix type liquid-crystal display device.

In a preferred embodiment of the display device of the present invention, the number of voltage levels of scanning lines during a non-selection period is only one, and to set a display element to a display-off state, the voltage level of the data line corresponding to that display element is set to the voltage level of the scanning lines during a non-selection period.

In such a driving method, if image presentation is performed with the polarity of the selection voltage to the scanning lines being periodically alternated, the voltage level during a non-selection period remains unchanged (at a single level) regardless of the polarity of the selection voltage for the scanning lines. By employing the voltage level of the data line as the non-selection voltage level of the scanning line, display-off state is easily performed.

The display-off state means a disabled state of the display. The screen of the display-off state corresponds to the screen in a display-off mode. The display-off mode is a mode available to achieve an extremely low power consumption. In the description that follows, the terms "display-off state", "display-off mode", and "display-off mode screen" are frequently used.

In the present invention, when a scanning line is set to a non-selection voltage with a data line set to the same voltage, no voltage difference between both lines appears activating a display-off state (display-off mode).

Since the number of non-selection voltage levels is only one, the power supply circuit for generating the non-selection voltage is simple, and the power consumption of the power supply circuit is reduced. Compared with the method where the non-selection voltage is changed periodically, equalizing the data line voltage to the scanning line voltage is easy, and the power consumption with a display panel attributed to the voltage difference between the scanning line and the data line is reduced. Thus, power consumption of the display device is accordingly reduced.

Even when a selection pulse enters the scanning line with the voltage level at the data line kept to the non-selection voltage level of the scanning line, the display-off state is maintained. This is because simply selecting a scanning line during a selection-period is not sufficient enough to exceed the threshold of the liquid crystal and keeps the display-off state.

Based on this principle, one area in one screen is set to the display-off mode while the remaining area is allowed to present a predetermined image such as icons by controlling properly the voltage applied to the data line.

In a preferred embodiment of the present invention, a display control signal is applied to each of a plurality of ICs to drive the data lines, and by the display control signals, at least parts of data line drive outputs from the ICs are set to the voltage level of the scanning lines during a non-selection period.

A plurality of ICs are arranged as data line drivers, and the data line drive outputs from the ICs on a per IC basis is kept to the voltage level of the scanning lines during the non-selection period. In this way, the area covered by that IC is set to the display-off state (display-off mode).

In a preferred embodiment of the present invention, when at least parts of data line drive outputs are set to the voltage level of the scanning lines during the non-selection period, the supply of, at least, either display data or a high-frequency clock for transferring the display data to the IC is suspended.

By suspending the display data in the area in display-off state (the area in the display-off mode) or the high-frequency clock to be used for the transfer of the display data, low power consumption design is further promoted.

In a preferred embodiment of the present invention, a display control signal is applied to the driving circuit for the data lines to individually control the data-line drive outputs and to selectively set a desired drive output to the voltage level of the scanning lines during the non-selection period.

With this arrangement, the area in the display-off state is flexibly set.

In a preferred embodiment of the present invention, the data-line driving circuit, constructed of a plurality of blocks, is supplied with the display control signal, which controls the data line drive outputs on a block by block basis so that the data line drive outputs within any block are set to the voltage level during the non-selection period.

In this way, the area in a display-off state is flexibly set on a block by block basis.

In a preferred embodiment of the present invention, h scanning lines out of the plurality of scanning lines (h is an integer equal to or greater than 2) are simultaneously selected, and each of the selected scanning lines is supplied with a scan voltage based on a predetermined selection voltage pattern, while each of the data lines is supplied with a voltage that is determined by comparing the selection voltage pattern with the display data representative of the display status of each display element so that a desired display is presented, and to activate no image presentation state (display-off mode screen), the display control signal fed to the data-line driving circuit sets, at least, parts of the data line drive outputs to the voltage level of the scanning lines during the non-selection period.

The driving method of activating the display-off state (display-off mode screen) is applied to a display device which features a known multi-line driving technique.

In this case, along with the advantage of the multi-line driving method that the level of the selection voltage applied to the scanning lines is lowered during image presentation, the effect of low power consumption during the display-off state further promotes reduction of power consumption.

In a preferred embodiment of the present invention, the number of scanning lines, h, simultaneously selected in the multi-line driving is set to be an even number.

When the number of simultaneously selected scanning lines is h, the number of voltage levels of the data lines is necessarily "h+1". If h is an even number, "h+1" is an odd number, and the voltage levels of the data lines are symmetrically distributed with its "predetermined reference voltage level" placed centrally with one half the voltage levels on the positive side and the other half on the negative side of the predetermined reference voltage level. The "predetermined reference voltage level" can be set to coincide with the scan voltage level during the non-selection period. Specifically, when the number of the simultaneously selected scanning lines is even, the middle one of the voltage levels of the data lines may be set to coincide with the voltage level of the scanning lines during the non-selection period. For this reason, setting a new voltage level for the scanning line during the non-selection period as the voltage level for the data line is not required to activate display-off state. This arrangement simplifies design and avoids an increase in circuit complexity, thereby leading to reduction of power consumption.

In a preferred embodiment of the present invention, the number of simultaneously selected scanning lines is 2, 4, 6, or 8.

As the number of simultaneously selected scanning lines increases, the scale of the circuit for driving them is accordingly enlarged, and the larger-scale driving circuit will work to the contrary to the prime object of the present invention of reducing power consumption. For this reason, the practicable number for simultaneously selected scanning lines, h, is 2, 4, 6, or 8.

The display device of the present invention incorporating the above-described driving method supplies desired data lines with the non-selection voltage, thereby flexibly setting a display-off state area (an area in display-off mode).

In a preferred embodiment of the display device of the present invention, by decoding the display control data and display data, an area to be in display-off state is designated on a per data line basis, or by a combination of a plurality of display control signals, an area to be in display-off state is designated on a per block basis.

In a preferred embodiment of the display device of the present invention, a display-enabled area is set to be smaller in size than the display-off state area (the area in the display-off mode) so that needless power consumption during standby time is restricted.

In a preferred embodiment of the display device of the present invention, the display device has a section that covers at least part of the screen and the area covered by the section becomes a display-off state area.

The area in the display-off state remains invisible to a user. The section that covers at least part of the screen is constituted by at least one movable member, such as a sliding cover. The screen entirely or partly is retracted in the cabinet of the display device depending on operating conditions.

The electronic apparatus of the present invention incorporates the display device that is capable of designating properly the display-off area.

In a preferred embodiment of the present invention, to drive a display device that comprises N scanning lines (N is an integer equal to or greater than 2), M data lines (M is an integer equal to or greater than 2), a plurality of display elements, the display state of which is controlled by a voltage applied to the scanning lines and a voltage applied to the data lines, a driving circuit for the scanning lines, and a driving circuit for the data lines, a display control signal is applied to the scanning-line driving circuit, consecutive K scanning lines (K is an integer equal to or greater than 2 but smaller than N) out of the N scanning lines are deselected from the range of selection, based on the display control signal, only (N−K) scanning lines are selected to be displayed, and the scanning line voltage level during the selection period when (N−K) scanning lines are driven is set to be lower than the scanning line voltage level during the selection period when N scanning lines are driven.

When the border of the display-off state area is arranged in the direction of the scanning lines (in the Y direction), K scanning lines corresponding to the display-off state area excluded from the range of selection. With this arrangement, the duty factor (thus, the number of scanning lines driven) in the driving of the display device changes, and along with the duty factor change, the selection voltage level for the scanning lines for appropriate image presentation is accordingly lowered. The lowered selection voltage level in turn reduces power consumption.

The change of the voltage level of the scanning lines during the selection period is performed by using the display control signal that changes the level of the voltage a variable voltage source supplies to the scanning-line driving circuit. The variable voltage source may be constituted by a bootstrap circuit, for example.

In a preferred embodiment of the present invention, resolution conversion is performed to a displayed image when the multi-line driving method is employed to present the image.

The resolution conversion is performed by applying the same scan voltage to consecutively arranged Q scanning lines when a resolution 1/Q (Q is an integer equal to or greater than 2) is designated by a resolution conversion signal, and by selecting simultaneously (Q×h) scanning lines. The resolution 1/Q means not only that the duty factor in the driving of the display device varies, but also that the size of the image is multiplied by Q times. In this case, while power consumption remains almost unchanged, the size of the image is enlarged, and appeal to the user's vision is substantially increased.

In a preferred embodiment of the present invention, to drive a display device that comprises N scanning lines (N is an integer equal to or greater than 2), M data lines (M is an integer equal to or greater than 2), a plurality of display elements, the display state of which is controlled by a voltage applied to the scanning lines and a voltage applied to the data lines, a driving circuit for the scanning lines, and a driving circuit for the data lines, the number of voltage levels of the scanning lines during a non-selection period is only one, a display control signal is applied to the driving circuit for the scanning lines, an area corresponding to consecutive K scanning lines (K is an integer equal to or greater than 2 but smaller than N) out of N scanning lines is set as an area not to be displayed, an area corresponding to the remaining scanning lines is set as a display-enabled area, the K scanning lines are kept to the voltage level during the non-selection period without applying a selection voltage thereto, while the data lines are supplied with the voltage, which is fet for image presentation, for a duration in which the K scanning lines should otherwise be selected.

When the border of the display-off state area is arranged in the direction of the scanning line (in the Y direction), the K scanning lines corresponding to the area in display-off state are included in the range of selection without varying the duty factor in the driving of the device, and on the other hand, the data lines are supplied with the voltage of the level for displaying rather than with the scanning line voltage during the non-selection period, for a duration corresponding to the display-off state area. No change in the selection voltage of the scanning lines is required, because the driving duty factor remains unchanged. Thus, the complexity in the construction of the power supply circuit is not increased. When a driving method of selecting simultaneously a plurality of scanning lines is adopted, the above driving method may be applied.

In a preferred embodiment of the display device of the present invention, during a standby time, the area other than the smallest display area required is set as the display-off state area (screen in the display-off mode) by using one of a variety of the above driving methods to reduce power consumption.

In a preferred embodiment of the display device of the present invention, a plurality of switch means are arranged in voltage paths to the scanning lines or data lines, and when no image is presented, the switch means are put to an open state to float electrically scanning lines or data lines.

In this case, the conductive paths interconnecting the scanning lines, electro-optic elements such as liquid crystals existing between the scanning lines and data lines, and the data lines are completely disconnected from a voltage source. For this reason, unwanted currents are prevented from flowing through the electro-optic elements. Since the scanning lines and data lines are electrically unstable with this arrangement, an unwanted display may be created by static electricity or the like, and thus a cover is preferably mounted entirely on a display panel to relieve the user of uncomfortable feelings.

In a preferred embodiment of the display device of the present invention, at least two display panels are provided, and the duty factor in the driving of one of the two panels is adequately set so that the selection voltage level of the scanning lines is set to coincide with the voltage level applied to the data lines. With this arrangement, the construction of the power supply circuit is simplified.

In a preferred embodiment of the display device of the present invention, the driving circuit for driving a display matrix is provided with one function for driving the scanning lines and another function for driving the data lines.

The functions of the driving circuit are adequately switched in accordance with the size and shape of the image display area to vary the duty factor in the driving of the device, and thus the voltage of the scanning lines during selection period is reduced, and thus the power consumption during image presentation is reduced.

DETAILED DESCRIPTION OF THE PREFERRED EMBODIMENT

Before discussing the embodiments of the present invention, the content of the study of the prior art conducted by the inventor of this invention prior to the development of the present invention is now discussed.

(1) Study of the Prior Art by the Inventor of the Present Invention

Figure 44:
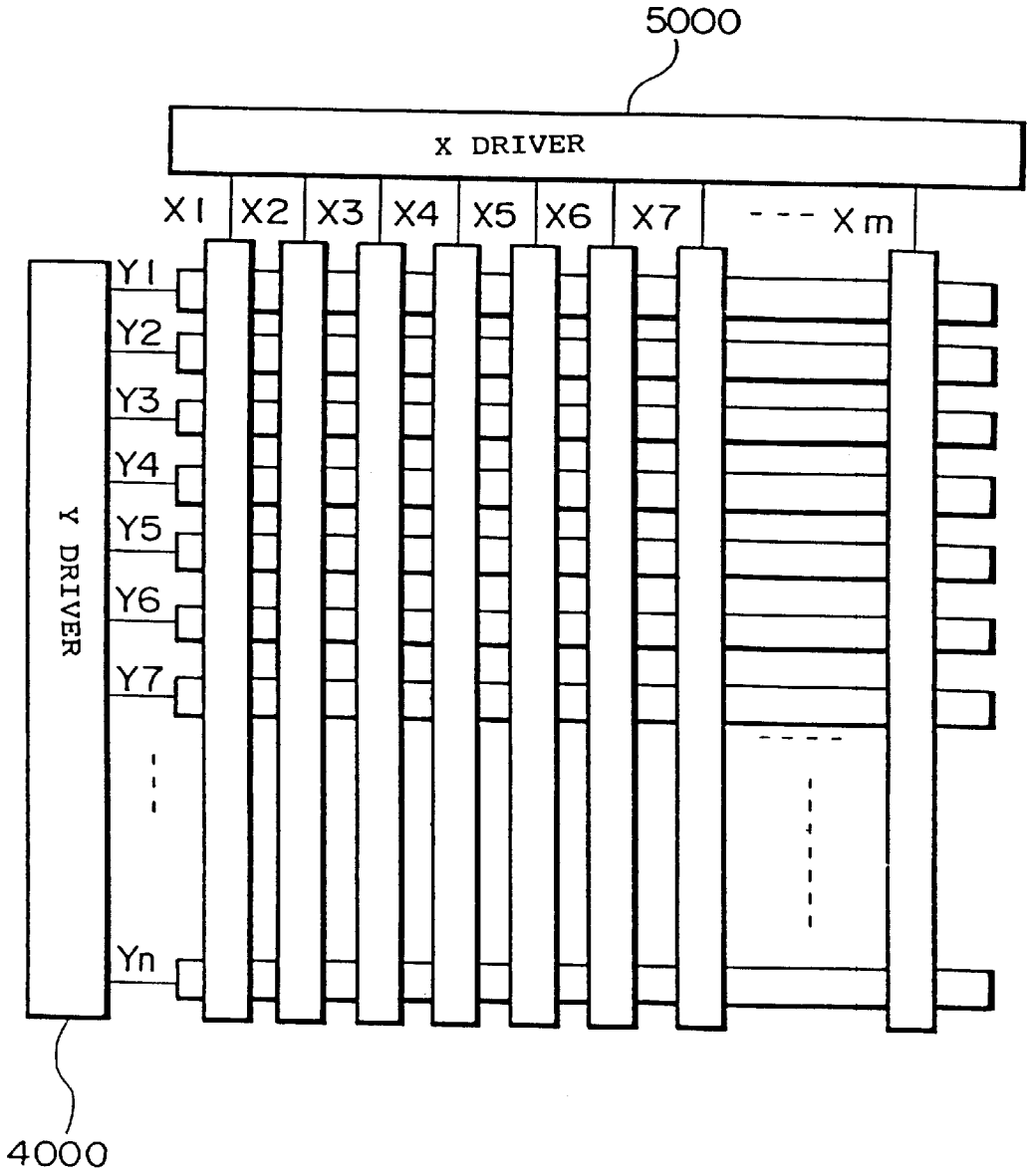
FIG. 44 is a diagram showing a major construction of a standard passive matrix type liquid-crystal display device.

As shown in FIG. 44, passive matrix type liquid-crystal display devices comprise a first substrate having a plurality of scanning lines Y1~Yn thereon and a second substrate having a plurality of data lines X1~Xm thereon, with a liquid crystal applied between the two substrates to seal them, and a Y driver (a scanning-line driving circuit) 4000 and an X driver (a data-line driving circuit) 5000 drive the scanning lines and the data lines, respectively, to control the display state of each pixel (a display element) placed at each of the intersections of the scanning lines and the data lines and to present a desired display.

Figure 45:
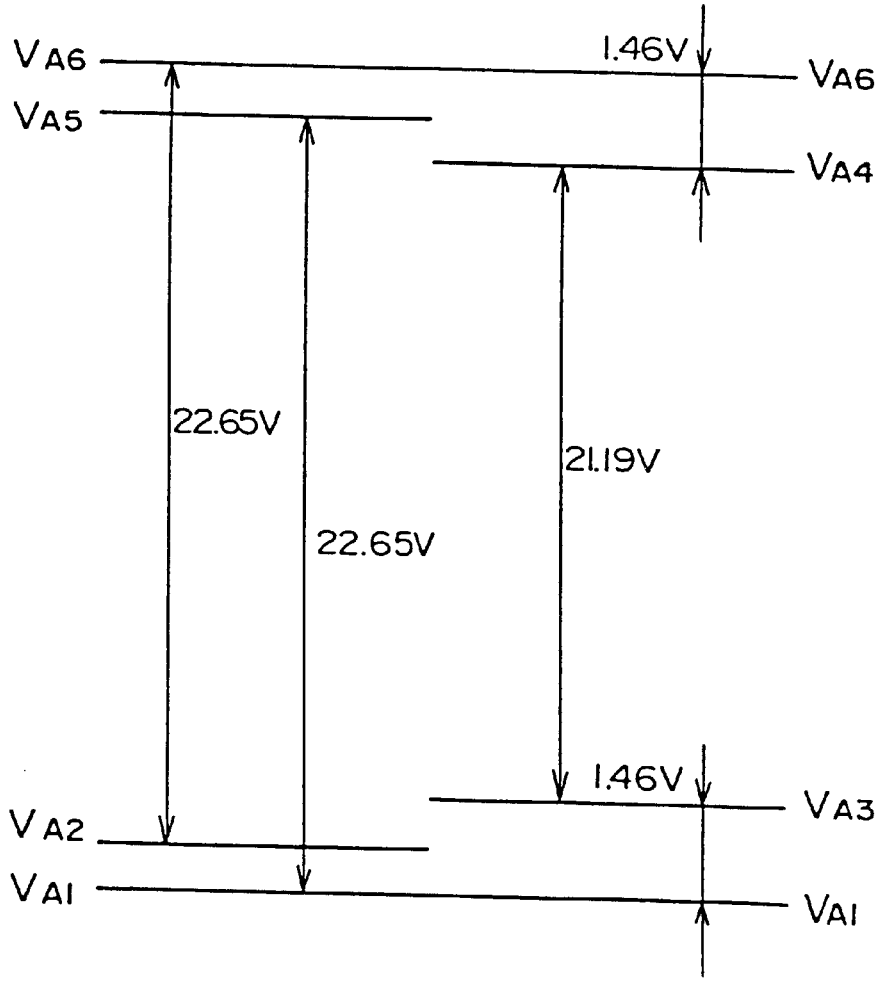
FIG. 45 is a diagram showing voltage levels for scanning lines and data lines in the driving method of a prior art liquid-crystal display device.

FIG. 45 is a diagram showing the voltage levels of the scanning lines and the data lines in a prior art liquid-crystal display device.

The voltage levels of the scanning lines are shown in the left portion of FIG. 45 and the voltage levels of the data lines are shown in the right portion of FIG. 45.

Two voltage levels of the scanning lines are available during a selection period are two levels, one positive and the other negative, $V_{A6}$ and $V_{A1}$, respectively, and two voltage levels are available during the non-selection period one positive and the other negative, $V_{A5}$ and $V_{A2}$, respectively. Also available as the voltage levels of the data lines are two positive voltage levels $V_{A4}$, $V_{A6}$ and two negative voltage levels $V_{A1}$, $V_{A3}$. The reason why the positive and negative voltage levels are employed is that the liquid-crystal display device needs periodical reversion of the polarity of the voltages applied to the scanning lines or the data lines to prevent deterioration of liquid crystals due to the application of direct currents.

Figure 46:
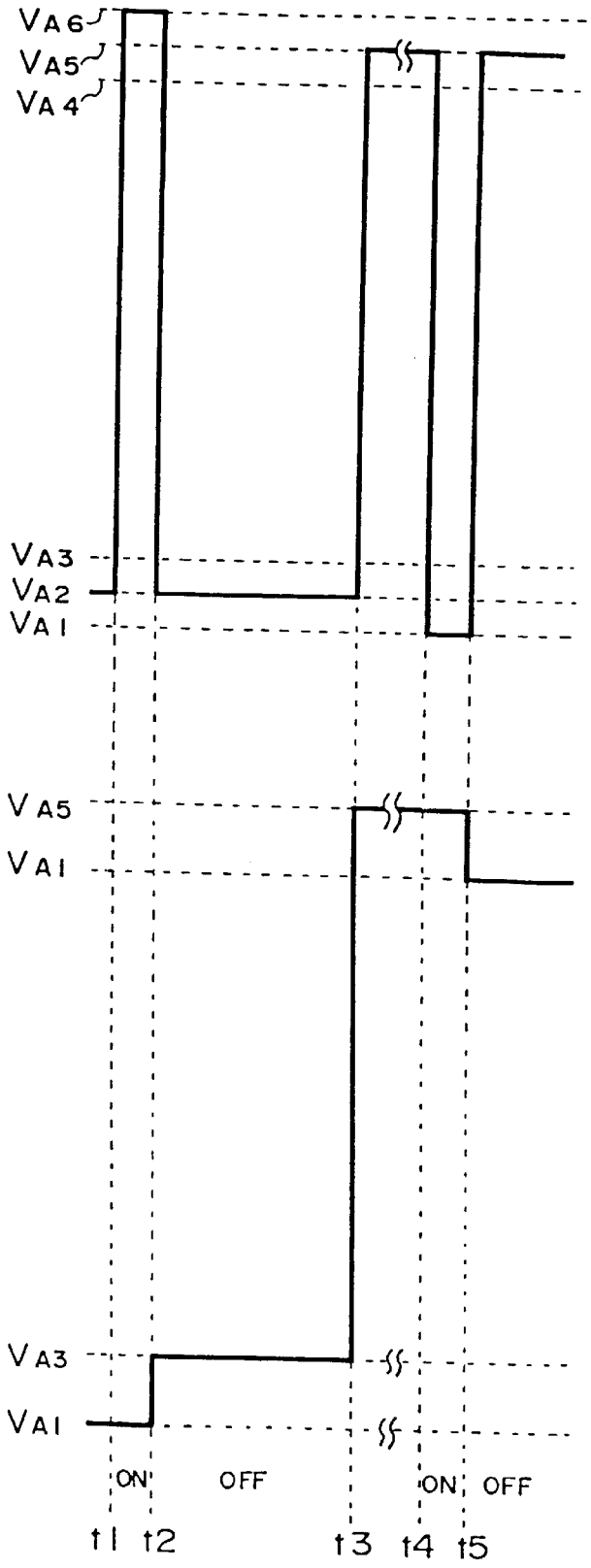
FIG. 46 is a timing diagram showing the operation of a standard passive matrix type liquid-crystal display device.

FIG. 46 shows the drive voltage waveform of the passive matrix type liquid-crystal display device. The drive voltage waveform for the scanning lines is shown in the upper portion of FIG. 46 and the drive voltage waveform for the data lines are shown in the lower portion of FIG. 46. A pixel-on period lasts from time t1 to time t2, and then from time t4 to time t5, and a pixel-off period lasts from time t2 to time t3, and then from time t5 thereafter.

As for the pixel-off period, the drive voltages of the scanning lines and data lines need to be periodically alternated not to present an image, and their amplitude is 20 V or more.

Figure 47:
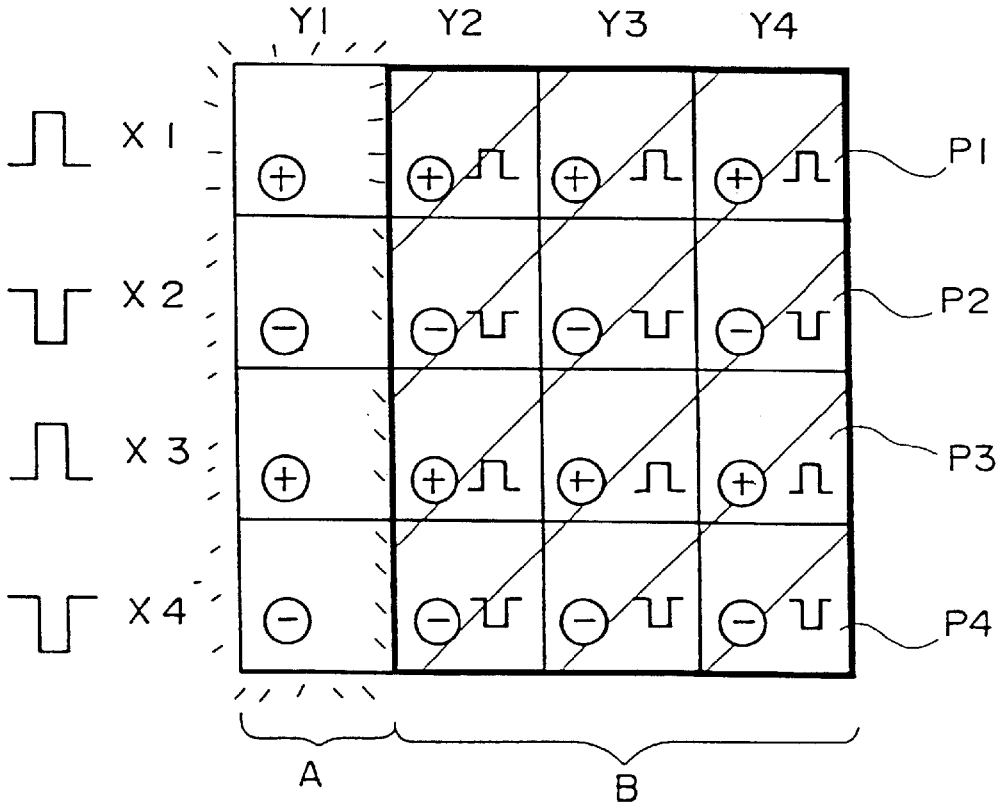
FIG. 47 is a diagram showing the problem associated with the driving method of the prior art liquid-crystal display device.

For example, suppose that a driving method that alternates the polarity of the drive voltage for the scanning lines on a per scanning line basis is adopted, that as shown in FIG. 47, an image is presented on an area "A" defined by data line Y1 and scanning lines X1, X2, X3 and X4, and that no image is presented on an area "B" defined by data lines Y2, Y3, and Y4 and scanning lines X1, X2, X3, and X4. "+" and "−" shown in FIG. 47 represent the polarities of a drive pulse.

To put the area "B" in a display-off state, the polarities of the drive pulses of the data lines Y2, Y3, and Y4 should be alternated on a line by line basis in accordance with the polarity of the drive pulse of the scanning line. Therefore, the construction of the power supply circuit for the drive waveform becomes complex, heightens power consumption, and since the data line voltage and scanning line voltage constantly change, currents flowing through liquid crystals driven by voltage differences between the scanning lines and data lines are not negligible, and thus a high power consumption in the display panel results.

(2) First Embodiment

Figure 1B:
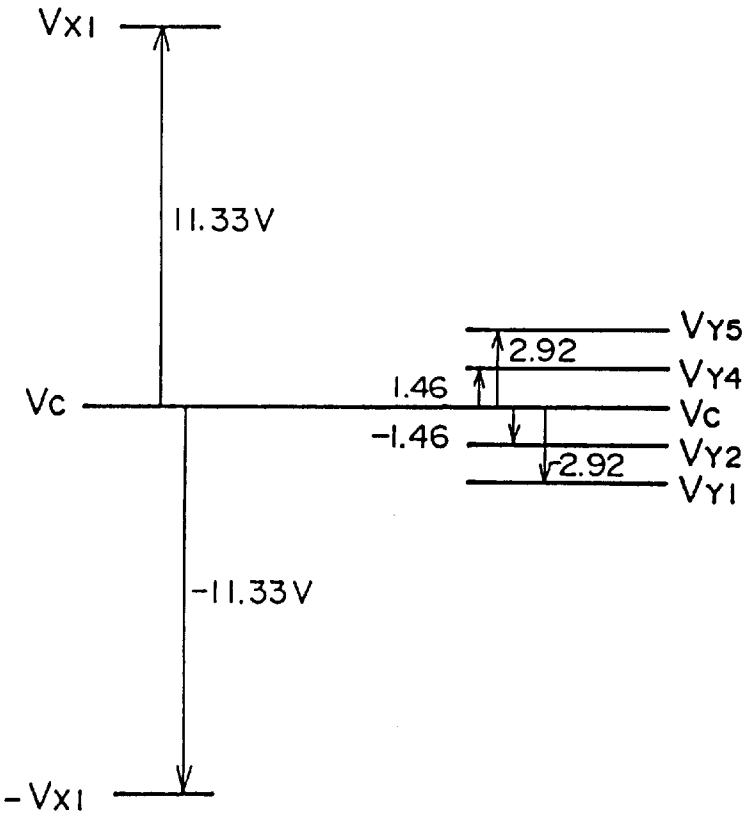
FIG. 1B shows another exemplary voltage levels for the scanning lines and data lines.
Figure 1A:
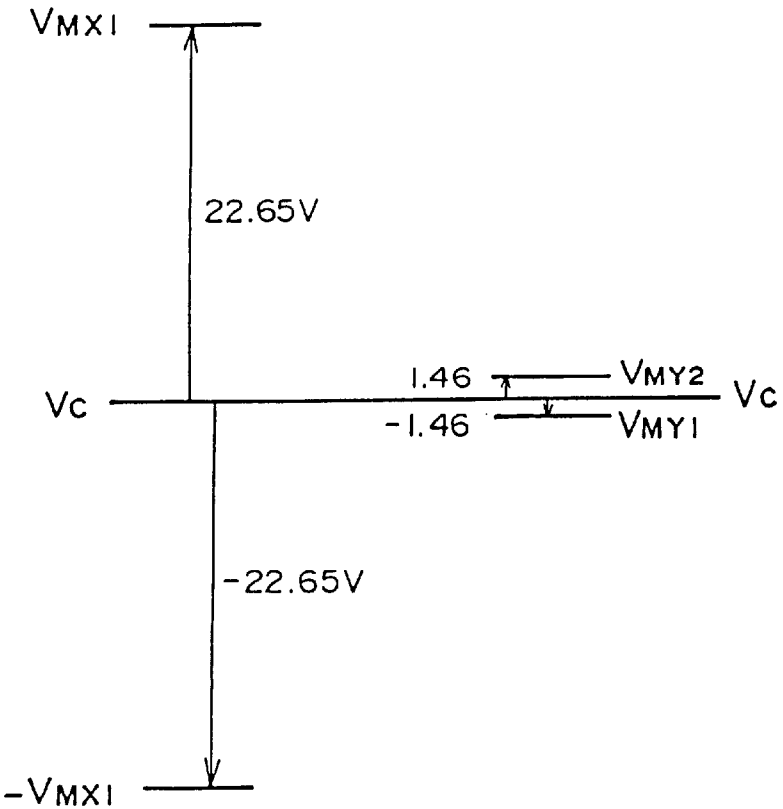
FIG. 1A shows exemplary voltage levels of scanning lines and data lines in the driving method of the display device of the present invention.
Figure 2:
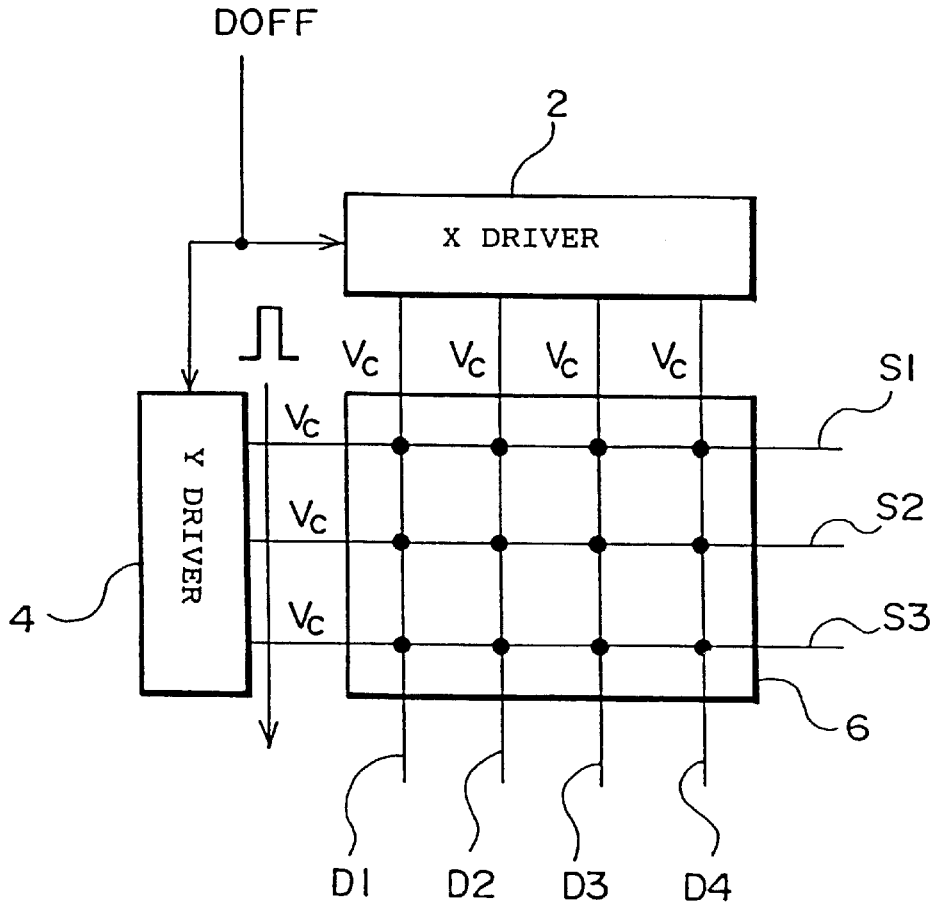
FIG. 2 shows the principle of the driving method of the display device of the present invention.

To resolve the above problem, the drive method of the present invention presents the drive voltage levels for the scanning lines and data lines as shown in FIG. 1A and FIG. 1B, and both the scanning lines and data lines are kept at a voltage level of Vc to turn to the display-off state (the screen in the display-off mode) as shown in FIG. 2.

Since regardless of the polarities of the drive voltages of the scanning lines and data lines, the voltage levels of the scanning lines and data lines are constantly kept at Vc in the display-off state (display-off mode), the construction of the power supply circuit is simplified and its power consumption is reduced. Theoretically, there is no voltage difference between the scanning lines and data lines, and thus no unwanted currents flow in the display panel.

The voltage levels shown in FIG. 1A and FIG. 1B are discussed more specifically.

FIG. 1A shows the drive voltage levels in the standard driving method (ATP method) of selecting sequentially the scanning lines one by one, in which the present invention is implemented, the voltage levels of the scanning lines are shown in the left portion of FIG. 1A and the voltage levels of the data lines are shown in the right portion of FIG. 1A.

The voltage levels of the scanning lines during the selection period are $V_{MX1}$, $-V_{MX1}$, and the voltage level of the scanning lines during the non-selection period is Vc only. On the other hand, the voltage levels of the data lines are $V_{MY1}$, $V_{MY2}$ and Vc. Vc is ground potential, for example.

FIG. 1B shows the drive voltage levels in the multi-line driving method of selecting simultaneously a plurality of scanning lines (four lines are simultaneously selected in FIG. 1B), the voltage levels of the scanning lines are shown in the left portion of FIG. 1B and the voltage levels of the data lines are shown in the right portion of FIG. 1B. During the selection period, the voltage levels of the scanning lines are two, $V_{X1}$ and $-V_{X1}$, and during the non-selection period, the voltage level of the scanning lines is Vc only. On the other hand, the voltage levels of the data lines are five: $V_{Y1}$, $V_{Y2}$, Vc, $V_{Y4}$, $V_{Y5}$.

The construction shown in FIG. 2 is now discussed.

Referring to FIG. 2, the X driver 2 drives data lines D1, D2, D3, and D4, and the Y driver 4 drives scanning lines S1, S2 and S3. Pixels are arranged at the intersections of the scanning lines and the data lines to constitute a liquid-crystal panel 6.

Suppose that the liquid-crystal panel 6 incorporated in a portable telephone presents an image during a communication session, while presenting no image at all on a standby mode. When the portable telephone is on the standby mode, the drive outputs from the X driver 2 and the Y driver 4 are all fixed to Vc by setting a display control signal DOFF to an active level (L, for example). In this way, a display-off state with extremely low power consumption is presented.

Figure 6:
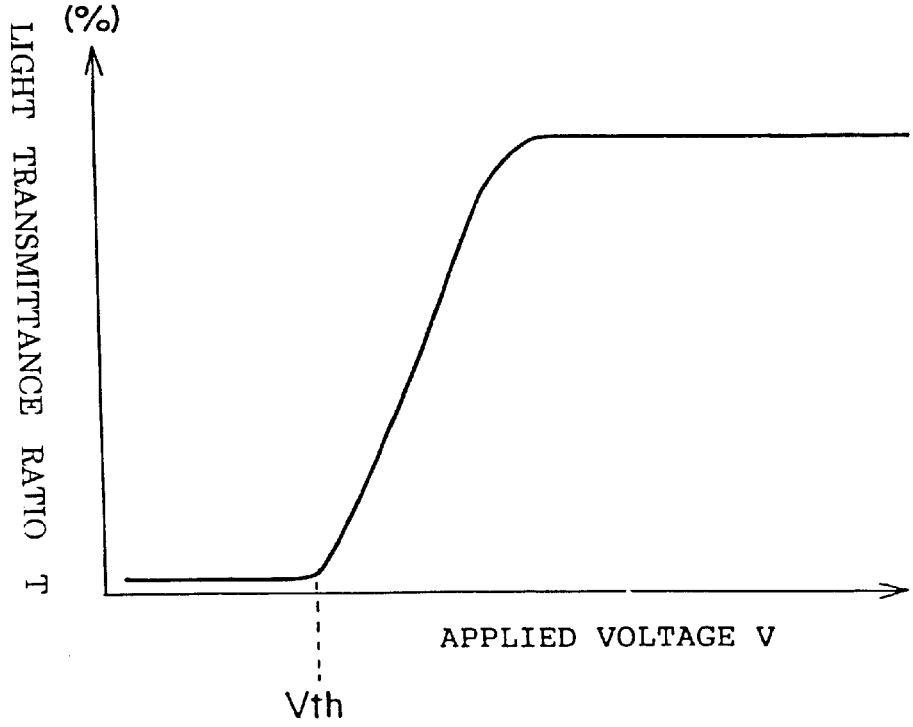
FIG. 6 shows the relationship between applied voltage and light transmittance ratio in the liquid-crystal display device.

Even if the Y driver is set to select the scanning lines by applying a drive pulse to the scanning lines, normally on a line-by-line basis or on a multi-line basis, the display-off state is maintained because all outputs of the Y driver are fixed to Vc. Specifically, the liquid crystal causes no variations in transmittance ratio unless the applied voltage to it exceeds a predetermined threshold voltage (Vth) as shown in FIG. 6, and simply applying a selection pulse to the scanning lines during the selection period does not cause the applied voltage to exceed the threshold voltage as long as the data line voltage is kept at Vc.

By properly controlling the voltage applied to each data line based on the above principle, not only can the entire screen of the liquid crystal panel 6 be turned to the display-off state as shown in FIG. 2, but also part of the screen of the liquid crystal panel 6 can be turned to the display-off state (a partial display-off state). The partial display-off state will be discussed in detail with reference to the following embodiments.

(3) Second Embodiment

Figure 3A:
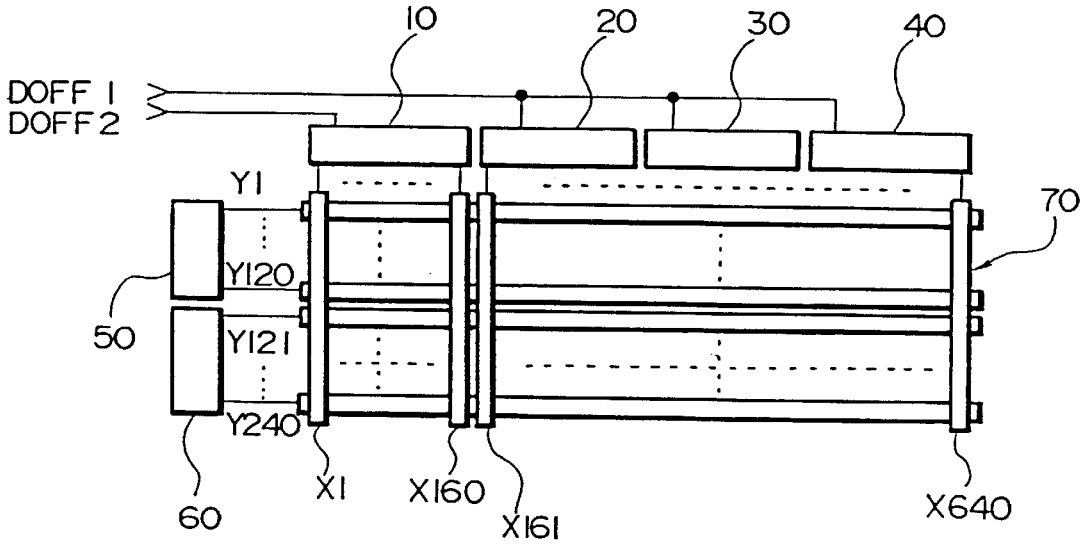
FIG. 3A shows an exemplary construction of the passive matrix type liquid-crystal display device which incorporates the driving method of the present invention.
Figure 3B:
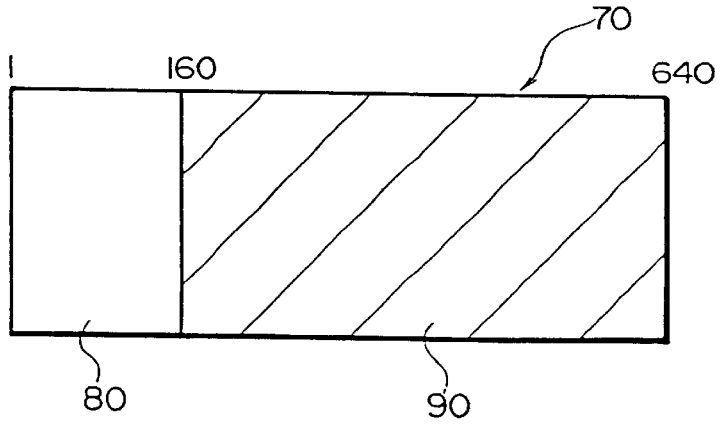
FIG. 3B shows an exemplary display screen of the device of FIG. 3A.

FIG. 3A shows a construction of the liquid-crystal display device according to a second embodiment of the present invention, and FIG. 3B shows a-n example of display control in the device of FIG. 3A.

According to the features of this embodiment, the screen is partitioned along a vertical data line X160 as a border, an area 80 is formed as an image presentation area, an area 90 is formed as an area not used for image presentation (a display-off state area) as shown in FIG. 3B, and such a screen partition is made by controlling the outputs of a plurality of ICs for data line driving.

Although the entire screen of the liquid crystal panel is set to the display-off state (the display-off screen) as shown in FIG. 2, the portable telephone in particular in its standby mode may need a minimum on-screen indication of, for example, how long a transmission is continuously possible and a speaker volume. In this case, if an area required for the minimum on-screen indication is assured with the remaining area set to the display-off mode (the display-off state), power consumption is minimized.

As shown in FIG. 3A, reference numerals 10, 20, 30 and 40 are data line driving ICs, each responsible for driving 160 data lines. Two as display control signals are available, DOFF (Display Off) 1 and DOFF2, DOFF1 is fed to data line driving IC 10, and DOFF2 is commonly fed to data line driving ICs 20, 30, and 40.

The display control signals DOFF1 and DOFF2 at their low level is an active level, and when they are at their active level, all the drive outputs of the data line driving ICs are fixed to a voltage level of Vc (the voltage level of the scanning lines during the non-selection period) as shown in FIG. 1A and FIG. 1B. Reference numerals 50 and 60 are scanning line driving ICs, each responsible for driving 120 scanning lines.

With DOFF1 at "H" and DOFF2 at "L", the drive outputs of the data line driving ICs 20, 30, and 40 (drive outputs for data lines X160~X640) are fixed to Vc. In this way, as shown in FIG. 3B, the area 90 of the screen of a liquid-crystal panel 70 is set to the display-off state (display-off mode).

On the other hand, the data line driving IC 10 sends its drive outputs to data lines X1~X160 to present a desired image. The scanning line driving ICs 50, 60 may be designed to select sequentially the scanning lines one by one, for example. A desired image is thus presented on the area 80 of the liquid crystal panel 70 as show in FIG. 3B.

The area 90 remains in the display-off state, and when the scanning lines are selected, the selection voltage is fed, but when the scanning lines are not selected, both the scanning lines and the data lines are together fixed to Vc, no unwanted currents flow through the liquid crystal, and the power consumption with the liquid-crystal panel 70 is thus reduced.

Since in the same way as in the first embodiment, it not necessary to switch the polarity of the control voltage for display-off in synchronization with the polarity of liquid crystal driving, the construction of the power supply circuit for generating the control voltage is simplified, and the power consumption with the power supply circuit is substantially reduced.

It is also acceptable that the display control signal DOFF controls only parts of the outputs of one IC.

(4) Third Embodiment

Figure 4A:
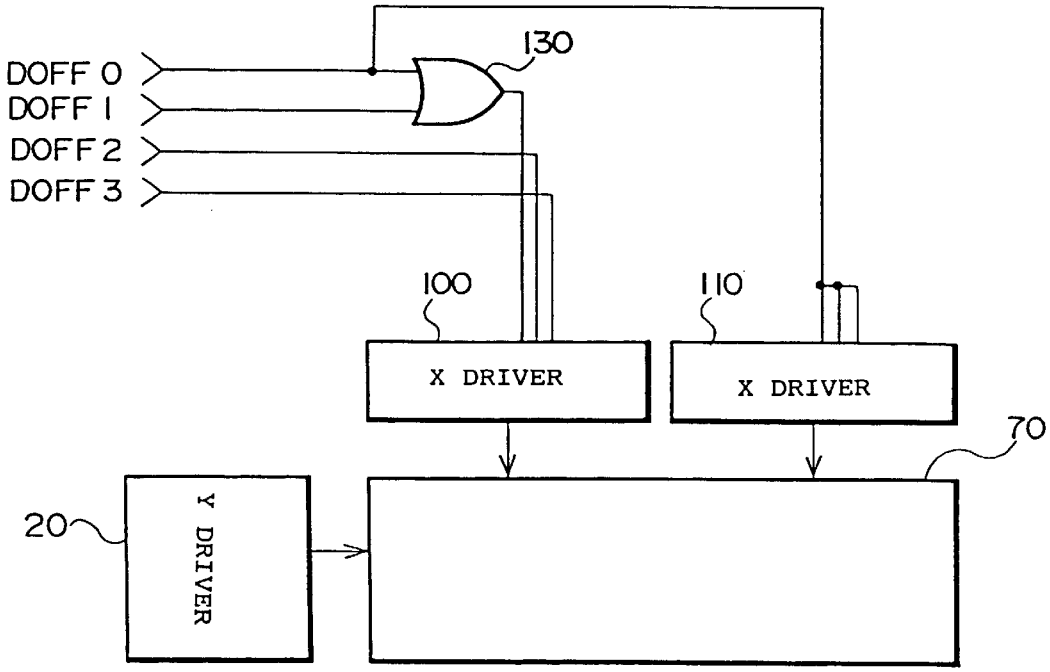
FIG. 4A shows another exemplary construction of the passive matrix type liquid-crystal display device which incorporates the driving method of the present invention.

Referring to a liquid-crystal display device in FIG. 4A, two drivers 100, 110 are provided as data drivers (X drivers) for a liquid-crystal panel 70. A scanning line driver (Y driver) 20 is of a driver type that sequentially selects the scanning lines one by one. A reference numeral 130 in FIG. 4A is an OR gate.

Figure 4B:
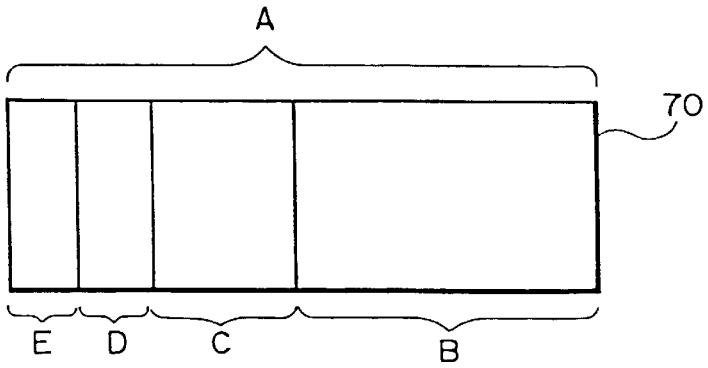
FIG. 4B shows an exemplary display screen of the device of FIG. 4A.

In this embodiment, four display control signals DOFF0, DOFF1, DOFF2, and DOFF3 are provided to control the voltage level of each control signal, thereby allowing areas to selectively turn to the display-off state as shown in FIG. 4B.

More particularly, with the entire screen of the liquid-crystal panel 70 designated "A" as shown in FIG. 4B, an area "B" only is in the display-off state when DOFF0 only is at "L". When both DOFF0 and DOFF1 are both at "L", both area "B" and area "C" turn to the display-off state, and when DOFF0~DOFF3 are at "L", area "B", area "C", and area "D", turn to the display-off state, and when DOFF0~DOFF3 are all at "L", the entire screen of the liquid-crystal panel 70 including an area "E" turns to the display-off state.

(5) Fourth Embodiment

When an area, of the liquid-crystal panel is set to the display-off mode, the power consumption of the display device is further reduced by suspending the display data concerning the area (image data indicative of display-off state) and the clock for transferring the image data. The circuit construction for performing such an operation is now discussed.

Figure 5:
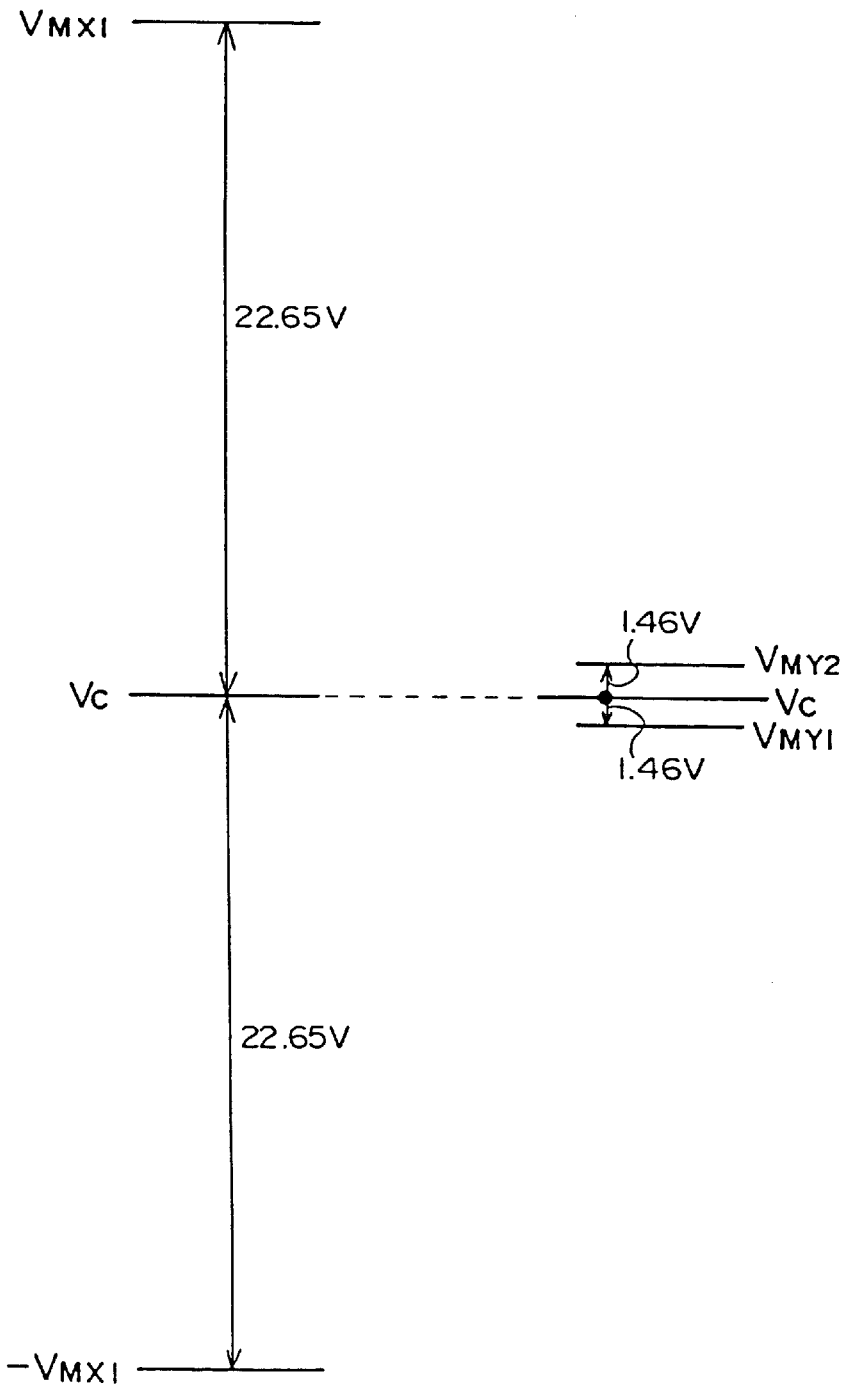
FIG. 5 shows voltage levels for the scanning lines and data lines in the present invention where the driving method of sequentially selecting the scanning lines one by one (ATP driving method) is incorporated.
Figure 7A:
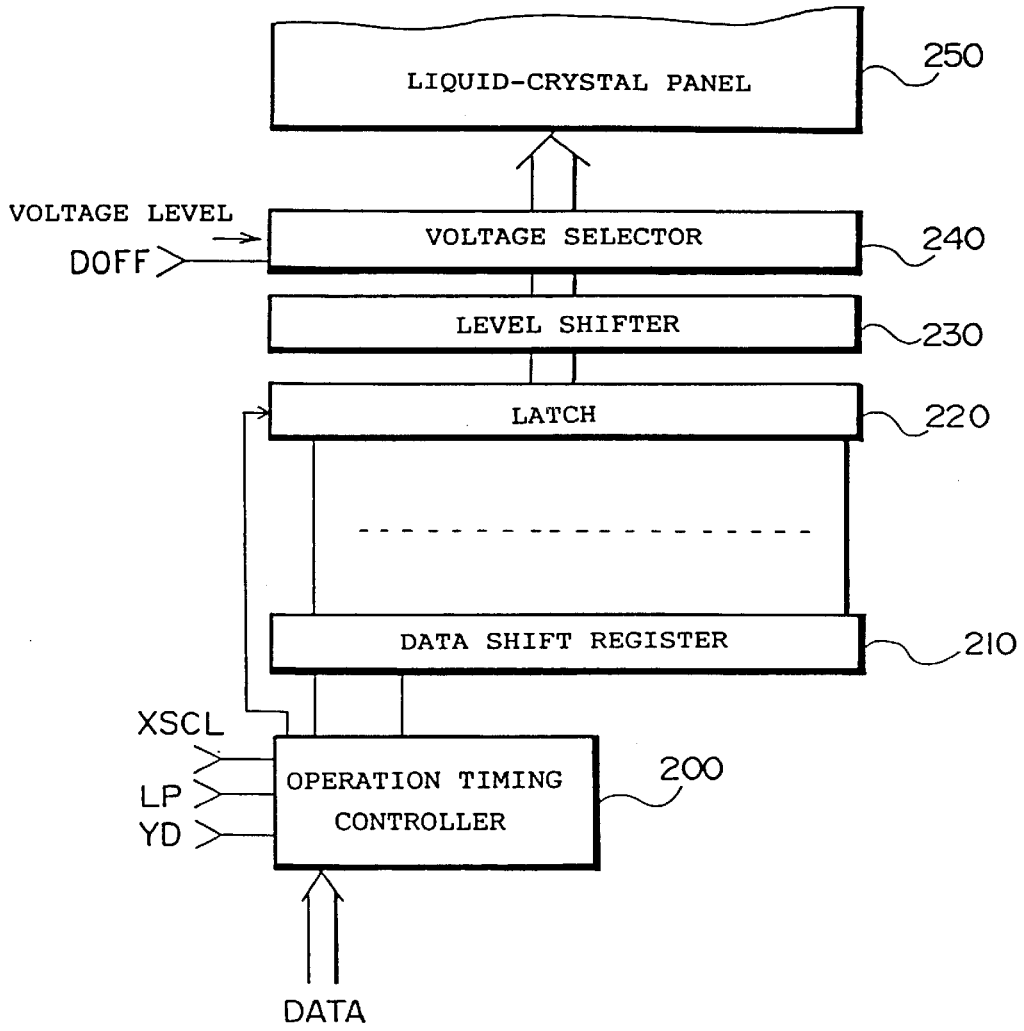
FIG. 7A shows an exemplary construction of the passive matrix type liquid-crystal display device which incorporates the driving method of the present invention.

FIG. 7A shows a major portion of the construction of the data-line driving circuit of the liquid-crystal display device. The data-line driving circuit is of a type that selects sequentially the scanning lines one by one, and outputs three voltage levels ($V_{MY1}$, Vc, $V_{MY2}$) to the data lines as shown in the right portion of FIG. 5 (FIG. 1A).

The circuit shown in FIG. 7A comprises an operation timing controller 200, a data shift register 210 for storing temporarily data-line drive data, a latch 220, a level shifter 230, and a voltage selector 240 for selecting one from three voltage levels ($V_{MY1}$, Vc, and $V_{MY2}$). A reference numeral 250 designates a liquid-crystal panel.

Also shown in FIG. 7A are a clock XSCL for transferring the data-line drive data, a pulse LP corresponding to the selection pulse, a signal YD for starting one frame period, data-line drive data DATA, and a display control signal DOFF.

Figure 7B:
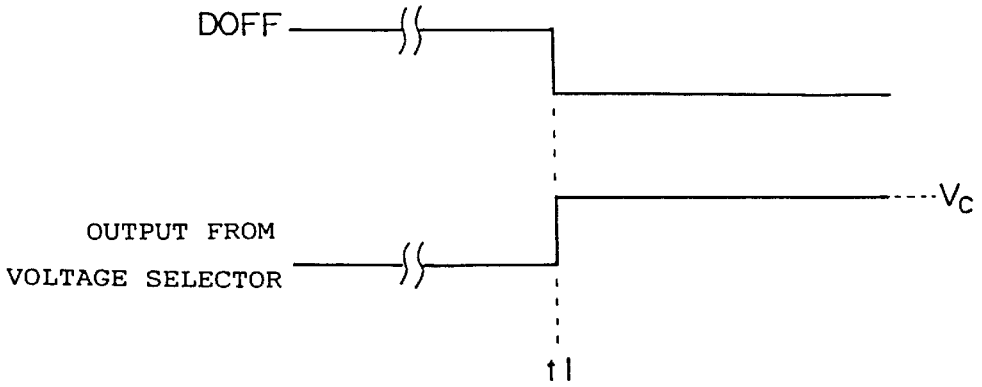
FIG. 7B is a timing diagram showing the operation characteristic of the device of FIG. 7A.

Referring to FIG. 7B, when the display control signal DOFF is driven to "L" at time t1, the output of the voltage selector 240 is fixed to Vc, and a corresponding area of the liquid-crystal panel 250 is turned to the display-off mode.

Unnecessary power consumption is avoided if the data-line drive data (DATA) and the clock (XSCL) for data transfer, both fed to the operation timing controller 200 as shown in FIG. 7A, are suspended in accordance with the start of the display-off mode. The suspension of either the data or the clock presents some power consumption reduction effect. Since the clock for data transfer is a high-frequency signal, the effect of suspending this clock, in particular, is substantial.

The suspension of the data and the clock for data transfer is controlled, for example, by a microcomputer which generally controls the operation of the liquid-crystal display device.

Figure 8A:
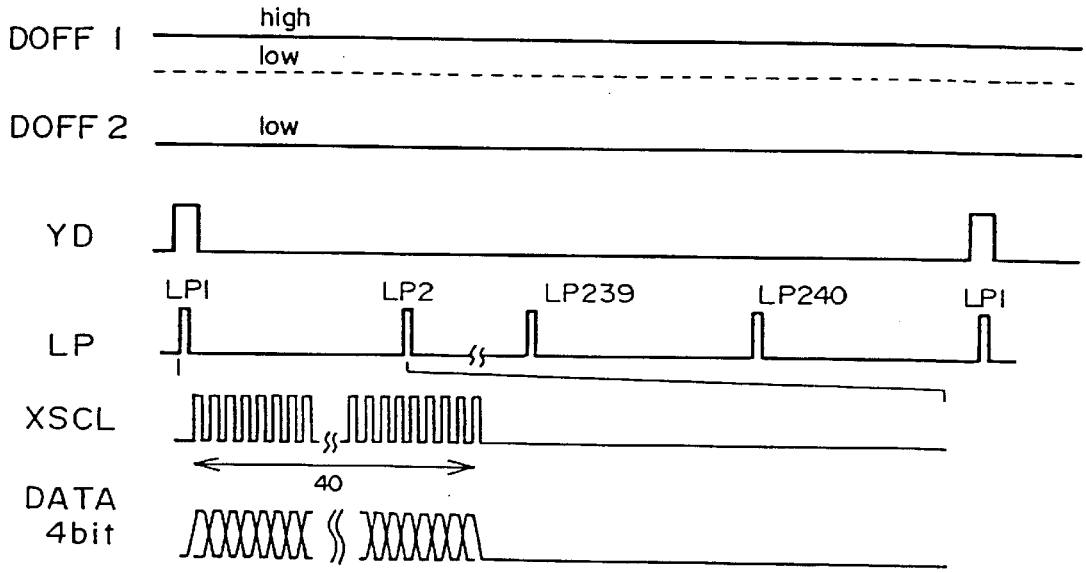
FIG. 8A is a timing diagram showing an exemplary operation of the liquid-crystal display device of FIG. 7A.

FIG. 8A is a timing diagram showing the operation of the liquid-crystal display device in which both the data and clock are suspended in accordance with the start of the display-off mode. Referring to FIG. 8A, in the same way as in FIG. 3A, two control signals (DOFF1, DOFF2) drive the liquid-crystal panel partially to the display-off mode.

With DOFF1 at "H" and DOFF2 at "L" as shown in FIG. 8A, data corresponding to 40 clock pulses is fed, but subsequent data input (and clock input) is suspended.

Figure 8B:
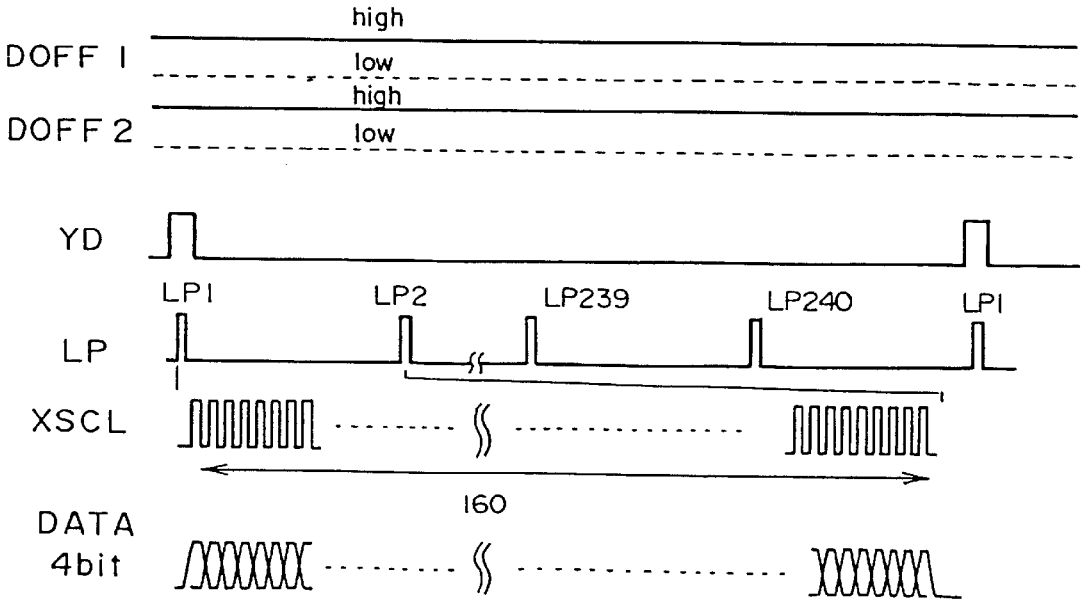
FIG. 8B is a timing diagram showing another exemplary operation.

When both DOFF1 and DOFF2 are driven to "H" as shown in FIG. 8B, the partial display-off mode is released, and along with it, the suspension of the data and clock is released as well.

(6) Fifth Embodiment

In this embodiment, the start position of the area to be in the display-off mode is flexibly set.

Figure 9:
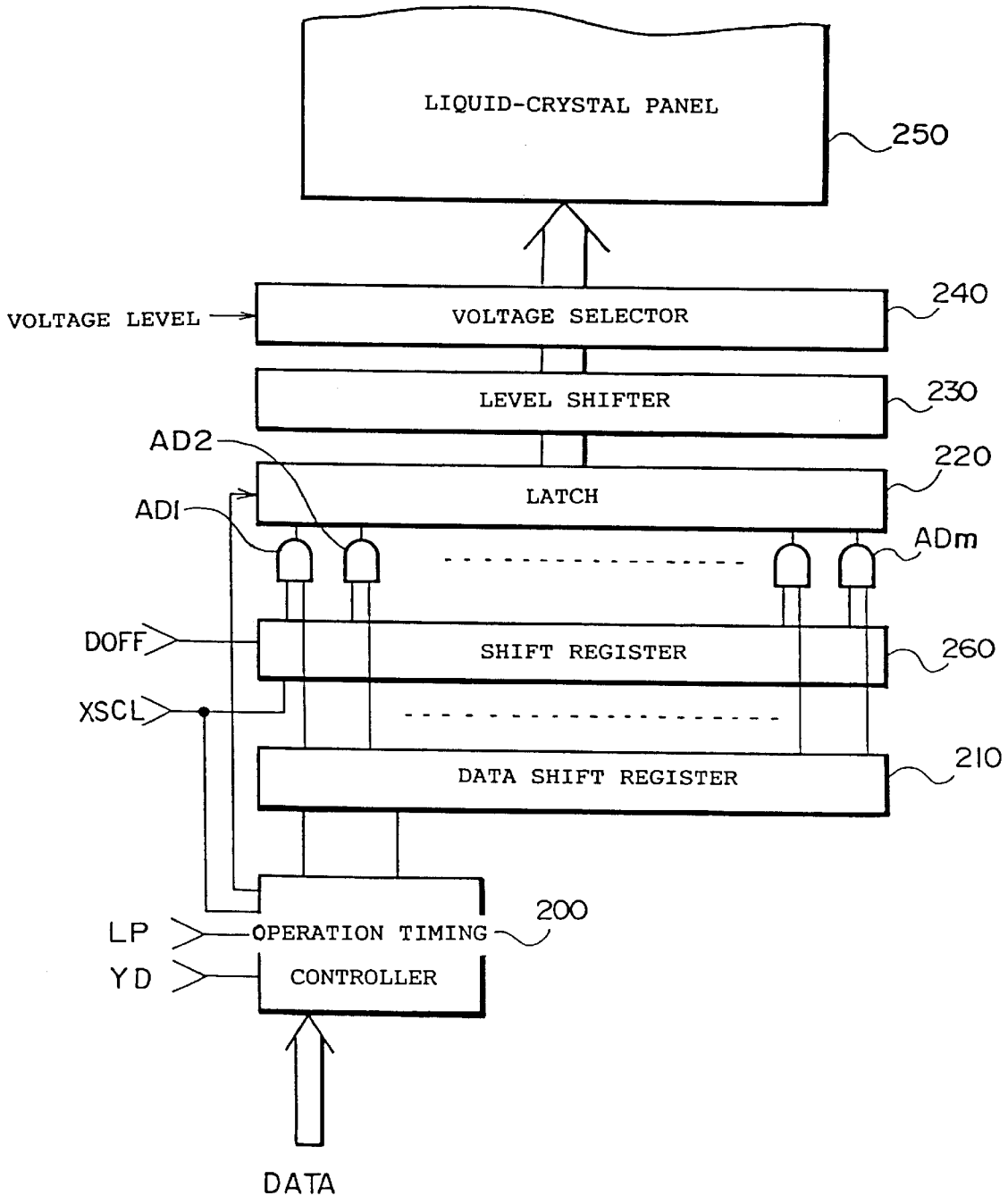
FIG. 9 shows an exemplary construction of the passive matrix type liquid-crystal display device which incorporates the driving method of the present invention.

FIG. 9 is a block diagram showing a data line driver (X driver) for performing display control. The circuit arrangement is substantially identical to that shown in FIG. 7A, except that the circuit in FIG. 9 includes a multi-stage shift register for temporarily storing the display control data (DOFF) for each drive output with the number of stages equal to the number of drive outputs and further includes AND gates AD1, AD2 . . . ADm.

The AND gates AD1, AD2 . . . ADm are arranged for respective drive outputs, and each AND gates the data line drive data (DATA) and the display control data (DOFF) and gives an ANDed output.

When the display control data (DOFF) is at "L", the output of the AND gate is fixed to a predetermined value, and the data of the fixed value is stored in the latch 220. When the data of the fixed value is present, the voltage selector 240 fixes the drive output level corresponding to the data to the above-described Vc. In this way, the start of the area to be set in the display-off mode is flexibly set in steps of one drive output.

Figure 10A:
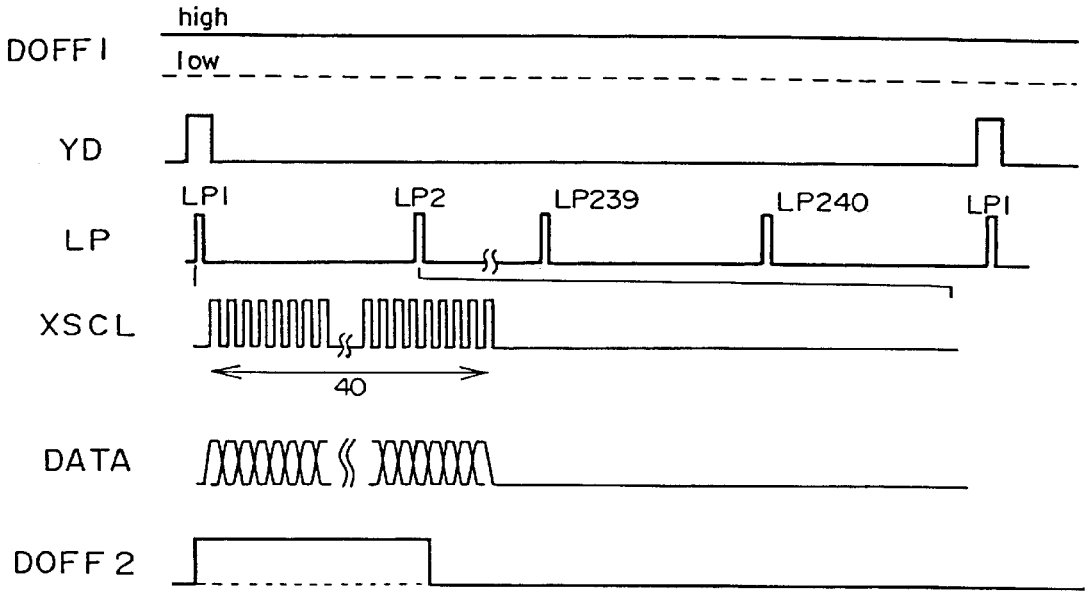
FIG. 10A is a timing diagram showing an exemplary operation of the liquid-crystal display device of FIG. 9.
Figure 10B:
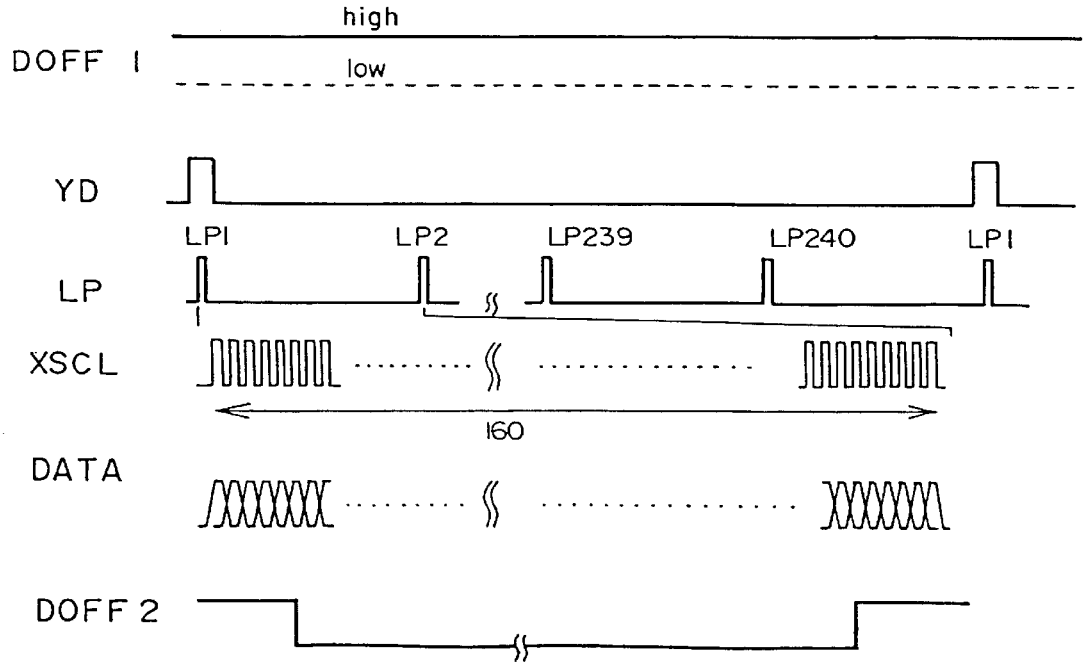
FIG. 10B is a timing diagram showing another exemplary operation.

FIG. 10A and FIG. 10B are timing diagrams, wherein the level of the display control signal DOFF2 is changed at an appropriate timing, and in accordance with the timing, the data transfer and clock input are suspended to flexibly set the area in the display-off mode.

(7) Sixth Embodiment

FIG. 11~FIG. 15 show other methods for determining an area in the display-off mode.

Figure 11:
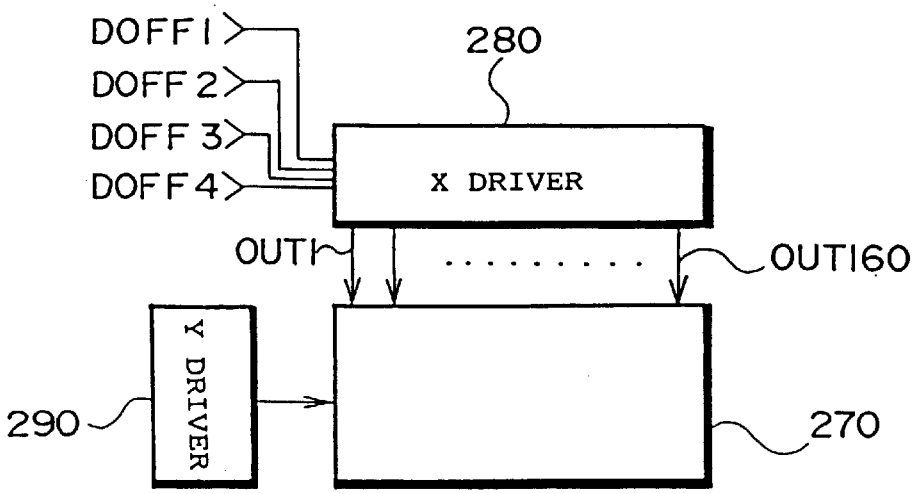
FIG. 11 shows an exemplary construction of the liquid-crystal display device of the present invention, FIG. 12A, FIG. 12B, and FIG. 12C respectively show display controls in the liquid-crystal display device of FIG. 11.
Figure 12A:
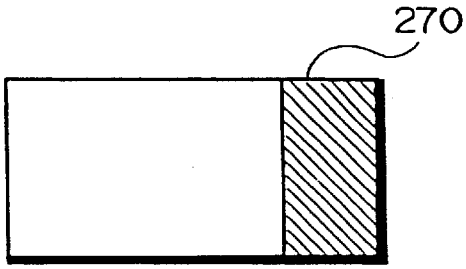
Figure 12B:
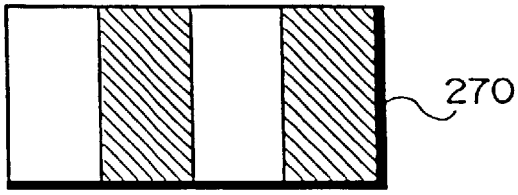
Figure 12C:
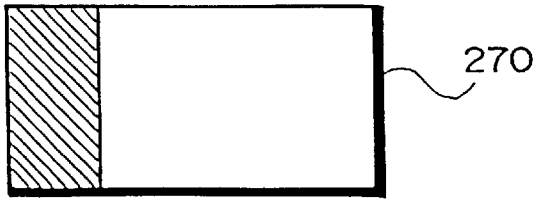

As shown in FIG. 11, depending on a combination of voltage levels of four display control signals DOFF1~DOFF4, various areas are set to be in the display-off mode in a display screen 270 as shown in FIG. 12A~FIG. 12C. The hatched areas in FIG. 12A~FIG. 12C indicate the areas in the display-off mode.

Figure 13:
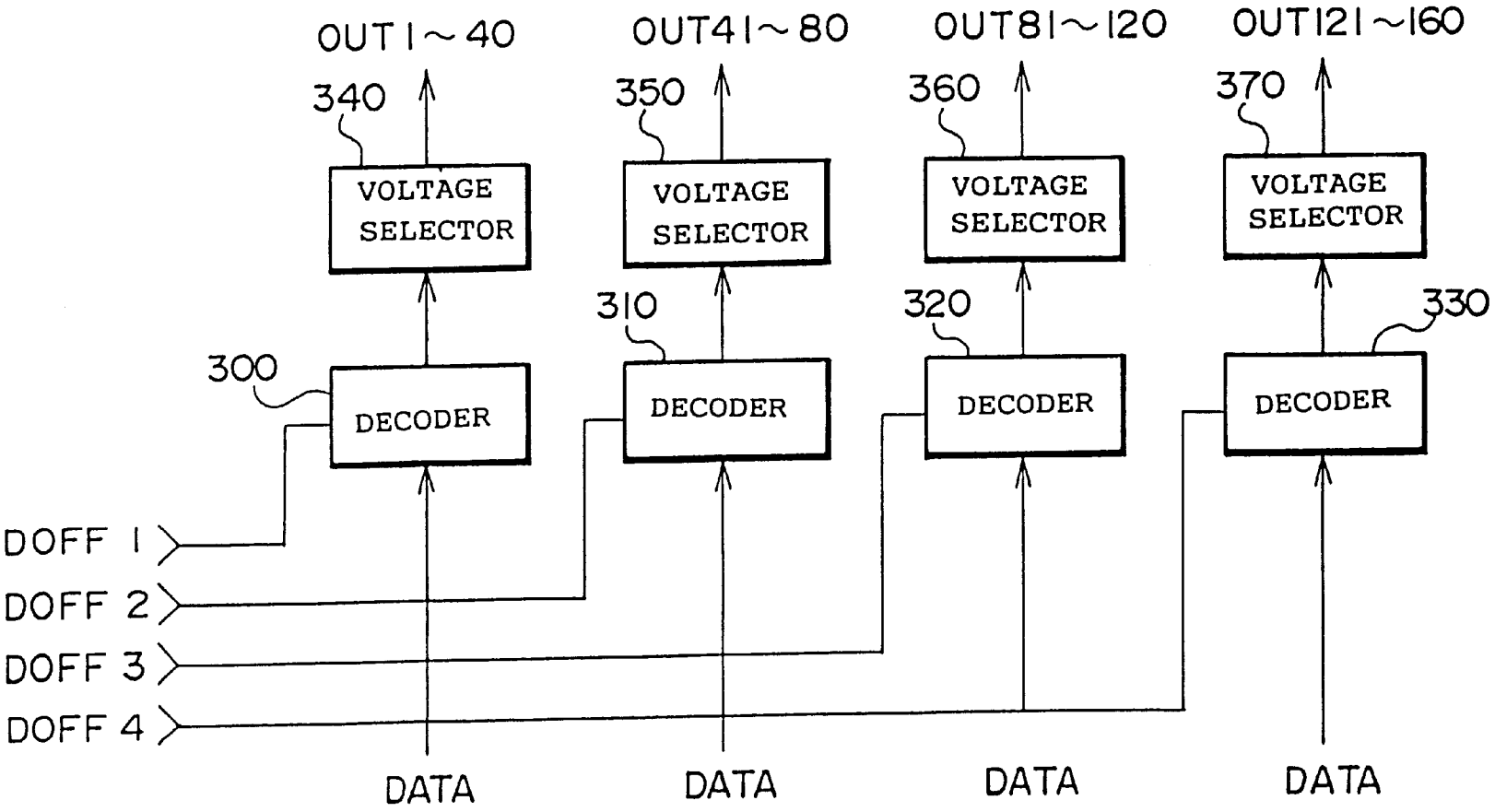
FIG. 13 is a block diagram showing an exemplary construction of a major portion of the liquid-crystal display device of the present invention.

FIG. 13 is a block diagram showing a specific construction of an X driver 280 shown in FIG. 11.

Provided are four decoders 300, 310, 320, and 330, to which display control signals DOFF1~DOFF4 are respectively fed.

Figure 14:
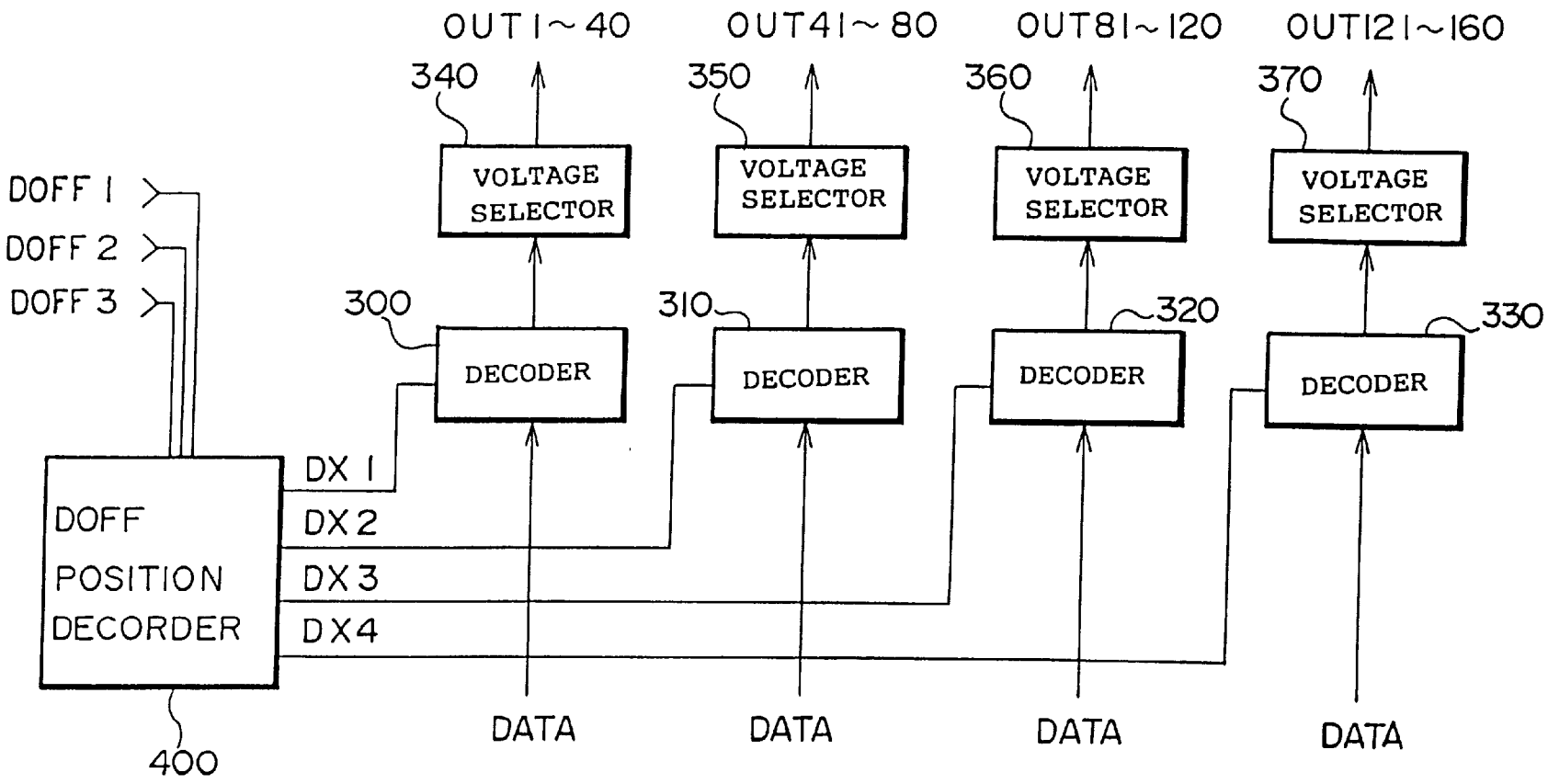
FIG. 14 is a block diagram showing another exemplary construction of the major portion of the liquid-crystal display device of the present invention.

FIG. 14 is a block diagram showing another exemplary construction of X driver.

In this example, the display control signals DOFF1~DOFF4 are decoded through a decoder (DOFF POSITION DECORDER) 400 to form control signals DX1~DX4 for the respective decoders 300, 310, 320, and 330.

Figure 15:
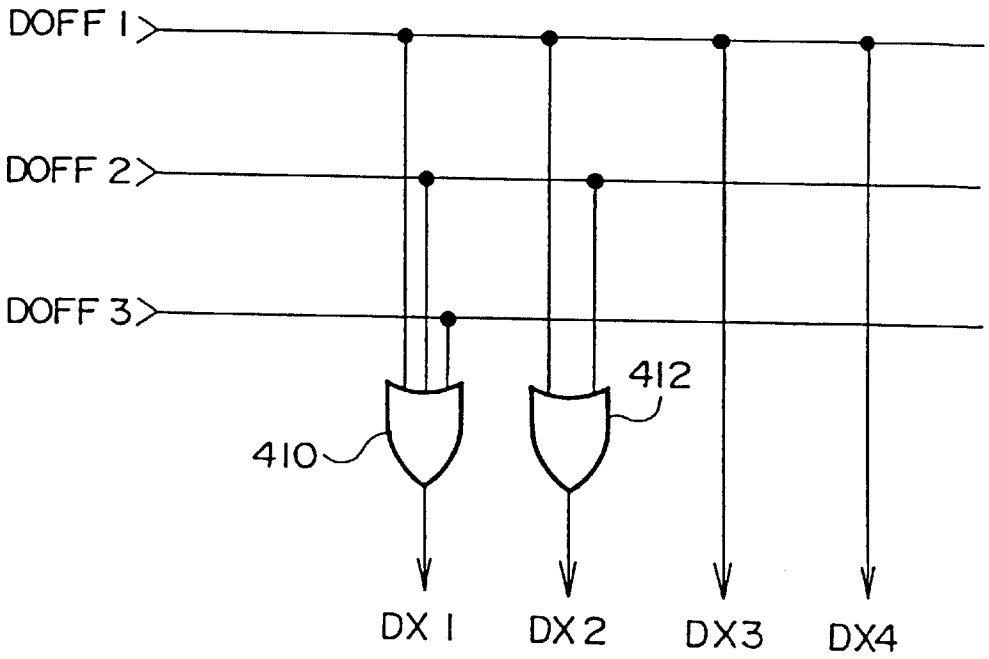
FIG. 15 shows a specific circuit arrangement of the decoder of FIG. 14.

The decoder (DOFF POSITION DECORDER) 400 has a circuit arrangement comprising two OR gates 410, 412, for example, as shown in FIG. 15.

(8) Seventh Embodiment

If the method of display-off mode screen already described in connection with the first embodiment is applied to the so-called multi-line driving method (MLS driving method), power consumption of the liquid-crystal display device is further reduced along with the feature of the MLS driving method that the voltage level applied to the scanning lines is lowered. Image quality is also improved.

When the method of display-off mode screen already described in connection with the first embodiment is applied to the so-called multi-line driving method (MLS driving method), the number of scanning lines L simultaneously selected is preferably an even number, and more preferably, L is 2, 4, 6, or 8. The reason for this is as follows. The multi-line driving method will be described later.

Figures 16A, 16B:
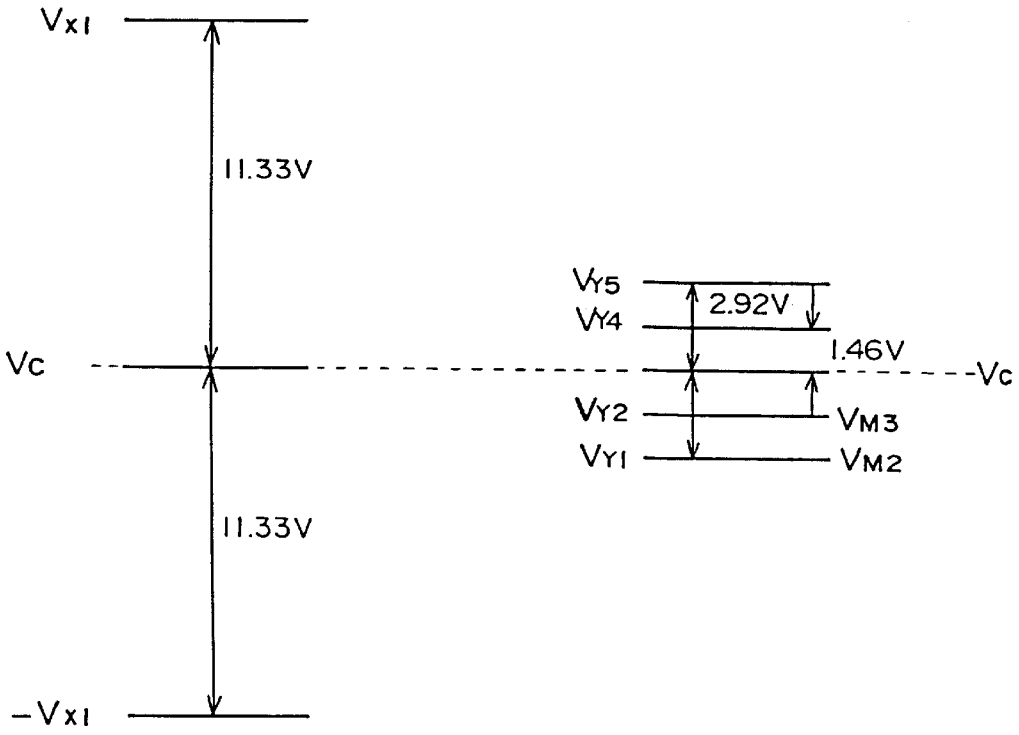
FIG. 16A shows voltage levels for the scanning lines and data lines when four scanning lines are simultaneously selected to be driven.
FIG. 16B shows the relationship between the number of simultaneous selection and the number of voltage levels for the data lines.

As shown in FIG. 16B, when the number of scanning lines simultaneously selected is "L", the number of voltage levels of the data lines is necessarily "L+1". When "L" is an even number, "L+1" is an odd number, and the voltage levels of the data lines are symmetrically distributed with its "predetermined reference voltage level" placed centrally with half voltage levels on the positive side and the other half voltage levels on the negative side of the predetermined reference voltage level. The "predetermined reference voltage level" can be set to coincide with the scanning line voltage level during the non-selection period.

Specifically, when the number of the simultaneously selected scanning lines is even, the middle one of the voltage levels of the data lines may be set to coincide with the voltage level of the scanning lines during the non-selection period. For this reason, setting a new voltage level for the scanning line during the non-selection period as the voltage level for the data line is not required to activate display-off state. This arrangement simplifies design and prevents the increase in circuit complexity, thereby leading to reduction of power consumption.

FIG. 16A (FIG. 1B) shows the voltage levels for the scanning lines and data lines when a driving method of selecting simultaneously four scanning lines is employed. The voltage levels for the scanning lines are shown in the left portion of FIG. 16A, and the voltage levels for the data lines are shown in the right portion of FIG. 16A. With L=4, five voltage levels (L+1) of $V_{Y1}$, $V_{Y2}$, Vc, $V_{Y4}$, and $V_{Y5}$are available as the voltage levels for the data lines. $V_{Y1}$ and $V_{Y2}$ are symmetrically set in level to $V_{Y4}$ and $V_{Y5}$ relative to Vc. Vc is exactly the non-selection voltage level of the scanning lines. Simply fixing the voltages of both the scanning lines and data lines to Vc is enough to set an area to the display-off mode.

When the number "L" of the simultaneously selected scanning lines is an odd number, the number of voltage levels of the data lines is an even number, and thus no voltage as a reference exists at the middle of the voltage levels. In this case, a voltage level corresponding to Vc needs to be added to the voltage levels of the data lines, as a voltage level to set the display-off mode.

As described above, the number of scanning lines simultaneously selected in the multi-line driving method is preferably 2, 4, 6, or 8.

As the number of simultaneously selected scanning lines increases, the scale of the circuit for driving them is accordingly enlarged, and the larger-scale driving circuit will work to the contrary to the prime object of the present invention of reducing power consumption. For this reason, the practicable number for simultaneously selected scanning lines, L, is 2, 4, 6, or 8.

(9) Eighth Embodiment

A. Construction of the Device

Figure 17:
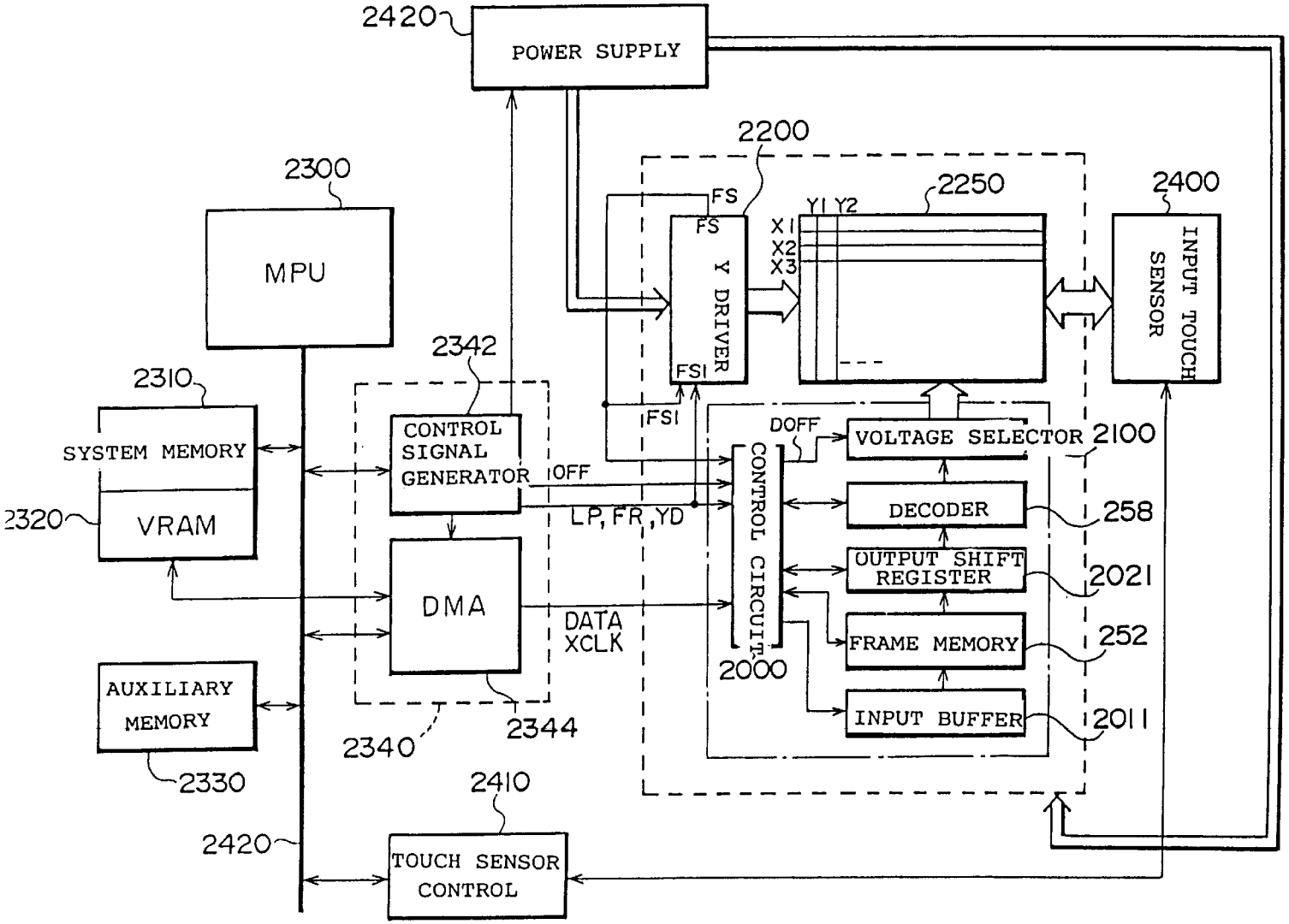
FIG. 17 is a block diagram showing an exemplary construction of the liquid-crystal display device of the present invention into which a multi-line driving method is implemented.
Figure 18:
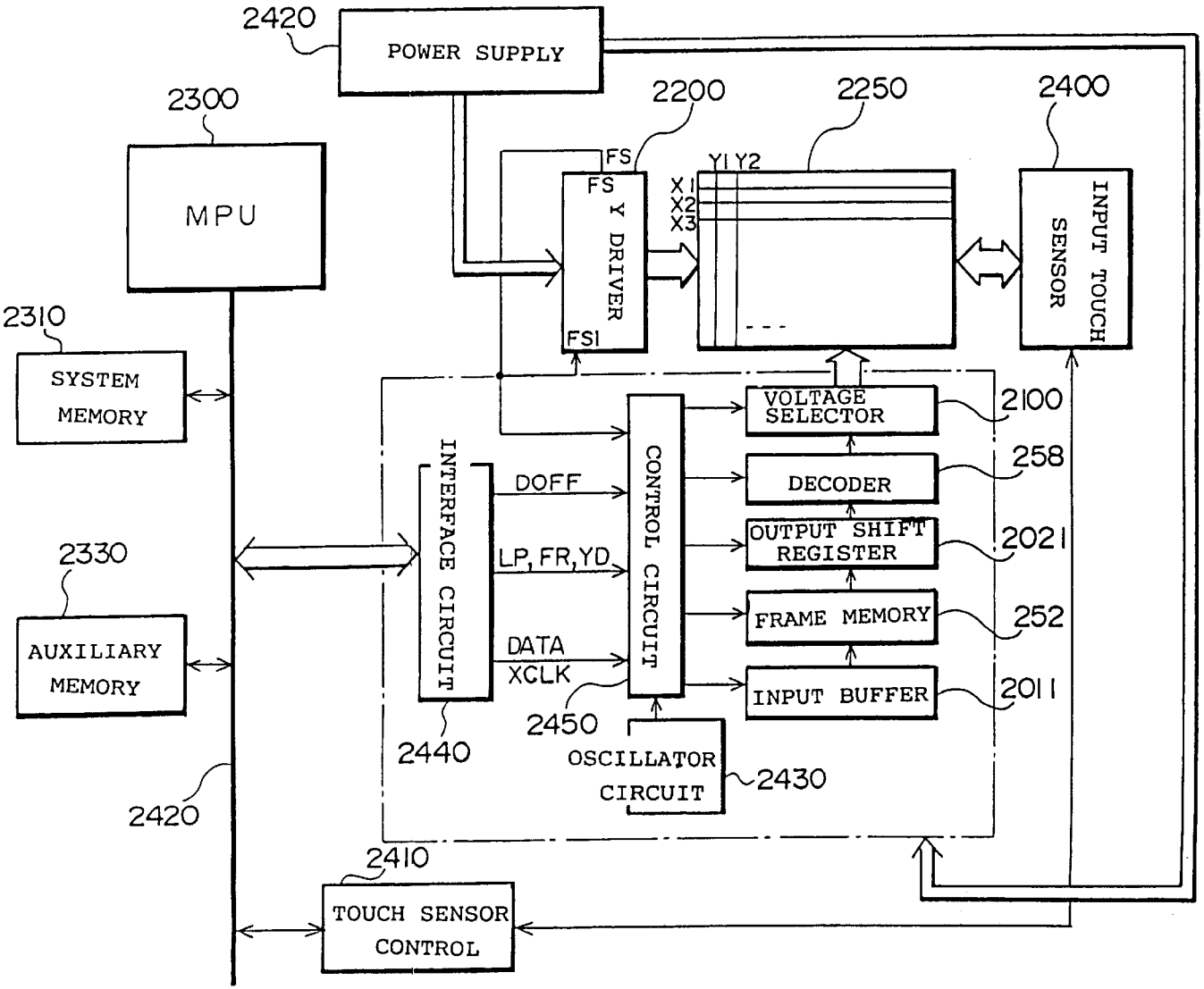
FIG. 18 is a block diagram showing another exemplary construction of the liquid-crystal display device of the present invention into which the multi-line driving method is implemented.

FIG. 17 and FIG. 18 show exemplary constructions of liquid-crystal display devices which adopt the multi-line driving method, flexibly setting the area to the display-off mode.

Discussed first is the liquid-crystal display device shown in FIG. 17.

Upon receiving an instruction from a microprocessor (MPU) 2300, a DMA control circuit 2344 within a module controller 2340 accesses a video RAM (VRAM) 2320, reads image data of one frame via a system bus 2420, and sends the image data (DATA) together with the clock (XCLK) to the data-line driving circuit.

The data-line driving circuit (enclosed in a chain line with one dot in FIG. 17) comprises a control circuit 2000, an input buffer 2011, a frame memory 252, an output shift register 2021, a decoder 258, and a voltage selector 2100.

A reference numeral 2400 designates an input touch sensor, and a reference numeral 2410 designates a touch sensor control circuit. Both the input touch sensor 2400 and the touch sensor control circuit 2410, if unnecessary, may be dispensed with.

In response to an instruction from MPU 2300, a control signal generator circuit 2342 within the module controller 2340 outputs a first display control signal (OFF) to the control circuit 2000 within the data-line driving circuit. In accordance with the level of the first display control signal (OFF), the control circuit 2000 changes the level of a second display control signal (DOFF) applied to the voltage selector 2100. In this way, the drive output for the corresponding data line is fixed to the voltage level Vc, resulting in the display-off mode screen.

A power supply circuit (voltage source circuit) 2420 feeds a predetermined power to the data-line driving circuit (X driver) and scanning-line driving circuit (Y driver) 2200.

The construction of the liquid-crystal display device shown in FIG. 18 is now discussed.

In the liquid-crystal display device shown in FIG. 17, control of the multi-line drive (MLS drive) is performed by the module controller 2340, while in the liquid-crystal display device shown in FIG. 18, the data-line driving circuit (enclosed in a chain line with one dot as shown) is directly connected to the system bus 2420 of a microcomputer so that MPU 2300 directly controls the MLS drive. The data-line driving circuit comprises an interface circuit 2440, a control circuit 2450, an oscillator circuit 2430 and the like. A display control signal (DOFF) is supplied to the control circuit 2450 via the interface circuit 2440. In accordance with the level of the display control signal (DOFF), the area in the display-off mode is flexibly set in the same manner as shown in FIG. 17.

Figure 19:
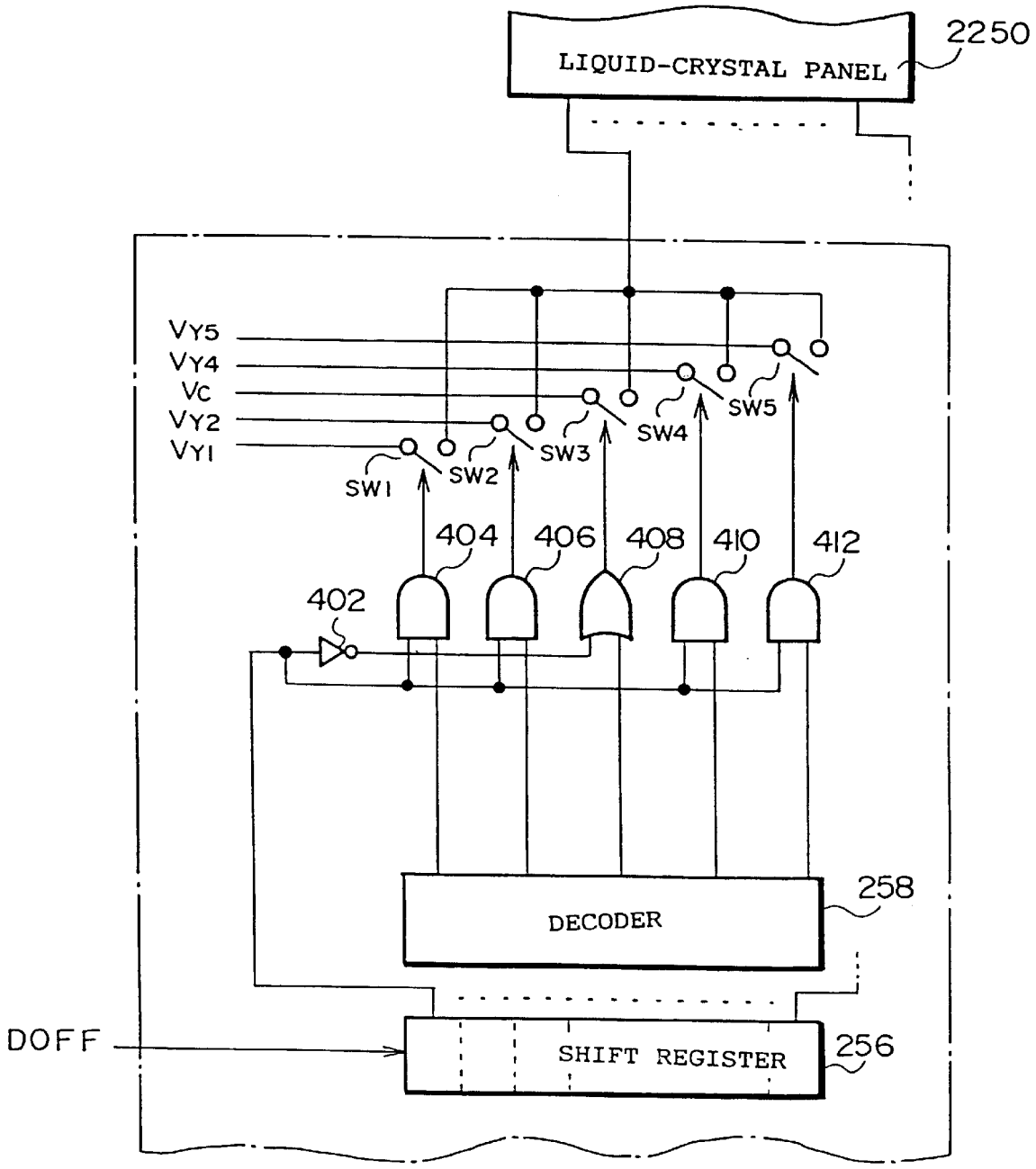
FIG. 19 shows an exemplary construction of the major portion of the liquid-crystal display device in FIG. 17 or FIG. 18.

Referring to FIG. 19, the constructions of the voltage selectors 2100 shown in FIG. 17 and FIG. 18 are now discussed.

The voltage selector in FIG. 19 has the same construction as that shown in FIG. 9. More particularly, the voltage selector comprises a shift register 256 for storing temporarily the display control data (DOFF), logic gates 404, 406, 408, 410, and 412 to which the outputs of the MLS decoder 258 and the data stored in the shift register 256 are input, and the like. The open/close statuses of switches SW 1~SW 5 are controlled by the outputs of the logic gates so that desired voltages are applied to the data lines of a liquid-crystal panel 2250. In the same way as the display device in FIG. 9, the start position of the area in the display-off mode is flexibly set in steps of one output of the data-line driver depending on the value of the display control data (DOFF).

B. Advantages and Features of the MLS Driving Method

Advantages and features of the MLS driving method are now discussed. Power consumption reduction is further promoted in the liquid-crystal display device by applying the production method of the display-off mode described with reference to the first embodiment, to the MLS driving method having the following features. Also, image quality in the liquid-crystal display device is further improved.

The MLS driving method is the technique that simultaneously select a plurality of scanning lines in a passive matrix type liquid-crystal panel such as an STN (Super Twisted Nematic) liquid-crystal panel. With this technique, the drive voltage for the scanning lines is lowered.

Figure 20:
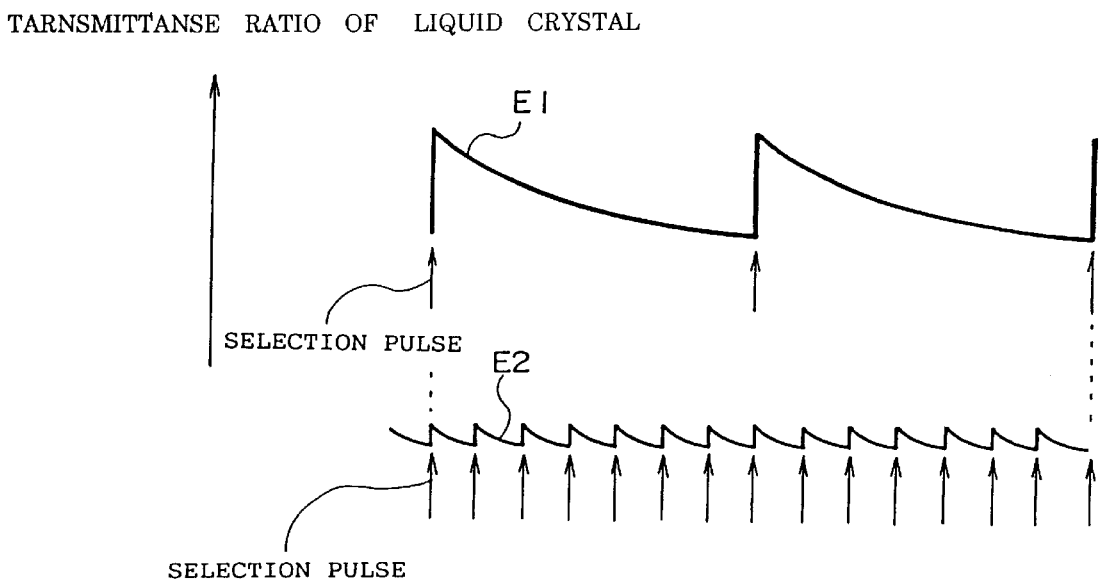
FIG. 20 is a diagram showing the feature of the multi-line driving method.

As shown in FIG. 20, in a prior art line-by-line sequential driving method, the width of a selection pulse is wide, and the light transmittance ratio of the liquid crystal drops with time, and image contrast and luminance (transmittance ratio) of the liquid crystal in its transmission state are lowered. In contrast, the MLS driving method allows a selection pulse to be narrowed as shown in the lower portion of FIG. 20, the drop in transmittance ratio (luminance) of the liquid crystal is small, and an average transmittance ratio is increased. Thus, image contrast is increased.

C. Principle of the MLS Driving Method

Figure 21:
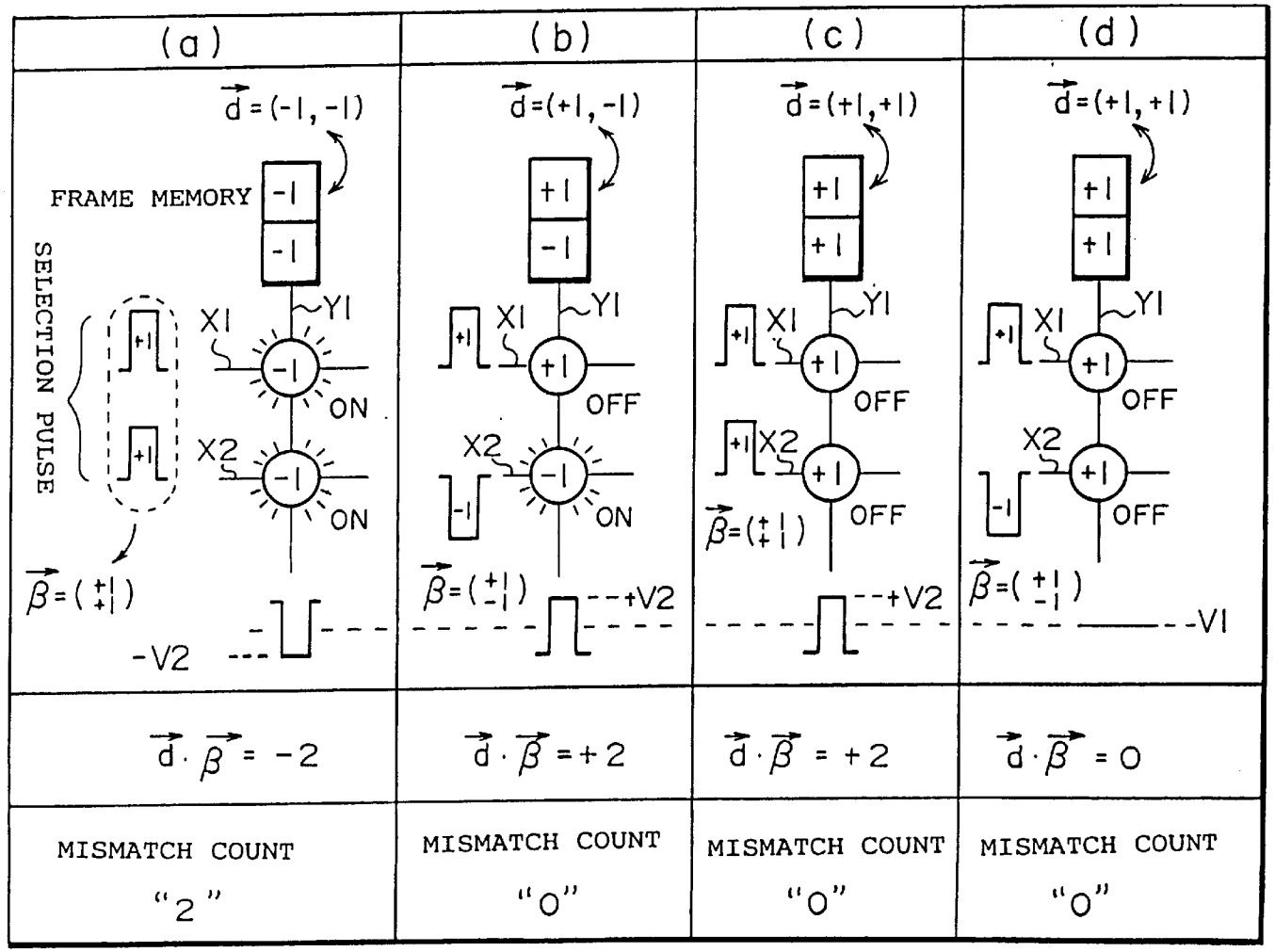
FIG. 21 is a diagram showing the feature of the operation of the multi-line driving method.

As shown in FIG. 21, suppose that two scanning lines X1 and X2 are simultaneously driven, and that pixels at the intersections of these scanning lines and a data line Y1 are turned on/off.

Let "−1" designate an on-pixel, and "+1" designate an off-pixel. Data indicative of on/off statuses is stored in the frame memory. The selection pulse is represented by binary values of "+1" and "−1". The drive voltage of the data line Y1 takes one of the three values "−V2", "+V2", and "V1".

Which voltage level of "−V2", "+V2", and "V1" to provide to the data line Y1 is determined by the product of a display data vector d and a selection matrix β.

$d \cdot \beta = -2$ in (a) of FIG. 21, $d \cdot \beta = +2$ in (b) of FIG. 21

$d \cdot \beta = -+2$ in (c) of FIG. 21 and $d \cdot \beta = 0$ in (d) of FIG. 21.

For the product of the display data vector d and the selection matrix β of "−2", "−V2" is selected as the data-line drive voltage, for "+2", "+V2" is selected, and for "0", "V1" is selected.

To carry out the operation for the product of the display data vector d and the selection matrix β in an electronic circuit, a circuit for determining the mismatch count of corresponding data between the display data vector d and the selection matrix β serves this purpose.

More particularly, for a mismatch count of "2", "−V2" is selected as the data-line drive voltage. For a mismatch count of "0", "+V2" is selected as the data-line drive voltage. For a mismatch count of "1", "V1" is selected as the data-line drive voltage "V1". In the MLS driving in which two lines are simultaneously selected, the data-line drive voltage is determined as described above, and each two lines are selected twice in one frame period to turn on/off the pixels. Since a plurality of selection periods are provided, the drop in transmittance ratio is decreased during the non-selection period, and the average transmittance ratio (luminance) in the liquid panel is increased. Thus, the contrast of the liquid crystal is heightened.

D. Example of MLS Driving

Figure 22:
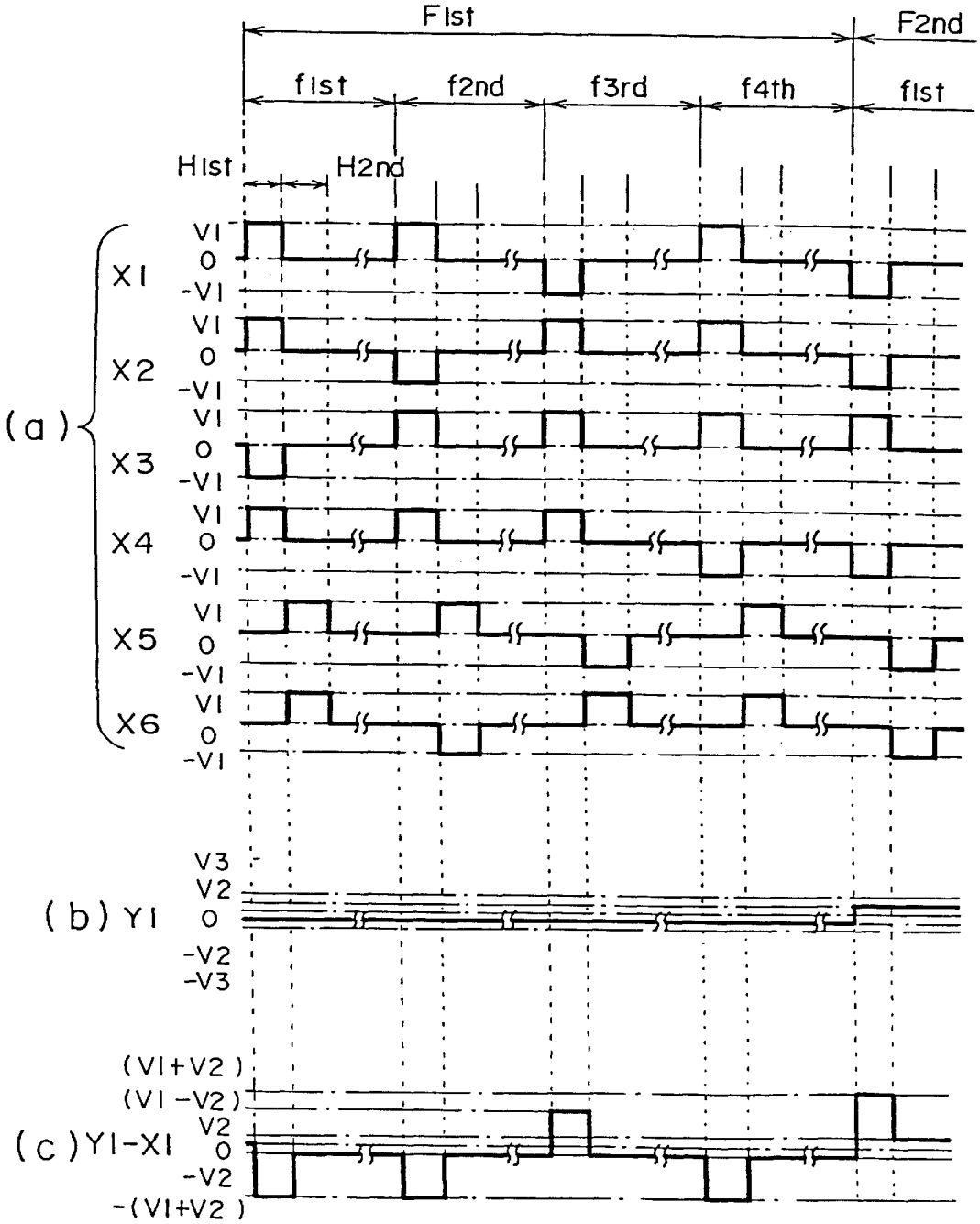
FIG. 22 shows the changes of voltages for the scanning lines, data line and pixels in the liquid-crystal display device which incorporates the multi-line driving method, FIG. 23A and FIG. 23B respectively show exemplary scan voltage patterns in the multi-line driving method.

Specifically discussed referring to FIG. 22 is the operation of a passive matrix type liquid-crystal display device in which four scanning lines are simultaneously selected.

Three voltage levels (+V1, 0, −V1) are appropriately selected for the scanning lines according to a scan voltage pattern that is defined by a predetermined orthogonal function system, and are respectively applied to the four scanning lines. Examples of scan voltage patterns are shown in FIG. 23A and FIG. 23B.

More particularly, four scanning lines X1~X4 are simultaneously selected as shown in (a) of FIG. 22.

The scan voltage pattern is compared to the display data pattern, and the voltage level (one of the five voltage levels of −V3, −V2, 0, +V2, +V3) determined by the number of mismatch count is applied to each data line by the data-line driving circuit. The following discussion describes the procedure of determining the voltage level applied to the data lines.

The scan voltage pattern is (+) when the selection voltage is +V1, and (−) when the selection voltage is −V1, and the display pattern is (+) when data is for display-enabled, and (−) when data is for display-off. The mismatch count is not considered during the non-selection period.

Referring to FIG. 22, let one frame period (F) represent a duration required for presenting one screen, one field period (f) represent a duration required for selecting all the scanning lines once, and one selection period (H) represent a duration required for selecting a scanning line once.

"$H_{1st}$" denotes a first selection period, and "$H_{2nd}$" denotes a second selection period in FIG. 22.

Furthermore, $f_{1st}$ denotes a first field period, and $f_{2nd}$ denotes a second field period. $F_{1st}$ denotes a first frame period and $F_{2nd}$ denotes a second frame period.

Referring to FIG. 22, the scan pattern of four lines (X1~X4) selected during the first selection period ($H_{1st}$) within the first field $f_{1st}$ is predetermined as shown in (a) of FIG. 22, and is always (++−+) regardless of the state of the display screen.

Considering setting the entire screen to display-enabled state, the first column display pattern (for pixel (X1, Y1), pixel (X3, Y1) and pixel (X4, Y1)) is (++++). Comparing sequentially both patterns, first, second and fourth polarities match but third polarities mismatch. The mismatch count is thus "1". With a mismatch count of "1", a voltage level of −V2 is selected from five levels (+V3, +V2, 0, −V2, and −V3). In this way, for the scanning lines X1, X2, and X4, all of which select +V1, the voltage applied to liquid crystals is increased by the selection of −V2, while for the scanning line X3 that selects −V1, the voltage applied to the crystal is decreased by the selection of −V2.

In this way, the voltage applied to the data line correspond to "the weight of a vector" during an orthogonal transformation, and if all the weights for four scan lines are summed, the voltage levels for reproducing a true display pattern are set.

In a similar fashion, −V3 is selected for a mismatch count of "0", 0V level is selected for a mismatch count of "2", +V2 is selected for a mismatch count of "3", and +V3 is selected for a mismatch count of "4". The voltage ratio of V2 to V3 is set for (V2:V3=1:2).

The mismatch counts are equally determined for columns of data lines from Y2 to Ym in connection with scanning lines X1~X4, and the data of the obtained selected voltage is transferred to the data-line driving circuit, and the voltage that is determined according to the above procedure during the first selection period is applied.

Likewise, the above procedure is repeated for all the scanning lines (X1~Xn), and the operation for the first field period ($f_{1st}$) is completed.

The above procedure is repeated for the second field thereafter until one frame ($F_{1st}$) is completed, and thus one screen is presented.

According to the above procedure, the voltage waveform applied to the data line (Y1) with the entire screen set to display-enabled state is obtained as shown in (b) of FIG. 22, and thus the waveform applied to the pixel (X1, Y1) is shown in (c) of FIG. 22.

The above discussion has specifically explained the MLS driving method.

(10) Ninth Embodiment

In this embodiment discussed here, the border position between one display not to be used for image presentation and the other display to be used for image presentation is controlled along the Y direction (the scanning line) of the display panel.

Figure 24A:
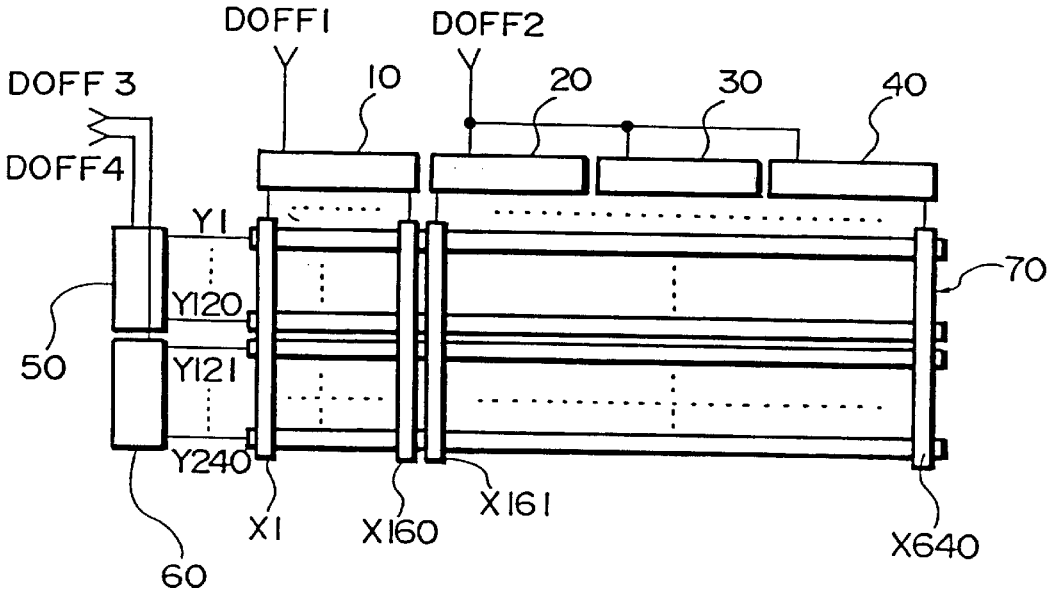
FIG. 24A shows an exemplary construction of the liquid-crystal display device of the present invention (in which display control is performed in the direction in which the scanning lines are arranged)
Figure 24B:
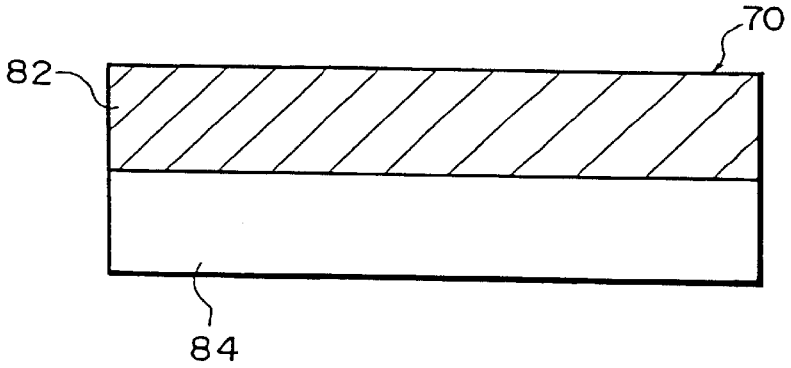
FIG. 24B shows the display control in the liquid-crystal display device of FIG. 24A.

More particularly, as shown in FIG. 24A, display control signals DOFF3, DOFF4 are fed to scanning line driving circuits 50, 60 so that the screen of a liquid-crystal panel 70 is partitioned into an area 82 to be used for image presentation and an area 84 not to be used for image presentation as shown in FIG. 24B.

Figure 25:
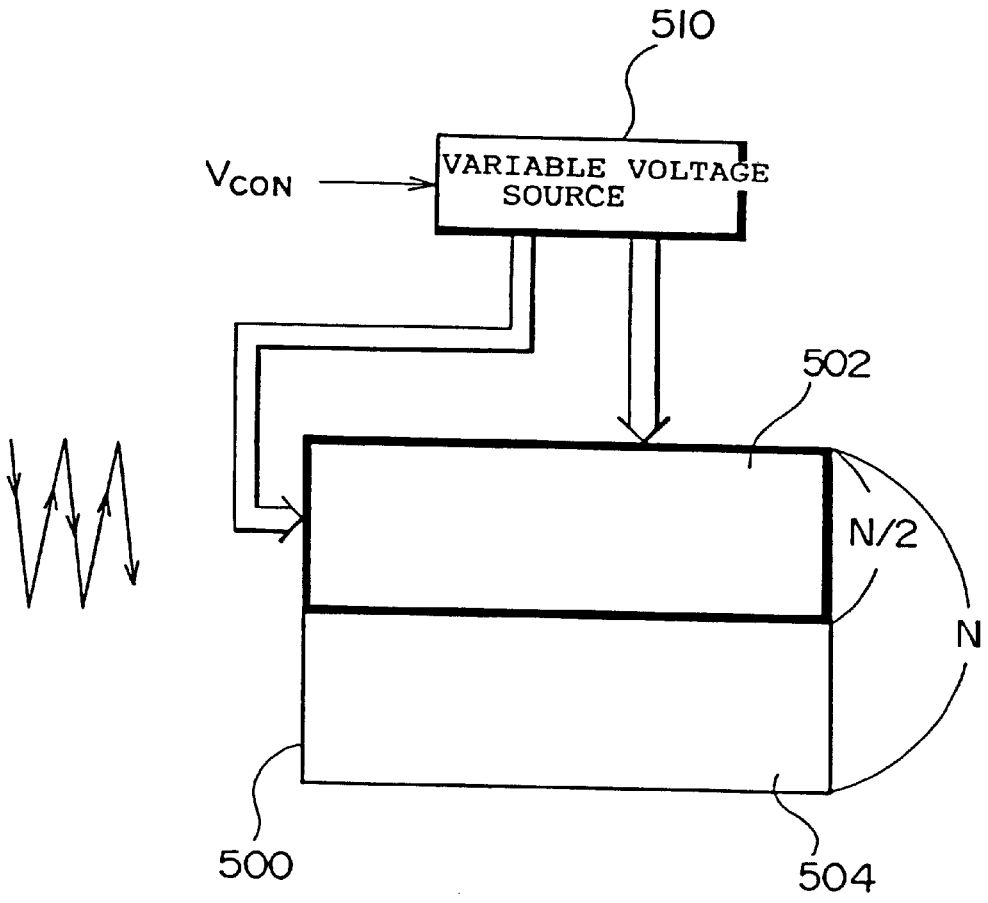
FIG. 25 shows an example of display control in the liquid-crystal display device of the present invention.

Such display control is carried out by performing the driving as shown in FIG. 25, for example. In the driving method shown in FIG. 25, the scanning lines responsible for an area 502 to be used for image presentation are included in the range of selection, while the scanning lines for the area 504 other than the area 502 are excluded from the range of selection.

The display panel size is virtually modified in this way, and the duty factor in the driving is changed from "N" to "N/2". In accordance with the change of duty factor, the voltage a variable voltage source 510 supplies to the scanning-line driving circuit is changed in response to a control signal $V_{CON}$.

Since in the example shown in FIG. 25, the driving duty factor is changed to ½, half the voltage the variable voltage source 510 supplies to the scanning-line driving circuit is sufficient enough.

The area 504 not to be used for image presentation is an area which does not serve as an image presenting screen at all.

Figure 26:
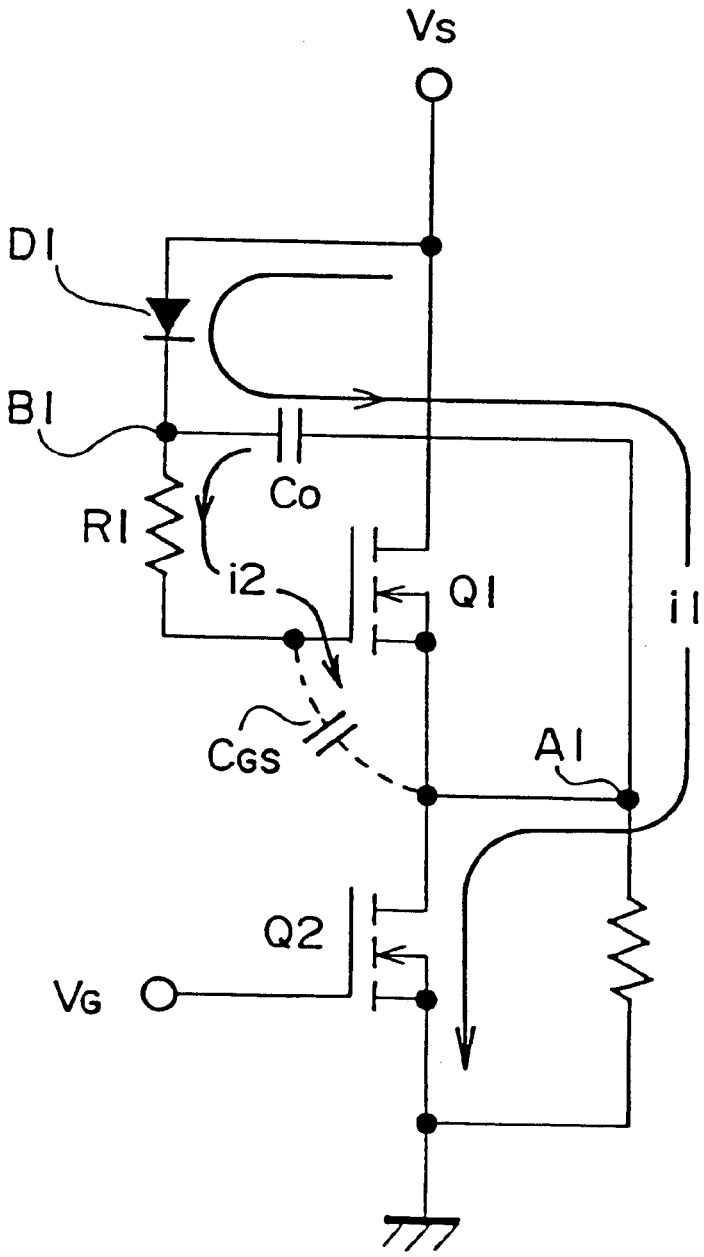
FIG. 26 shows an example of a variable voltage source (a bootstrap circuit) shown in FIG. 25.

A variable voltage source 26 may be constituted using a bootstrap circuit shown in FIG. 26, for example.

The bootstrap circuit shown in FIG. 26 operates as follows.

When a transistor Q2 turns on with its gate voltage Vg driven to "H", a current i1 flows charging a capacitor Co. The voltage across the capacitor Co becomes V1.

When the transistor Q2 turns off, a current i2 flows turning a transistor Q1 on and setting the voltage at a node A1 equal to Vs.

The voltage at a node B1 rises to Vs+V1. A wide range of voltages may be generated by selecting appropriate V1 and Vs.

A liquid-crystal display device shown in FIG. 510 that adopts the MLS driving method operates the driving method of this embodiment. An MLS controller 2340 varies the output voltage from a variable voltage source 510 using a control voltage $V_{CON}$ in accordance with display control signals DOFF3 and DOFF4.

(11) Tenth Embodiment

Figure 28A:
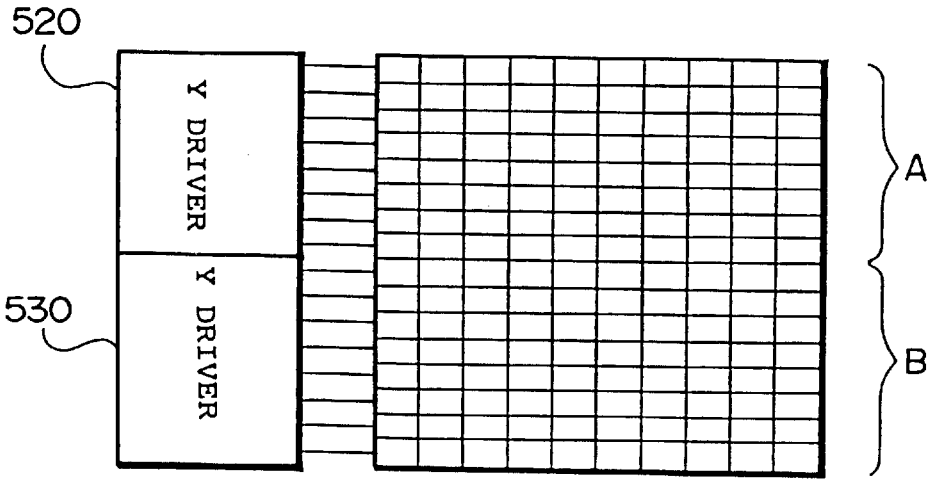
FIG. 28A shows a screen on which no image is presented.
Figure 28B:
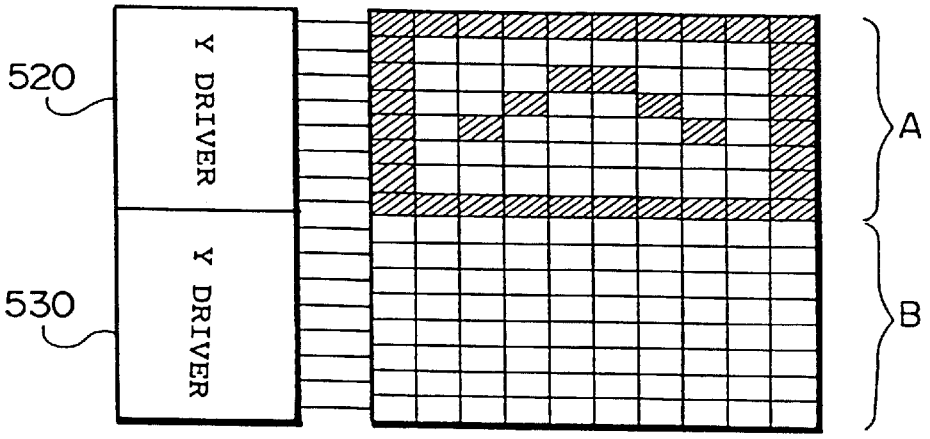
FIG. 28B shows a screen, one half of which presents an image.
Figure 28C:
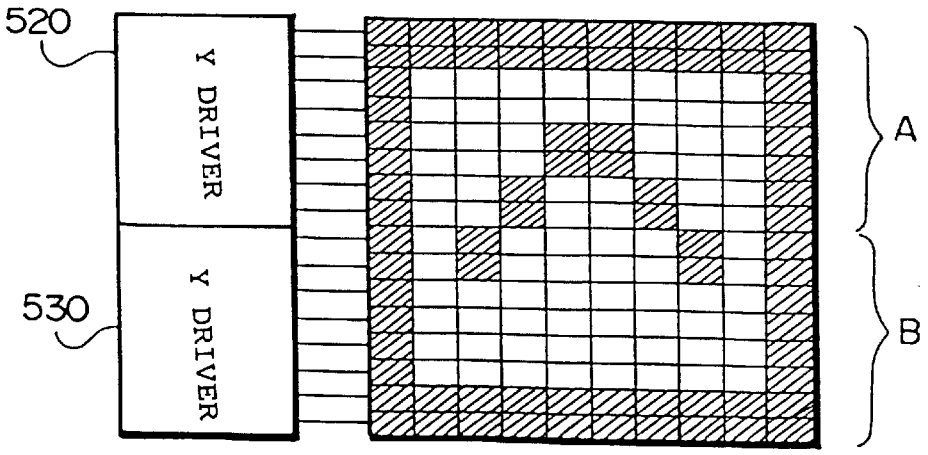
FIG. 28C shows a screen, which presents the image of FIG. 28B in double sizing (with a resolution of half that of the image of FIG. 28B)

In this embodiment, the image size is enlarged without changing the driving duty factor. Namely, the image is subjected to resolution conversion process. Referring to FIGS. 28A–FIG. 28C, this process is discussed.

As shown in FIG. 28A, the display panel has two display areas "A" and "B", a Y driver 520 is responsible for the driving of the scanning lines for the area "A", and a Y driver 530 is responsible for the driving of the scanning lines for the area "B".

Using the method described with reference to FIG. 25, an image is presented on the area "A" only as shown in FIG. 28B. In this case, the area "B" contributes nothing to image presentation. In this state, only the upper half of the display panel is used for image presentation, and gives less visual impact on viewers of the image.

As shown in FIG. 28C, two vertically adjacent pixels are used to present the same image to double vertically the image in size. Although the image size is doubled, the same image is merely presented by two pixels, and thus the driving duty factor remains unchanged from that in FIG. 28B. This arrangement results in no substantial change in power consumption. However, the image resolution is halved, and the quality of image is thus reduced. With the image size doubled, however, the visual impact of the image to a viewer is stronger, thereby reinforcing display functionality.

Figure 29:
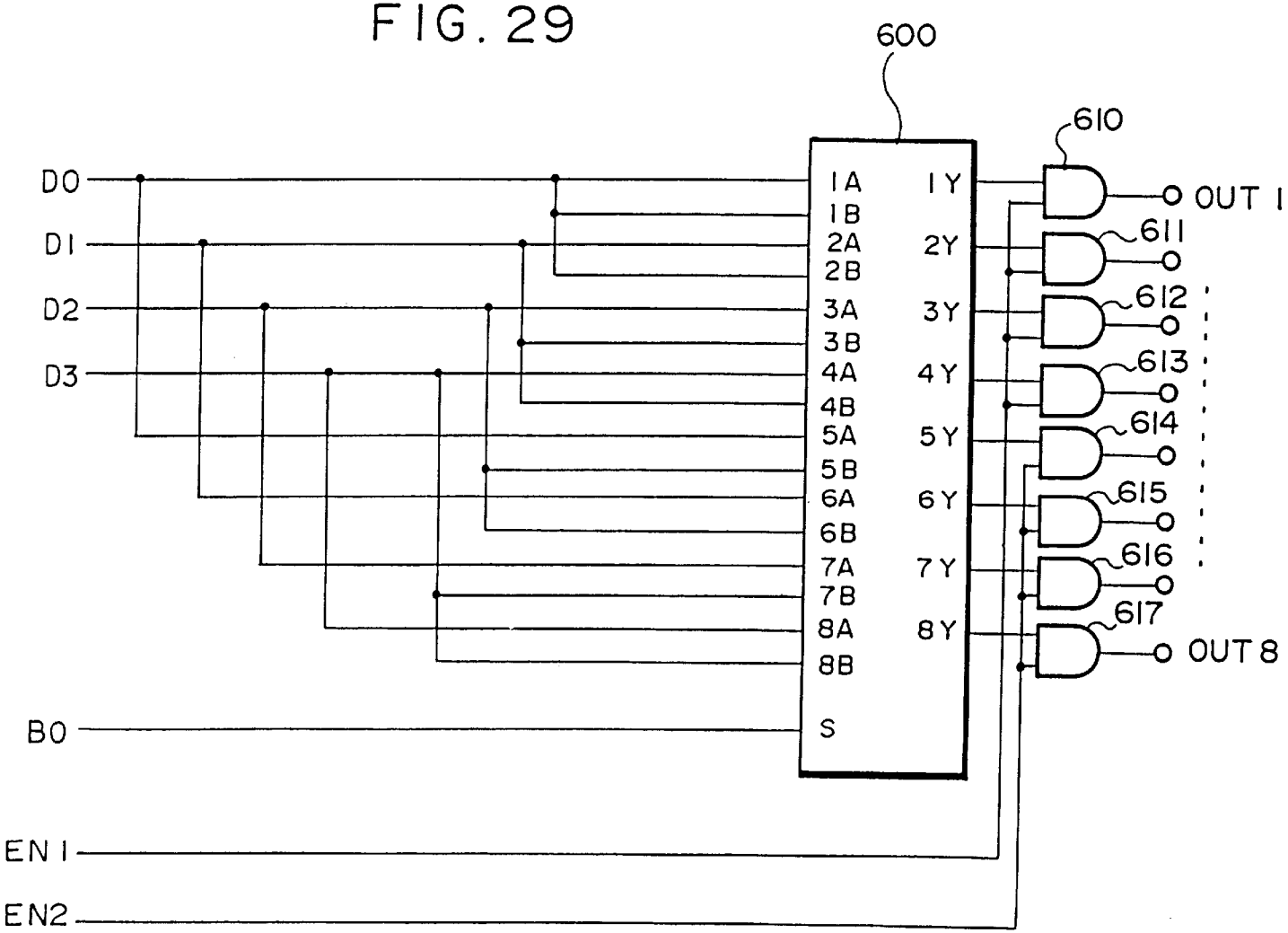
FIG. 29 is a schematic diagram of a circuit for performing resolution conversion as shown in FIG. 28B and FIG. 28C, FIG. 30A and FIG. 30B respectively show the operation of the circuit shown in FIG. 29.

FIG. 29 shows a major portion of the construction of the scanning-line driving circuit in the liquid-crystal display device that adopts the MLS driving method, in which the image size is doubled (with the resolution halved) without changing the driving duty factor. FIG. 30A and FIG. 30B show conditions at typical points when the display in FIG. 28*b* and the double-sized display in FIG. 28C are presented, respectively.

A circuit 600 shown in FIG. 29 is provided with input terminals 1A, 2A . . . 8A, and input terminals 1B, 2B . . . 8B. One of data D0, D1, D2 and D3 is fed to each of the terminals. The data D0, D1, D2 and D3 are the ones that determine the voltages applied to the scanning lines.

When a control signal B0 is at "L", data fed to 1A, 2A . . . 8A are output at output terminals 1Y, 2Y . . . 8Y, respectively. When the control signal B0 is at "H", data fet to 1B, 2B . . . 8B are output at the output terminals 1Y, 2Y . . . 8Y.

Each of the output terminals 1Y, 2Y . . . 8Y in the circuit 600 is connected to one input terminal of each of respective two-input AND gates 610~617. An enable control signal EN1 is fed to the other input terminal of each of the two-input AND gates 610~613 and an enable control signal EN2 is fed to the other input terminal of each of the two-input AND gates 614~617.

To present the display shown in FIG. 28B, the control signal B0 is driven to "L", the enable control signal EN1 to "H", and the enable control signal EN2 to "L" as shown in FIG. 30A. Data D0, D1, D2 and D3 are output at output terminals OUT1~OUT4 of the respective two-input AND gates 610~614 shown in FIG. 29, and based on the output data, the voltages for four scanning lines are determined.

To present the double-sized display shown in FIG. 28C, the control signal B0 is driven to "H", the enable control signal EN1 to "H", and the enable control signal EN2 to "H" as shown in FIG. 30B. Data D0, D0, D1, D1, D2, D2, D3, and D3 are output at output terminals OUT1~0UT8 of the respective two-input AND gates 610~617 shown in FIG. 29, and based on the output data, the voltages for eight scanning lines are determined. More particularly, every two adjacent scanning lines are supplied with the same scanning-line drive voltage. In this way, the image size is doubled.

Although the image size is doubled in the above example, the image size may be quadrupled or octupled in a similar manner. In any of these enlarged sizes, with power consumption that is as low as that in the case where an partial area of one screen is set to the display-off state, the visual impact of, for example, an icon is increased and sufficient enough to impress the user of the liquid-crystal panel therewith.

(12) Eleventh Embodiment

The ninth embodiment, discussed referring to FIG. 24 and FIG. 25, covers the display control method in which the border position between one display not to be used for image presentation and the other display to be used for image presentation is controlled along the Y direction (the scanning line) of the display panel. In this method, however, a variable voltage source is required because the driving duty factor changes.

In this embodiment, the equivalent display control is performed but without changing the driving duty factor.

Figure 31:
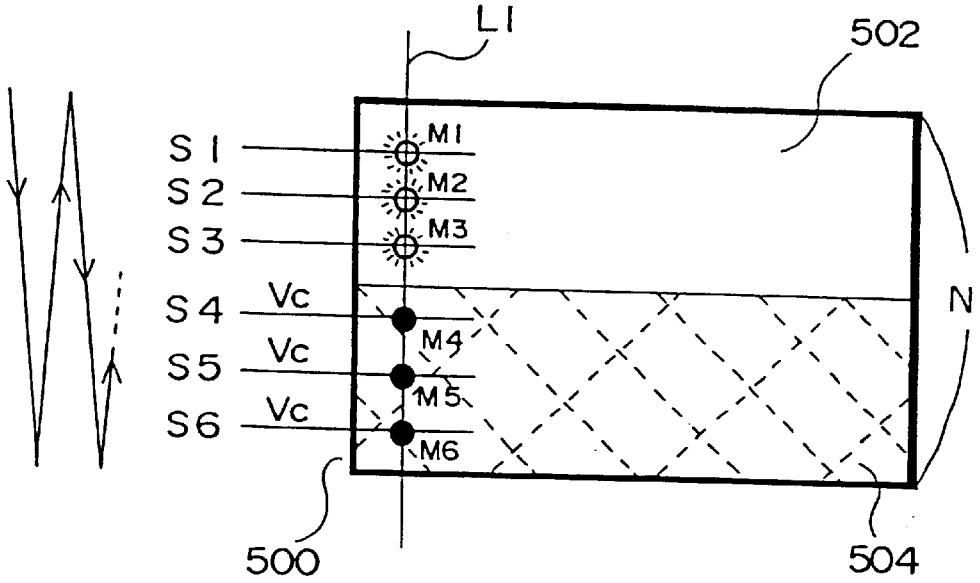
FIG. 31 shows specific display control carried out by the liquid-crystal display device (incorporating the multi-line driving) of the present invention.

As shown in FIG. 31, this embodiment selects all the scanning lines S1~S6 without changing the driving duty factor "N".

Out of the screen of a display panel 500, an area 502 is the area to be used for image presentation, handled by scanning lines S1~S3, and an area 504 is the area not to be used for image presentation, handled by scanning lines S4~S6.

Now, pixels M1~M6 along a data line L1 are considered with pixels M1~M3 turned on and pixels M4~M6 turned off. To merely turn off the pixels M4~M6, it is sufficient to fix the voltage level of the data line L1 to the above-described Vc (the voltage of the scanning lines during the non-selection period) while the scanning lines S4~S6 are selected, but with this arrangement, the pixels M1~M3 become too dark to present adequately an image. This is because the circuit of the display device is designed on the assumption that the voltage applied to the data line L1 for presenting the predetermined display (the voltage required to turn on/off display) is continuously applied. Namely, applying to the data line L1 the voltage level of Vc for the scanning lines during the non-selection period is an out-of-specification driving method.

In this embodiment, at the timings for selecting scanning lines S4, S5, and S6, the non-selection voltage Vc is applied to the scanning lines while the data line L1 is supplied with one of the voltages for on/off display state. In this way, the display by pixels M1, M2 and M3 is properly presented while pixels M4, M5 and M6 are set to the display-off state. In the area 504 currently in the display-off state, the voltage level of the scanning lines is fixed to Vc with no polarity reversion, and thus power consumption is reduced even if the voltage for displaying is provided to the data line.

Since the driving duty factor is free from change, a variable voltage source is not required, and the power supply circuit is simpler in its construction, thus needing less power consumption.

Figure 32:
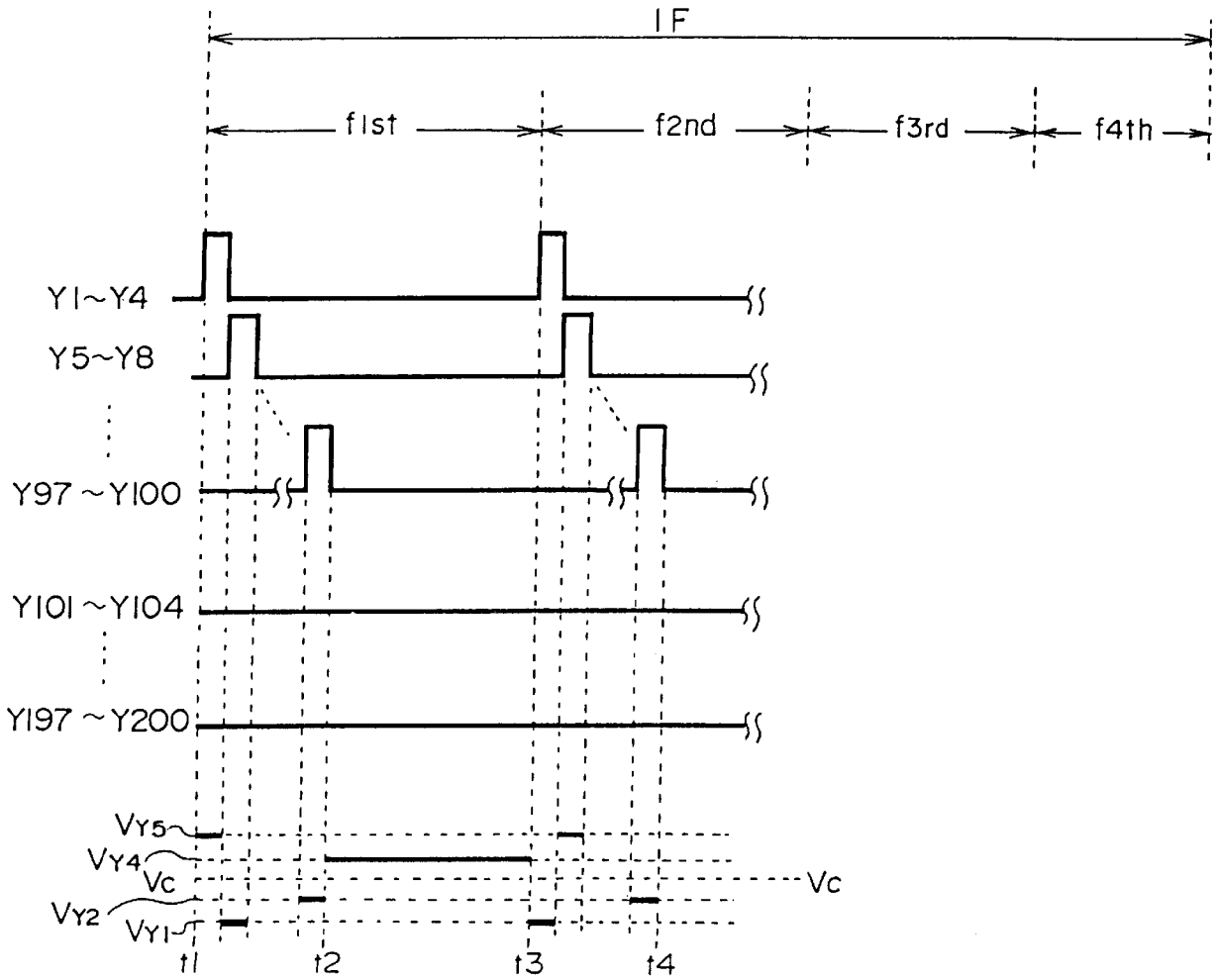
FIG. 32 is a timing diagram showing the operation of the device of FIG. 31.

FIG. 32 is a timing diagram showing the operation of the display device in which the driving method of this embodiment is combined with the MLS driving method capable of selecting simultaneously four lines. For simplicity, FIG. 32 shows waveforms during first and second field periods.

Referring to FIG. 32, an appropriate image presentation is provided for a duration from time t1 to t2 and a duration from t3 to t4, and over a duration from time t2 to time t3, the screen is set to the display-off state. For the duration from time t2 to t3, the corresponding scanning lines Y101~Y200 are kept to the non-selection voltage level Vc, while the data line is supplied with "$V_{Y4}$" rather than "Vc".

Figure 27:
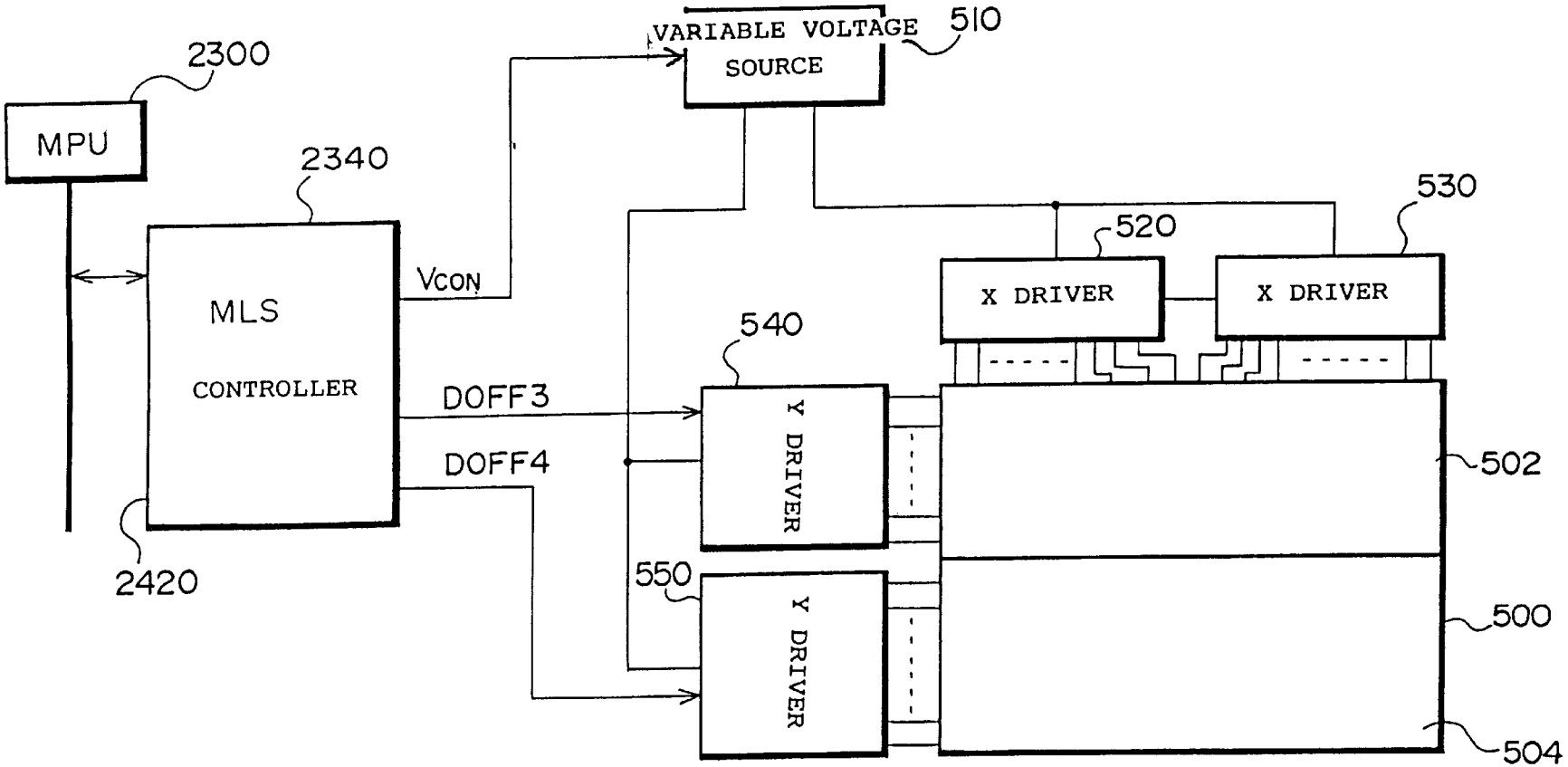
FIG. 27 shows an exemplary construction of the liquid-crystal display device that incorporates the multi-line driving method to carry out the display control shown in FIG. 25.
Figure 33:
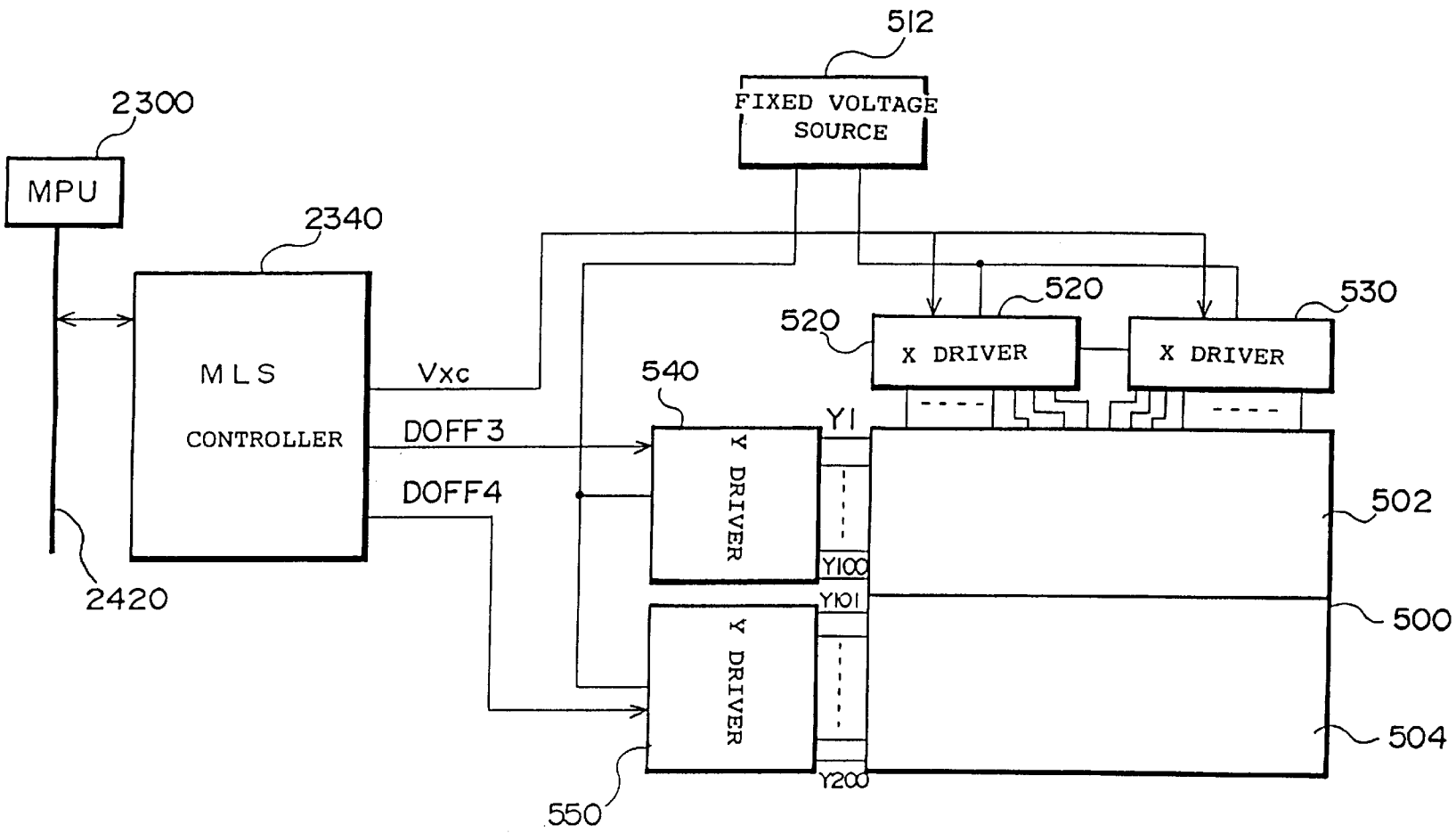
FIG. 33 is a block diagram showing an exemplary construction of the liquid-crystal display device that carries out the display control shown in FIG. 31.

FIG. 33 shows a construction of the liquid-crystal display device that adopts the MLS driving method described with reference to FIG. 32. Unlike the display device shown in FIG. 27, this display device includes a fixed voltage source 512. An MLS controller 2340 issues DOFF3, DOFF4 to fix the scanning-line drive outputs to Vc while issuing $V_{XC}$ at the same time to fix the outputs of X drivers 520, 530 to a predetermined voltage ($V_{Y4}$, for example, as shown in FIG. 32).

(13) Twelfth Embodiment

Figure 34A:
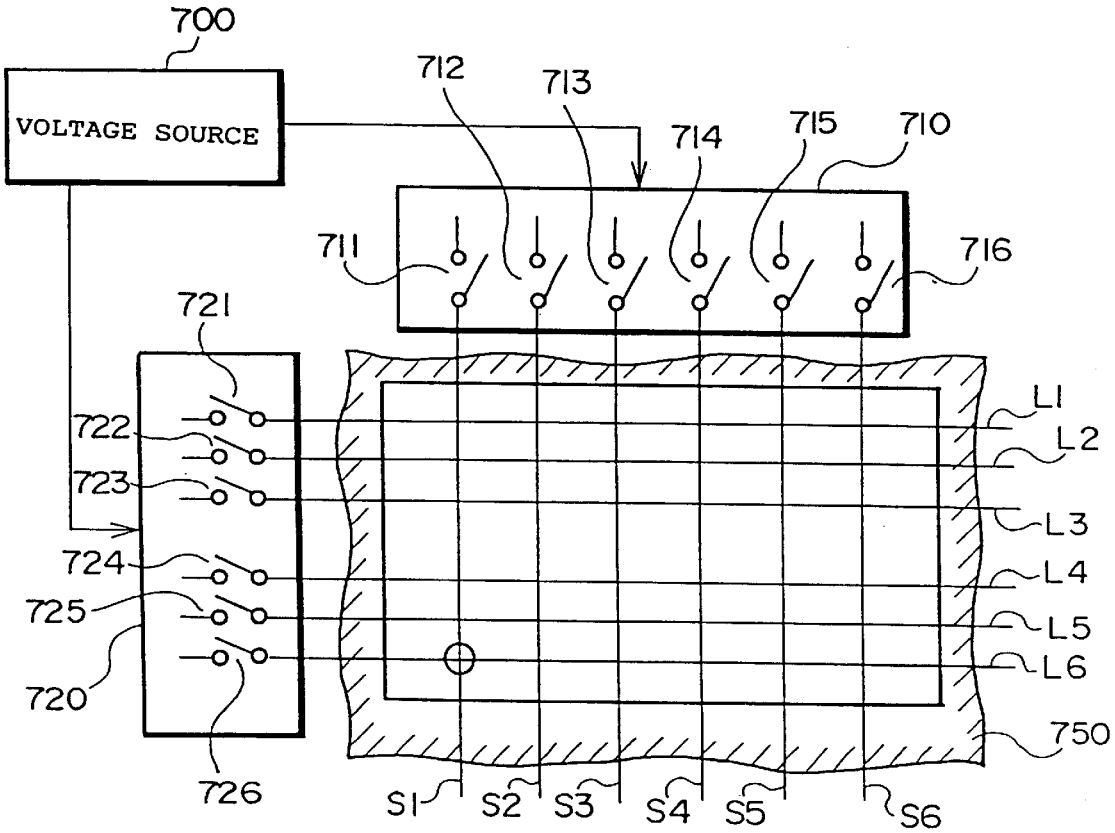
FIG. 34A shows a major portion of the construction of the liquid-crystal display device of the present invention.
Figure 34B:
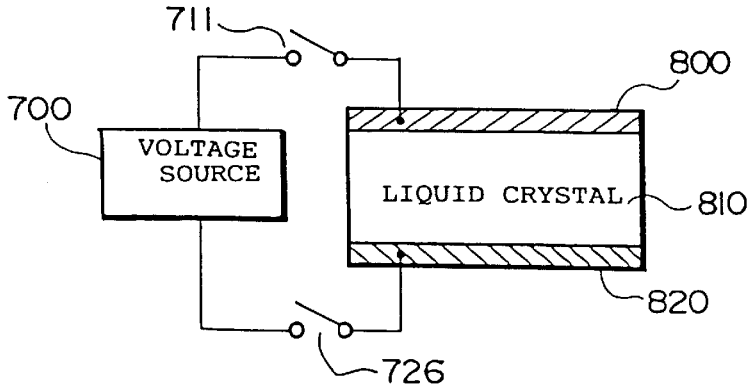
FIG. 34B shows the feature of the construction of FIG. 34A.

FIG. 34A and FIG. 34B show the construction of a major portion of the liquid-crystal display device of a twelfth embodiment. The feature of this embodiment is that at least either the scanning lines or the data lines are set to an electronically floating state to turn the screen to the display-off state (a high-impedance state). With this arrangement, unnecessary power consumption in the liquid-crystal panel is avoided.

As shown in FIG. 34B, the liquid-crystal panel includes conductive layers 800, 820, between which a liquid crystal 810 is enclosed, and a predetermined voltage is generated by a voltage source 700 to drive the liquid crystal, and to present a predetermined display. The conductive layers 800, 820 are constituent materials of the scanning lines and the data lines.

Even if the same voltage is applied to the conductive layers 800, 820 to set the screen to the display-off state, a small voltage difference still takes place between the conductive layers. When a path connecting the liquid crystal 810 to the voltage source 700 is established, electric charge flows into the liquid crystal 810 from the conductive layer 800 or conductive layer 820 due to the voltage difference between the conductive layer 800 and conductive layer 820, causing a current flow. This current is an unnecessary current.

For this reason, as shown in FIG. 34B, switches 711 and 726 are arranged in voltage application paths to the conductive layers 800, 820 to cause at least one of the switches 711, 726 to open during a high-impedance mode. In this way, the current path is disconnected, and such an unnecessary current never flows. With this arrangement, power consumption is reduced.

However, since the scanning lines or the data lines at an electrically floating state are rendered unstable, it is expected that an unwanted pattern will appear on the screen due to static electricity or the like. When at least either the scanning lines or the data lines are set to an electrically floating state, the screen is preferably covered with a covering to relieve the user of the liquid-crystal panel of uncomfortable feelings.

In the liquid-crystal panel shown in FIG. 34A, switches 711~716 within switch means 710 and switches 721~726 within switch means 720 are all opened. Therefore, the scanning lines L1~L6 and the data lines S1~S6 are all set to an electrically floating state. The screen is covered with a covering 750.

Figure 35:
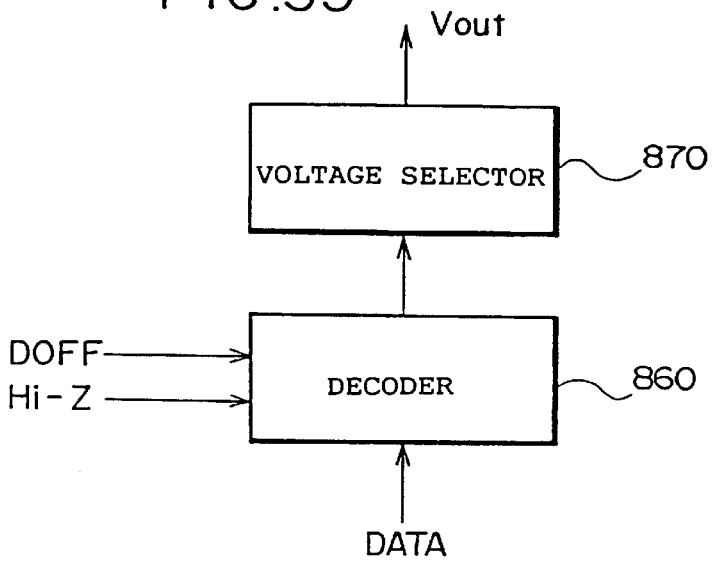
FIG. 35 shows major portion of the construction of the liquid-crystal display device which incorporates the multi-line driving method and carries out the display control shown in FIG. 34A and FIG. 34B.
Figure 36:
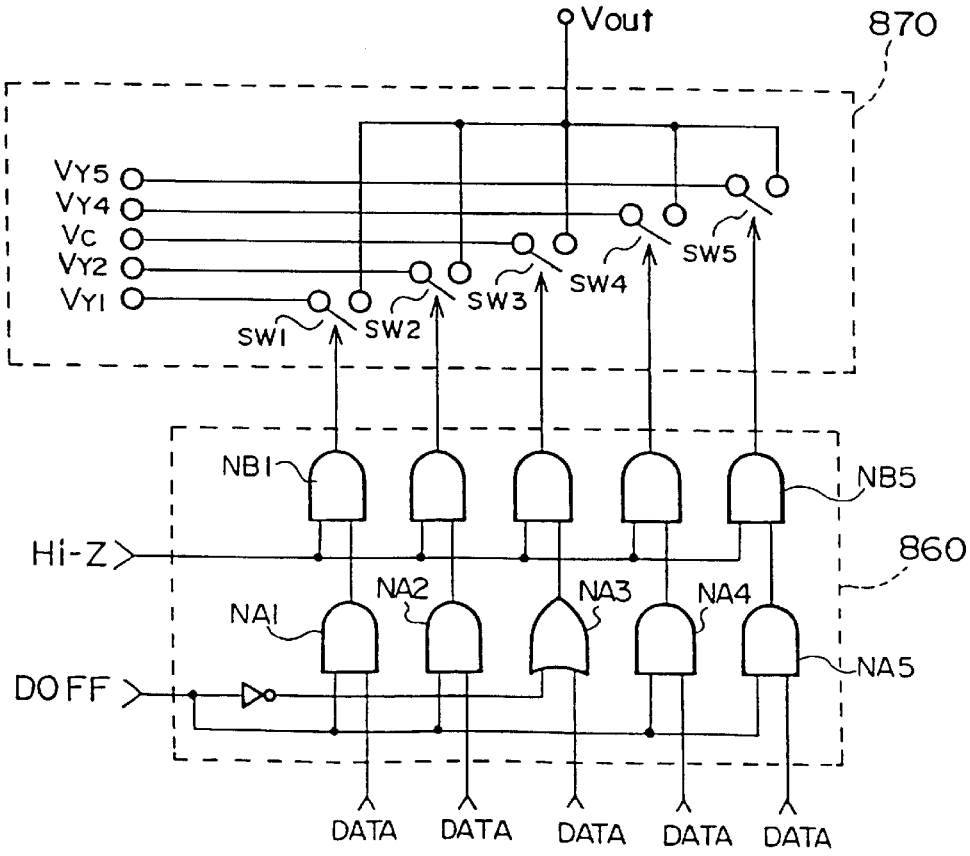
FIG. 36 is a schematic diagram showing a more specific construction of the construction shown in FIG. 35.

FIG. 35 and FIG. 36 show the construction of the liquid-crystal display device adopting the MLS driving method, which offers a mode (a high-impedance mode) for disabling the displaying by putting the voltage of the data lines to an electrically floating state.

More particularly, as shown in FIG. 35, a control signal Hi-Z for the high-impedance mode is fed to a multi-line decoder 860. Also fed to the multi-line decoder 860 is a display control signal DOFF for a display-off state.

FIG. 36 shows an exemplary construction of the multi-line decoder 860 and a voltage selector 870.

The multi-line decoder 860 comprises logic gates Na1~NA5 for decoding image data (DATA) and the display control signal DOFF, and AND gates NB1~NB5 for decoding the control signal Hi-Z and each of the outputs of the respective logic gates NA1~NA5.

When the control signal Hi-Z is driven to "L", the outputs of the AND gates NB1~NB5 are forced to "L". In response to this transition, switches SW1~SW5 within the voltage selector 870 are opened, causing the data lines to be electrically floating. The display screen is thus set to the high-impedance mode.

(14) Thirteenth Embodiment

Figure 37:
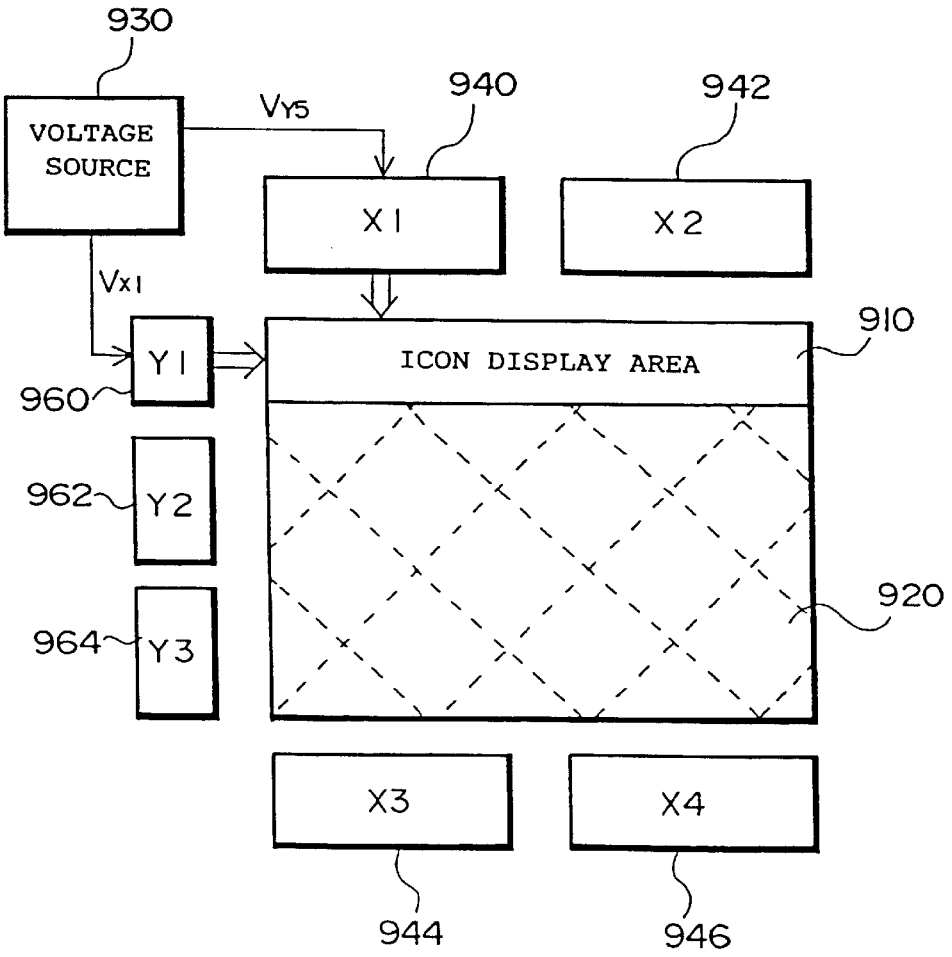
FIG. 37 is a diagram showing an exemplary construction of the liquid-crystal display device of the present invention.

FIG. 37 shows a typical construction of the liquid-crystal display device of a thirteenth embodiment.

The liquid-crystal display device of this embodiment comprises a first display panel 910 and a second display panel 920.

By setting the adequate number of scanning lines (the driving duty factor) of the first display panel 910, a voltage source 930 equalizes a voltage $V_{X1}$ applied to a scanning-line driver (Y1) 960 to a voltage $V_{Y5}$ applied to a data-line driver (X1) 940. Therefore, what is required of the voltage source 930 is to generate a common voltage, and thus the construction of the power supply circuit 930 is simplified, and power consumption is reduced.

Both panels 910, 920 are MLS driven to present image. As shown in FIG. 37, an X driver (X1) 940, an X driver (X2) 942, and a Y driver (Y1) 960 are arranged to drive the first display panel 910. An X driver (X3) 944, an X driver (X4) 946, a Y driver (Y2) 962, and a Y driver (Y3) 964 are arranged to drive the second display panel.

The first display panel 910 may be a dedicated panel for presenting a simple icon, for example, and the second panel 920 may be a general panel for presenting a variety of displays. The number of scanning lines for the first panel 910 is substantially smaller than that of the scanning lines for the second panel 920.

An elongated display area works as the first display panel 910 because its function is only to present an icon, and the driving duty factor of the first display panel 910 is made small and the level of the voltage applied to the X driver 940 is equalized to the level of the voltage applied to the Y driver 960.

More particularly, when the MLS driving method is adopted as shown in the right portion of FIG. 1B, the selection voltage level $V_{X1}$ ($-V_{X1}$) of the scanning lines is typically unequal to the selection voltage level $V_{Y5}$ ($V_{Y1}$) of the data lines However, with the number of simultaneously selected scanning lines h=4 and the threshold voltage of the liquid crystal Vth=2.0 V, $V_{X1}$ and $V_{Y5}$ are 3.27 V and thus coincide with each other when the number of scanning lines for the first display panel 910 is 16.

By properly adjusting the number of scanning lines (by properly adjusting the driving duty factor), the selection voltage level of the scanning lines is equalized to the selection voltage level of the data lines. The display device shown in FIG. 37 takes advantage of this technique to simplify the construction of the voltage source 930 and thus to reduce power consumption. Therefore, icons are presented at a low power consumption.

A variety of displays may be presented on the second display panel 920.

(15) Fourteenth Embodiment

In a fourteenth embodiment, the driving circuit for driving a display matrix is provided with both the function for driving scanning lines and the function for driving data lines.

The functions are switched depending on the size and shape of an image display area to change the driving duty factor, thus to reduce both the voltage of the scanning lines during the selection period and power consumption during image presentation.

Figure 38:
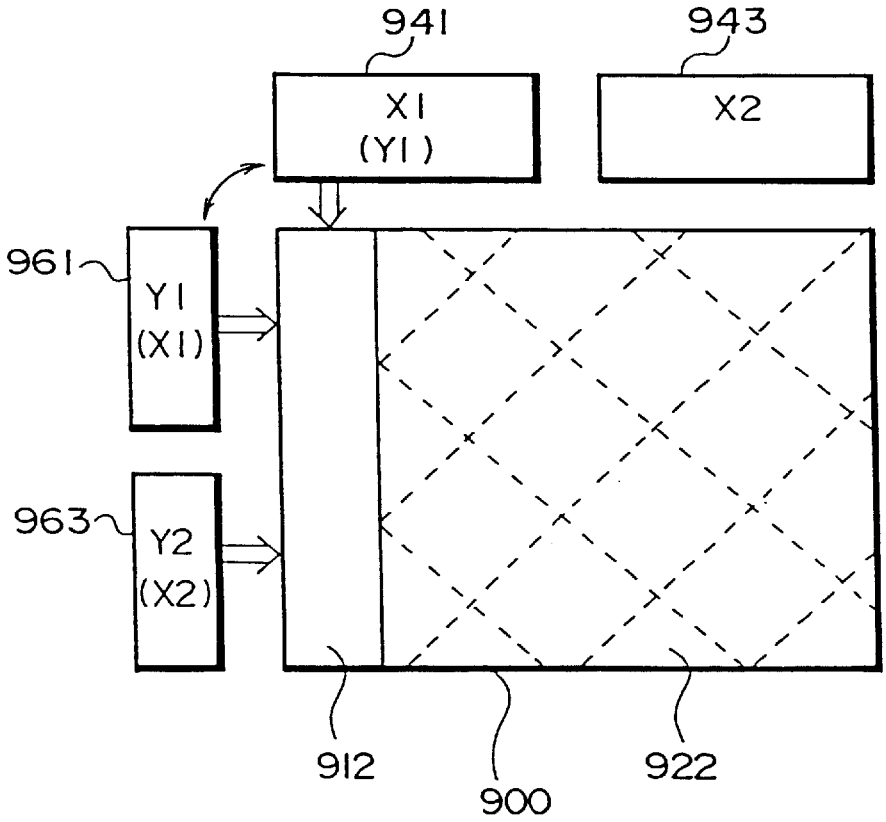
FIG. 38 is a diagram showing an exemplary construction of the liquid-crystal display device of the present invention.

The fourteen embodiment is discussed in detail referring to FIG. 38. As shown in FIG. 38, an area 912 is an area (display area) for presenting an image, and an area 922 is an area not used for image presentation (display-off mode area).

A driver 941 currently functions as a data-line driver (an X driver) and both a driver 961 and a driver 963 function as scanning-line drivers (Y drivers).

Now, the shape of the display area 912 is considered. The display area 912 is vertically elongated. Specifically, it is vertically long and horizontally short across in size. In such a case, the driver 941 is designed to function as a scanning-line driver (a Y driver) while both the driver 961 and driver 963 are designed to function as data-line drivers (X drivers). With this arrangement, the number of scanning lines (driving duty factor) is reduced, and the selection voltage level of the scanning lines is reduced according to the reduced quantity of the driving duty factor. In this way, the power consumption of the display device is reduced.

(16) Fifteenth Embodiment

An electronic apparatus incorporating the display device is now discussed referring to FIG. 39~FIG. 43.

Figure 39A:
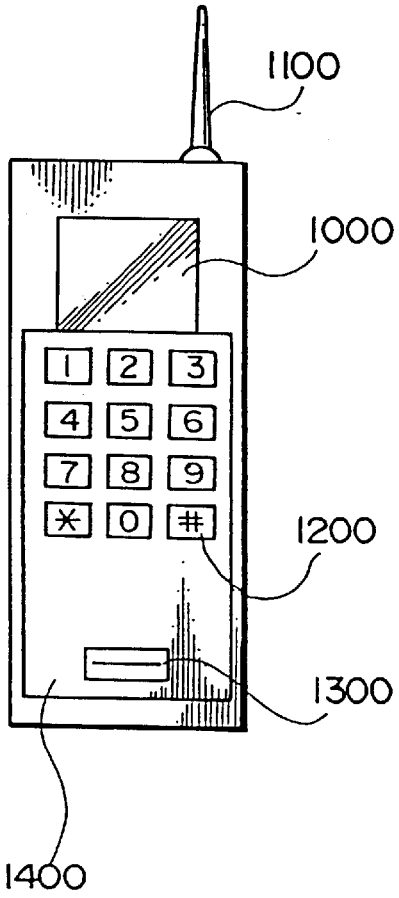
FIG. 39A is a front view showing a portable telephone in its normal use which incorporates the display device of the present invention.
Figure 39B:
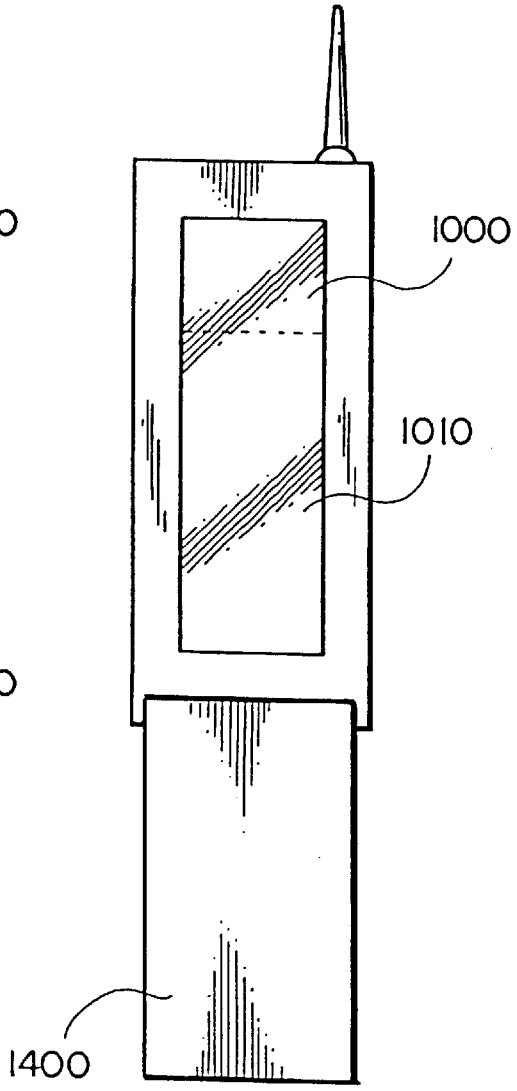
FIG. 39B is a front view showing the portable telephone of FIG. 39A in its special use.

FIG. 39A is an external view showing a portable telephone in its normal use, and FIG. 39B is an external view showing the portable telephone that is used as a portable terminal.

The portable telephone comprises a screen 1000, a screen 1010, an antenna 1100, touchpad keys 1200, a microphone 1300, and the panel 1400. The screen 1000 and screen 1010 constitute a single liquid-crystal panel.

As can be seen from FIG. 39A and FIG. 39B, the screen 1010 is hidden behind the panel 1400. During normal use, the screen 1010 is in either the display-off mode or the high-impedance mode.

To use the portable telephone as a portable terminal as shown in FIG. 39B, the panel 400 is flipped down, exposing the screen 1010. In this condition, the display-off mode or the high-impedance mode on the screen 1010 is released, and thus a variety of displays are presented on the screen 100 and screen 1010.

Figure 40A:
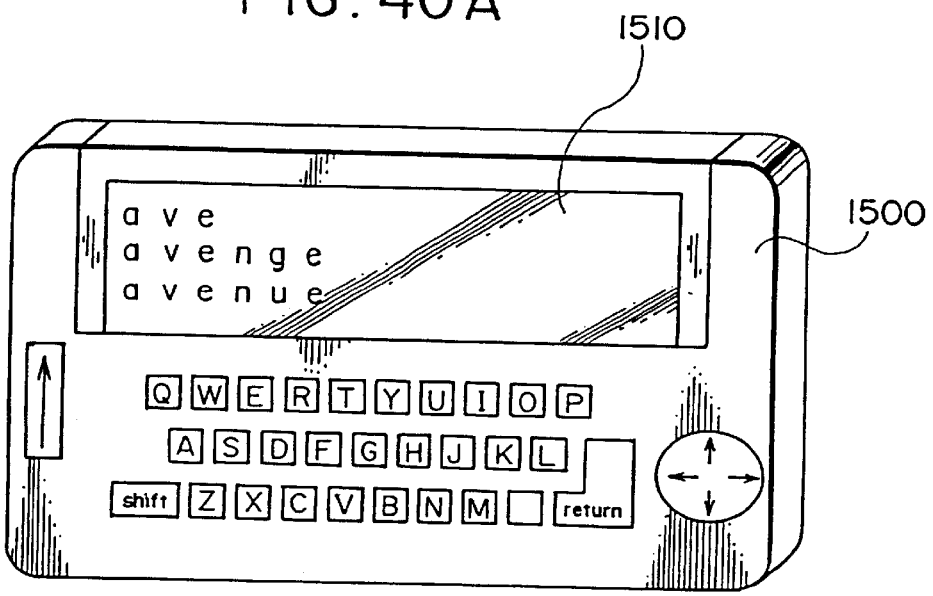
FIG. 40A and FIG. 40B are respectively perspective views showing a portable electronic dictionary.
Figure 40B:
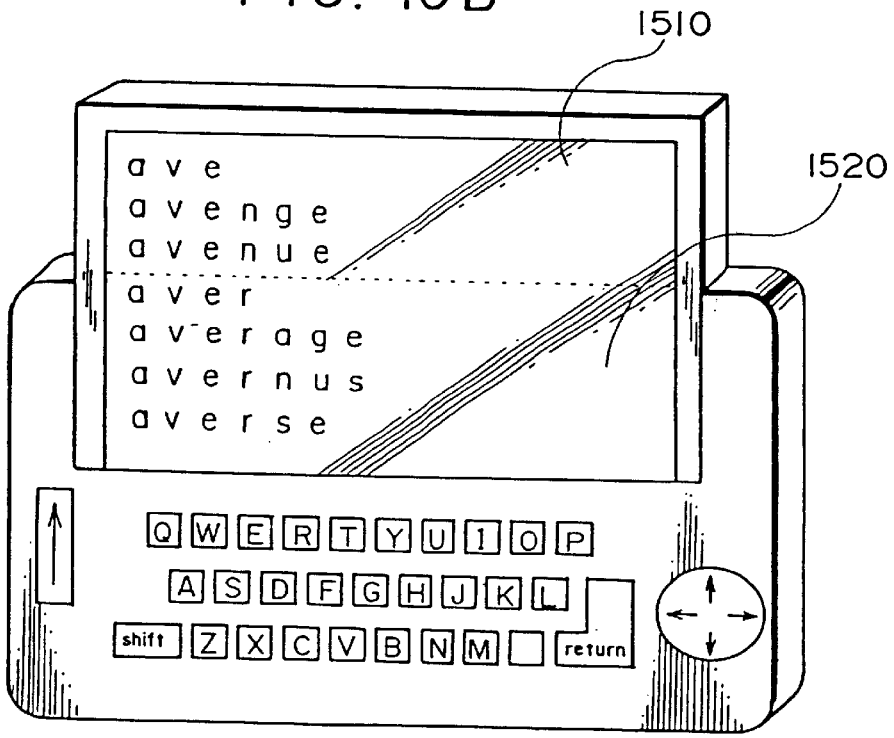

FIG. 40A and FIG. 40B show the operation of a portable electronic dictionary.

The portable electronic dictionary 1500 is normally used as shown in FIG. 40A to present a desired display on a screen 1510.

When the space of the screen 1510 is not large enough, a screen 1520 is pushed up to expand the image display area as shown in FIG. 40B. In the condition shown in FIG. 40A, the screen 1520 remains hidden within the cabinet of the apparatus, and thus the screen 1520 is set to the display-off mode or the high-impedance mode.

Figure 41A:
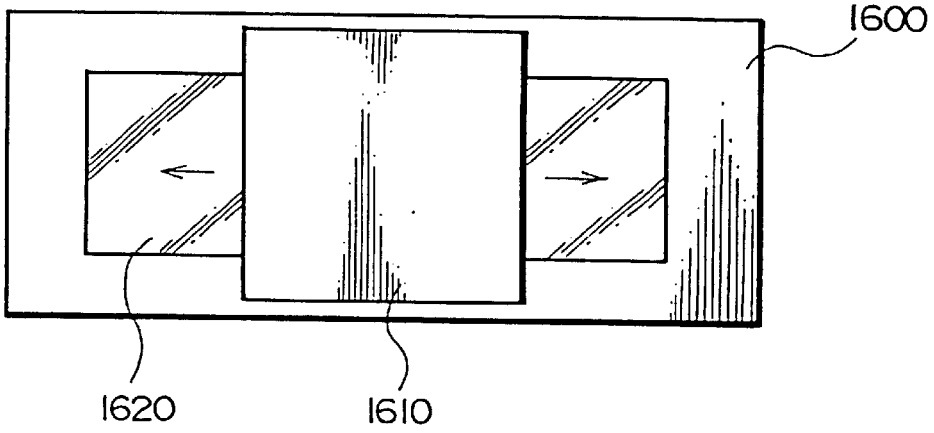
FIG. 41A and FIG. 41B are respectively external views of an electronic apparatus which incorporates the display device of the present invention.
Figure 41B:
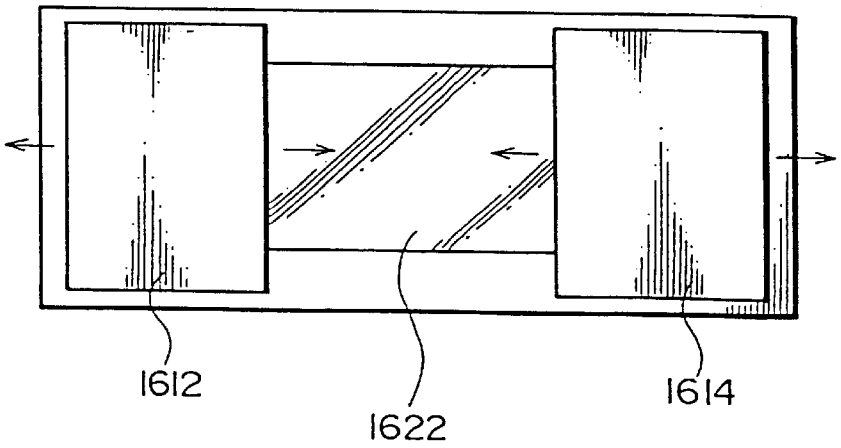

FIG. 41A and FIG. 41B show respectively external views of a portable electronic apparatus.

The portable electronic apparatus shown in FIG. 41 comprises a housing 1600, a display panel 1620, and a cover 1610. The cover 1610 can be sidewardly slid to vary the size of a display area or to partition the display screen of the panel. The invisible portion of the display panel hidden behind the cover 1610 is set to the display-off mode or the high-impedance mode.

Referring to FIG. 41B, two covers 1612, 1614 are provided. Each cover can be sidewardly slid, to vary the size of the display area. The invisible portions of the display panel 1622 hidden behind the covers 1612, 1614 are set to the display-off mode or the high-impedance mode.

Figure 42A:
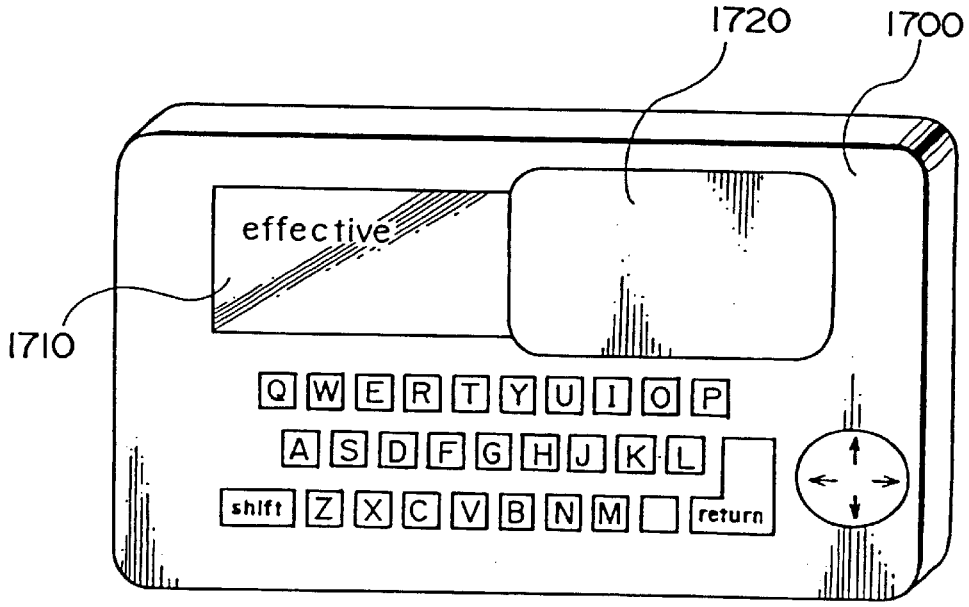
FIG. 42A and FIG. 42B are respectively perspective views showing a portable electronic translator.
Figure 42B:
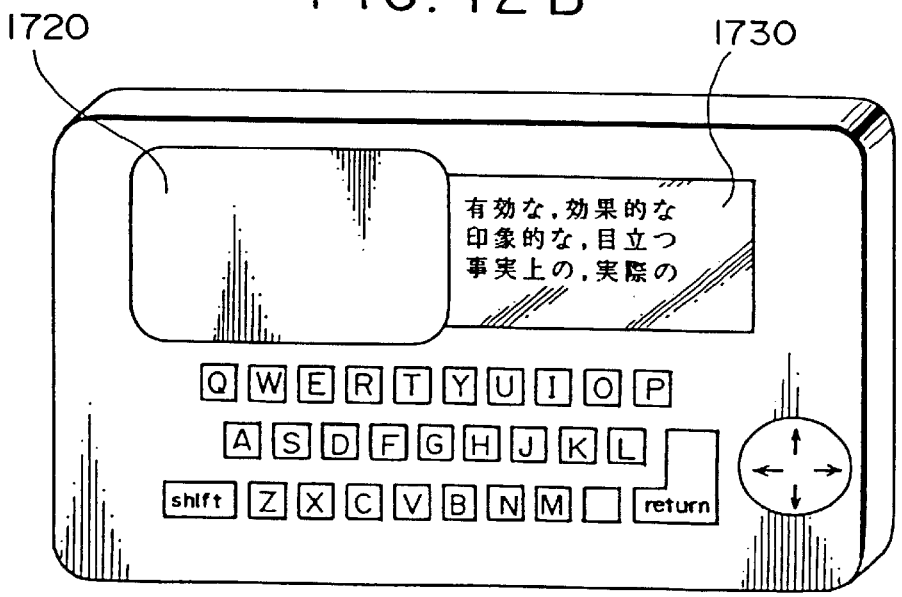

FIG. 42A and FIG. 42B show a portable electronic translator in operation.

The screen 1710 of the portable electronic translator 1700 presents an English word to be translated as shown in FIG. 42A. With its cover 1720 slid as shown in FIG. 42B, Japanese words corresponding to the English word are shown on the screen 1730.

The invisible portion of the screen hidden behind the covers 1612, 1614 are set to the display-off mode or the high-impedance mode.

Figure 43:
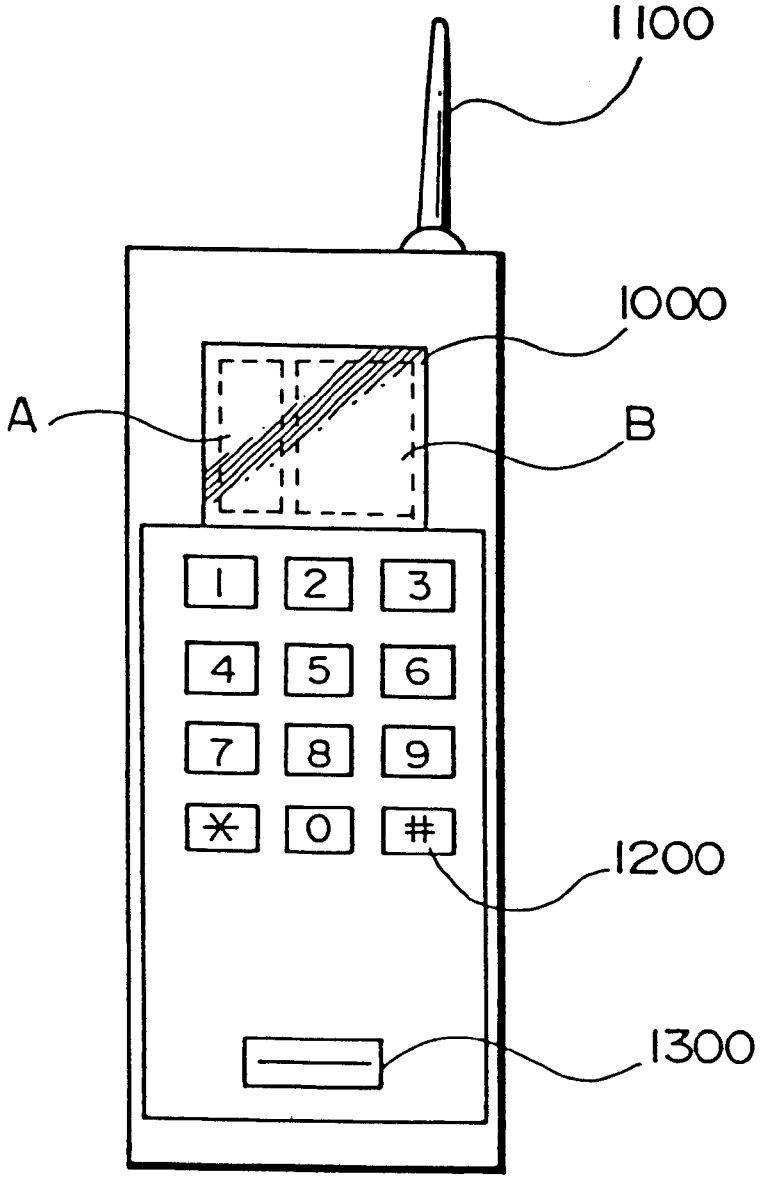
FIG. 43 is an external view of a portable telephone which incorporates the display device.

In a portable telephone shown in FIG. 43,, the display screen of a display panel is partitioned into an area "A" and an area "B" wherein the area "A" presents a simple image such as an icon while the area "B" is set to the display-off mode or the high-impedance mode.

In the above electronic apparatuses, a desired image is presented at an extremely low power consumption by setting an area contributing nothing to image presentation to the display-off mode or the high-impedance mode.

What is claimed is:

1. A driving method of a display device comprising a plurality of scanning lines, a plurality of data lines, a plurality of display elements, the display state of which is controlled by a voltage applied to the scanning lines and a voltage applied to the data lines, and a plurality of driving ICs for driving the data lines, wherein the number of the voltage levels of the scanning lines during a non-selection period is only one, and a display control signal is applied to each of the plurality of ICs for driving the data lines, and in response to the display control signal, parts of data-line drive outputs from the ICs are set to the voltage level of the scanning lines during the non-selection period.

2. A driving method of a display device according to claim 1, wherein when at least parts of data-line drive outputs are set to the voltage level of the scanning lines during the non-selection period, the supply of at least either display data or a high-frequency clock for transferring the display data to the IC is suspended.

3. A driving method of a display device comprising a plurality of scanning lines, a plurality of data lines, a plurality of display elements, the display state of which is controlled by a voltage applied to the scanning lines and a voltage applied to the data lines, and a driving circuit for driving the data lines, wherein the number of voltage levels of the scanning lines during a non-selection period is only one, and a display control signal is applied to the driving circuit for the data lines, and in response to the display control signal, data-line drive outputs are controlled on an individual basis so that a desired drive output is selectively set to the voltage level of the scanning lines during the non-selection period.

4. A driving method of a display device according to claim 3, wherein when scanning-line drive outputs are controlled on an individual basis so that a desired drive output is selectively set to the voltage level of the scanning lines during the non-selection period, the supply of at least either display data or a high-frequency clock for transferring the display data, to the driving circuit for the data lines is suspended.

5. A driving method of a display device comprising a plurality of scanning lines, a plurality of data lines, a plurality of display elements, the display state of which is controlled by a voltage applied to the scanning lines and a voltage applied to the data lines, and a driving circuit for driving the data lines, wherein the number of voltage levels of the scanning lines during a non-selection period is only one, the driving circuit for the data lines comprises a plurality of blocks, a display control signal is applied to the driving circuit for the data lines, and in response to the display control signal, data-line drive outputs are controlled on a block by block basis so that the data-line drive output of a corresponding block is set to the voltage level of the scanning lines during the non-selection period.

6. A driving method of a display device comprising a plurality of scanning lines, a plurality of data lines, a plurality of display elements, a display state of the display elements is controlled by a voltage applied to the scanning lines and a voltage applied to the data lines, and a driving circuit for driving the plurality of data lines, wherein the number of voltage levels of the scanning lines during a non-selection period is only one, simultaneously selecting h scanning lines (h is an integer equal to or greater than 2) out of the plurality of scanning lines;

applying a scan voltage to each of the h scanning lines, the scan voltage being selected according to a voltage pattern;

supplying each of the data lines with a data voltage that is determined by the scan voltage pattern and a display data pattern representative of the display state to be presented; and applying a display control signal to the data-line driving circuit to set at least, parts of the data line drive outputs to the voltage level of the scanning lines during the non-selection period to disable image presentation;

wherein the number of scanning lines, h, simultaneously selected is an even number.

7. A driving method of a display device according to claim 6, wherein the number of scanning lines, h, simultaneously selected is 2, 4, 6, or 8.

8. A driving method of a display device according to claim 6, wherein when, at least, parts of data-line drive outputs are set to the voltage level of the scanning lines during the non-selection period, the supply of at least either display data or a high-frequency clock for transferring the display data to the data-line driving circuit is suspended.

9. A driving method of a display device according to claim 6, wherein the driving circuit for the data lines comprises a plurality of ICs, each of which is supplied with a display control signal, and in response to the display control signal, at least, parts of the data-line drive outputs from the ICs are set to the voltage level of the scanning lines during the non-selection period.

10. A driving method of a display device according to claim 6, wherein a display control signal is applied to the driving circuit of the data lines, and in response to the display control circuit, the data-line outputs are controlled on an individual basis so that a desired drive output is selectively set to the voltage level of the scanning lines during the non-selection period.

11. A driving method of a display device according to claim 6, wherein the driving circuit for the data lines comprises a plurality of blocks, the display control signal is applied to the driving circuit for the data lines, and in response to the display control signal, the data-line drive outputs are controlled on a block by block basis so that the data-line drive output for a corresponding block is set to the voltage level of the scanning lines during the non-selection period.

12. A display device comprising a plurality of scanning lines, a plurality of data lines, a plurality of display elements, the display state of which is controlled by a voltage applied to the scanning lines and a voltage applied to the data lines, a scanning-line driving circuit for driving the plurality of scanning lines and a data-line driving circuit for driving the plurality of data lines, wherein the number of voltage levels of the scanning lines during a non-selection period is only one, a display control signal is applied to the data-line driving circuit, and in response to the display control signal, at least, parts of a plurality of outputs of data-line driving circuit corresponding to the plurality of scanning lines are forced to the voltage level of the scanning lines during the non-selection period so that the area of the corresponding data lines is an area to be set to display-off state wherein the data-line driving circuit comprises a first temporary memory for storing temporarily display control data, a second temporary memory for storing temporarily display data, a decoder circuit for decoding the display control data output from the first temporary memory and the display data output from the second temporary memory, and for determining a drive voltage at each output given by the data-line driving circuit.

13. A display device according to claim 12, wherein the area to be set to the display-off state is designated by a combination of a plurality of display control signals.

14. A display device according to claim 12, wherein both a display-off state area and a display-enabled area exist in a screen, and the size of the display-enabled area is smaller than the display-off state area.

15. An electronic apparatus comprising a display device according to claim 12.

16. A display device comprising a plurality of scanning lines, a plurality of data lines, a plurality of display elements, the display state of which is controlled by a voltage applied to the scanning lines and a voltage applied to the data lines, a scanning-line driving circuit for driving the plurality of scanning lines and a data-line driving circuit for driving the plurality of data lines, wherein the number of voltage levels of the scanning lines during a non-selection period is only one, a display control signal is applied to the data-line driving circuit, and in response to the display control signal, at least parts, of a plurality of outputs of data-line driving circuit corresponding to the plurality of scanning lines are forced to the voltage level of the scanning lines during the non-selection period so that the area of the corresponding data lines is an area to be set to display off state wherein the scanning-line driving circuit selects simultaneously a plurality of scanning lines and applies a scan voltage based on a selection voltage pattern to each of the scanning lines, and the data-line driving circuit determines the voltage applied to the data lines by comparing the selection voltage pattern with a display data pattern representative of the display state to be presented, and applies the determined voltage to each of the data lines;

wherein the number of scanning lines, h, simultaneously selected is an even number.

17. A display device comprising a plurality of scanning lines, a plurality of data lines, a plurality of display elements, the display state of which is controlled by a voltage applied to the scanning lines and a voltage applied to the data lines, a scanning-line driving circuit for driving the plurality of scanning lines and a data-line driving circuit for driving the plurality of data lines, wherein the number of voltage levels of the scanning lines during a non-selection period is only one, a display control signal is applied to the data-line driving circuit, and in response to the display control signal, at least, parts of a plurality of outputs of data-line driving circuit corresponding to the plurality of scanning lines are forced to the voltage level of the scanning lines during the non-selection period so that the area of the corresponding data lines is an area to be set to display-off state wherein the display device includes a section that covers at least part of a screen and the covered area of the screen becomes a display-off state area.

18. A display device according to claim 17, wherein the section that covers at least part of the screen is at least one movable member.

19. A display device according to claim 17, wherein the screen can be partly retracted into the cabinet of the display device, and wherein with the screen partly retracted, the retracted portion of the screen is set to the display-off area, while with the screen fully exposed, the portion that was retracted is set to a display-enabled area.

20. A driving method of a display device comprising N scanning lines (N is an integer equal to or greater than 2), M data lines (M is an integer equal to or greater than 2), a plurality of display elements, the display state of which is controlled by a voltage applied to the scanning lines and a voltage applied to the data lines, a driving circuit for the scanning lines, and a driving circuit for the data lines, wherein a display control signal is applied to the scanning-line driving circuit, consecutive K scanning lines (K is an integer equal to or greater than 2 but smaller than N) out of the N scanning lines are deselected from the range of selection, based on the display control signal, only (N−K) scanning lines are selected to be displayed, and the scanning line voltage level during a selection period when (N−K) scanning lines are driven is set to be lower than the scanning line voltage level during the selection period when N scanning lines are driven and the number of voltage levels of the scanning lines during a non-selection period is one.

21. A driving method of a display device according to claim 20, wherein the change of the voltage level of the scanning lines during the selection period is performed by using the display control signal that changes the level of the voltage a variable voltage source supplies to the scanning-line driving circuit.

22. A driving method of a display device according claim 21, wherein the variable voltage source is provided with a bootstrap circuit, which generates a plurality of voltages of different levels, by changing at least either the quantity of charge stored in a capacitor or the voltage of one polarity that is lower in voltage level after a polarity reversion of the capacitor.

23. A driving method of a display device according to claim 20, wherein h scanning lines (h is an integer equal to or greater than 2) are simultaneously selected, and a scan voltage based on a predetermined selection voltage pattern is applied to each of the scanning lines for image presentation.

24. A display device that adopts the driving method according to claim 20.

25. A display device comprising a plurality of scanning lines, a plurality of data lines, a plurality of display elements, the display state of which is controlled by a voltage applied to the scanning lines and a voltage applied to the data lines, a driving circuit for driving the scanning lines and a driving circuit for driving the data lines, wherein the driving circuit for the scanning lines simultaneously selects h scanning lines (h is an integer equal to or greater than 2) in a normal display mode to apply a scan voltage based on a predetermined selection voltage pattern to each of the scanning lines, and applies the same scan voltage to consecutive Q scanning lines when a resolution of 1/Q (Q is an integer equal to or greater than 2) is designated by a resolution conversion signal, thus to simultaneously selects (Q×h) scanning lines, the data-line driving circuit determines the voltage applied to the data lines by comparing the selection voltage pattern with the display data representative of the display status of each display element, and applies the determined voltage to each of the data lines.

26. A display device that adopts the driving method according to claim 25.

27. A driving method of a display device comprising N scanning lines (N is an integer equal to or greater than 2), M data lines (M is an integer equal to or greater than 2), a plurality of display elements, the display state of which is controlled by a voltage applied to the scanning lines and a voltage applied to the data lines, a driving circuit for the scanning lines, and a driving circuit for the data lines, wherein the number of voltage levels of the scanning lines during a non-selection period is only one, a display control signal is applied to the driving circuit for the scanning lines, and in response to the display control signal, an area corresponding to consecutive K scanning lines (K is an integer equal to or greater than 2 but smaller than N) out of the N scanning lines is set to a display-off state, an area corresponding to the remaining scanning lines is a display-enabled area, and the K scanning lines are kept to the voltage level during the non-selection period without applying a selection voltage thereto, while the data lines are supplied with the voltage, which is to be applied for image presentation, for a duration in which the K scanning lines should otherwise be selected.

28. A driving method of a display device according to claim 27;

wherein h scanning lines (h is an integer equal to or greater than 2) are simultaneously selected as the scanning lines responsible for the display-enabled area, and are respectively supplied with a scan voltage based on a predetermined selection voltage pattern.

29. A display device that adopts the driving method according to claim 27.

30. A display device according to claim 29, wherein the display device includes a section that covers at least part of a screen and the covered area of the screen is a display-off state area.

31. A display device according to claim 30, wherein the section that covers at least part of the screen is at least one movable member.

32. An electronic apparatus comprising a display device according to claim 29.

33. A display device according to claim 30, wherein the screen can be partly retracted into the cabinet of the display device, and wherein with the screen partly retracted, the retracted portion of the screen is set to the display-off state area, while with the screen fully exposed, the portion that was retracted is set to the display-enabled area.

34. A display device comprising N scanning lines (N is an integer equal to or greater than 2), M data lines (M is an integer equal to or greater than 2), a plurality of display elements, the display state of which is controlled by a voltage applied to the scanning lines and a voltage applied to the data lines, a driving circuit for the scanning lines, and a driving circuit for the data lines, wherein at least either the scanning lines or the data lines are provided with a plurality of switch means in the driving circuits which are arranged in voltage paths to the scanning lines or the data lines and are controlled by a control signal for open or close state, and when no image is presented, the switch means in the driving circuits are put to the open state to float electrically the scanning lines or data lines.

35. A display device comprising:

a first panel comprising a plurality of scanning lines, a plurality of data lines, a plurality of display elements, the display state of which is controlled by a voltage applied to the scanning lines and a voltage applied to the data lines, a driving circuit for driving the scanning lines, a driving circuit for driving the data lines and a power supply circuit for supplying power to the driving circuit for the scanning lines and the driving circuit for the data lines, and a second panel having a larger number of scanning lines than the first panel, wherein the number of scanning lines in the first display panel is set so that a selection voltage level of the scanning lines coincides with one of a plurality of drive voltage levels for the data lines, and the driving circuit for the scanning lines and the driving circuit for the data lines are supplied with a common voltage equal to the level of the selection voltage of the scanning lines, by the power supply circuit.

36. A display device comprising:

a display matrix comprising a plurality of first conductive lines running in a predetermined direction, a plurality of second conductive lines running a direction that intersects the first conductive lines, a plurality of display elements at the intersections of the first and second lines, a first driving circuit for driving the first conductive lines, and a second driving circuit for driving the second conductive lines, wherein the first driving circuit comprises driving means for driving the first conductive lines as data lines, and driving means for driving the first conductive lines as scanning lines, and the second driving circuit comprises driving means for driving the second conductive lines as scanning lines, and driving means for driving the second conductive lines as data lines, wherein when the first driving circuit functions as a data-line driving circuit, the second driving circuit functions as a scanning-line driving circuit, and when the second driving circuit functions as a scanning-line driving circuit, the second driving circuit functions as a data-line driving circuit;

wherein the first and second driving circuits switch their functions based on a shape of a display area and parts of the display area are set to a display-off state.

* * * * *

UNITED STATES PATENT AND TRADEMARK OFFICE

CERTIFICATE OF CORRECTION

PATENT NO. : 6,262,704 B1
DATED : July 17, 2001
INVENTOR(S) : Takashi Kurumisawa et al.

It is certified that error appears in the above-identified patent and that said Letters Patent is hereby corrected as shown below:

Title page,
Item [56], References Cited, U.S. PATENT DOCUMENTS, add
-- 4,764,766 8/1998 Aoyama et al. --.
FOREIGN PATENT DOCUMENTS, list all Japanese references as follows:

| | | |
|---|---|---|
| -- 5-199482 | 8/6/93 | (JP) |
| 6-95621 | 4/8/94 | (JP) |
| 3-248122 | 11/6/91 | (JP) |
| 7-170470 | 7/4/95 | (JP) |
| 6-301010 | 10/28/94 | (JP) |
| 61-202973 | 12/20/86 | (JP) |
| 3-241984 | 10/29/91 | (JP) |
| 61-124531 | 6/5/87 | (JP) |
| 58-10784 | 1/21/83 | (JP) |
| 4-70625 | 3/5/92 | (JP) |
| 4-490 | 1/6/92 | (JP) -- |

Column 5,
Line 28, delete “fet” and insert -- set -- therefor.

Column 8,
Line 65, delete “are two levels”.
Line 67, after “period” insert a comma.

Column 10,
Line 53, “a - n” should be -- an --.

Column 11,
Line 6, delete “as”.
Line 30, delete “show” and insert -- shown -- therefor.
Line 38, after “it” insert -- is --.

Column 13,
Line 5, “gates” should be -- gate --.

Column 16,
Line 22, after “FIG. 21” insert a comma.

UNITED STATES PATENT AND TRADEMARK OFFICE

CERTIFICATE OF CORRECTION

PATENT NO. : 6,262,704 B1
DATED : July 17, 2001
INVENTOR(S) : Takashi Kurumisawa et al.

It is certified that error appears in the above-identified patent and that said Letters Patent is hereby corrected as shown below:

Column 19,
Line 10, "FIG. 28b" should be -- FIG. 28B --.
Line 20, delete "fet" and insert -- fed -- therefor.
Line 40, "0UT8" should be -- OUT8 -- (letter O not a zero).
Line 49, delete "an" and insert -- a -- therfor.

Column 21,
Line 47, "Na1" should be -- NA1 --.

Column 22,
Line 26, insert a period after "lines".

Column 26,
Lines 3 and 42, insert a comma after "state".

Column 27,
Line 4, insert a comma after "state".

Column 28,
Line 9, "selects" should be -- select --.
Lines 12-13, "selection voltage pattern" should be -- scan voltage --.
Line 42, "claim 29;" should be -- claim 27 --.

Signed and Sealed this

Eighth Day of March, 2005

JON W. DUDAS
*Director of the United States Patent and Trademark Office*